US008394214B2

(12) United States Patent
Nakamura et al.

(10) Patent No.: US 8,394,214 B2
(45) Date of Patent: Mar. 12, 2013

(54) METHOD FOR PROCESSING METAL BODY AND APPARATUS FOR PROCESSING METAL BODY

(75) Inventors: Katsuaki Nakamura, Fukuoka (JP); Zenji Horita, Fukuoka (JP); Koji Neishi, Fukuoka (JP); Michihiko Nakagaki, Munakata (JP); Kenji Kaneko, Fukuoka (JP)

(73) Assignee: Rinascimetalli Ltd., Fukuoka (JP)

( * ) Notice: Subject to any disclaimer, the term of this patent is extended or adjusted under 35 U.S.C. 154(b) by 943 days.

(21) Appl. No.: 10/549,411

(22) PCT Filed: Mar. 10, 2004

(86) PCT No.: PCT/JP2004/003252

§ 371 (c)(1),
(2), (4) Date: Dec. 21, 2005

(87) PCT Pub. No.: WO2004/080625

PCT Pub. Date: Sep. 23, 2004

(65) Prior Publication Data

US 2006/0157168 A1 Jul. 20, 2006

(30) Foreign Application Priority Data

Mar. 10, 2003 (JP) ..... 2003-64160

(51) Int. Cl.
*C21D 9/00* (2006.01)

(52) U.S. Cl. ..... 148/559; 148/558; 148/641

(58) Field of Classification Search ..... 148/559, 148/558

See application file for complete search history.

(56) References Cited

U.S. PATENT DOCUMENTS

| | | | | |
|---|---|---|---|---|
| 3,534,574 | A * | 10/1970 | McMaster | 72/57 |
| 3,794,528 | A * | 2/1974 | Rosales | 148/671 |
| 6,209,379 | B1 | 4/2001 | Nishida et al. | |
| 6,742,374 | B2 * | 6/2004 | Ozawa | 72/342.5 |
| 7,559,221 | B2 * | 7/2009 | Horita et al. | 72/342.6 |
| 7,637,136 | B2 * | 12/2009 | Horita et al. | 72/371 |
| 2002/0157740 | A1 | 10/2002 | Appel et al. | |
| 2006/0260378 | A1 * | 11/2006 | Horita et al. | 72/342.1 |
| 2008/0110226 | A1 * | 5/2008 | Horita et al. | 72/342.5 |

FOREIGN PATENT DOCUMENTS

| | | |
|---|---|---|
| DE | 60010968 | 6/2005 |
| EP | 1044741 | 10/2000 |
| JP | 2-89599 | 3/1990 |
| JP | 2000-239772 | 9/2000 |

(Continued)

OTHER PUBLICATIONS

Machine translation document of JP2001-321825 (Nov. 20, 2001).*

*Primary Examiner* — Jie Yang
(74) *Attorney, Agent, or Firm* — Jordan and Hamburg LLP

(57) ABSTRACT

The present invention provides a method for processing a metal body which can turn a metal structure of the metal body into a finer grain structure thus obtaining the high strength and the high ductility. In a method or an apparatus for processing a metal body which turns the metal structure of the metal body into the finer grain structure by forming a low deformation resistance region where the deformation resistance is locally lowered in the metal body and by deforming the low deformation resistance region by shearing, using a non-low deformation resistance region forming means which forms a non-low deformation resistance region by increasing the deformation resistance which is lowered in the low deformation resistance region, the non-low deformation resistance region is formed along the low deformation resistance region.

4 Claims, 21 Drawing Sheets

FOREIGN PATENT DOCUMENTS

| | | |
|---|---|---|
| JP | 2000-288675 | 10/2000 |
| JP | 2001-321825 | 11/2001 |
| JP | 3268639 | 1/2002 |
| JP | 2002-102982 | 4/2002 |
| JP | 2002-241912 | 8/2002 |
| JP | 2003-89858 | 3/2003 |

* cited by examiner

METHOD FOR PROCESSING METAL BODY AND APPARATUS FOR PROCESSING METAL BODY

TECHNICAL FIELD

The present invention relates to a method for processing a metal body and an apparatus for processing a metal body which allows the metal body to have a high strength, the high ductility or the uniform structure by turning the metal structure of an object such as a metal body into a finer grain structure.

BACKGROUND ART

Conventionally, there has been known that with respect to a material which possesses the metal structure such as a metal body, the strength or the ductility of the material can be enhanced by turning the metal structure into the finer grain structure using an ECAP (Equal Channel Angular Pressing) method.

In the ECAP method, as shown in FIG. 33, the metal structure is turned into the finer grain structure in such a manner that an insertion passage 200 which has a midst portion thereof bent at a desired angle is formed in a die 100, a desired metal body 300 is inserted into the insertion passage 200 by pushing so as to bend the metal body 300 along the insertion passage 200 and hence, a shearing stress is generated in the metal body 300 due to such bending, whereby the metal structure is turned into the finer grain structure due to the shearing stress. In FIG. 33, numeral 400 indicates a plunger which pushes the metal body.

In such an ECAP method, to facilitate the bending of the metal body 300 along the insertion passage 200, the deformation resistance is lowered by heating the whole metal body 300 by heating the die 100 at a given temperature. However, when the deformation resistance of the metal body 300 is largely lowered, there exists a possibility that the undesired deformation such as buckling is generated in the metal body 300 when the metal body 300 is pushed by the plunger 400 and hence, it is necessary to suppress the heating of the metal body 300 to a necessary minimum.

When the heating of the metal body 300 is suppressed, since it is necessary to push the metal body 300 by the plunger 400 with a relatively large force, there has been a drawback that the formability is poor.

Accordingly, in a method for processing a metal material and an apparatus for processing the metal material disclosed in Japanese patent laid-open-2001-321825, there has been proposed a technique in which a shearing deformation region of an insertion passage where a shearing stress is applied to a metal body is locally heated and hence, the deformation resistance of a shearing deformation portion of the metal body is reduced by heating, whereby a force which pushes the metal body using a plunger can be decreased thus enhancing the formability.

However, usually, when a portion of a metal-made die is locally heated, the whole die is heated to a given temperature due to the influence of thermal diffusion and hence, the formation of the locally heated region is difficult.

Accordingly, so long as the metal body is inserted in the insertion passage, the metal body is continuously heated at the given temperature and hence, there has been a possibility that the metal structure which is once turned into the finer grain structure by the shearing stress becomes coarse.

Further, since the ECAP method is required to use the die which is a consumable product, it is necessary to exchange the die depending on the durable condition of the die thus also giving rise to a drawback that a manufacturing cost is pushed up.

In such circumstances, recently, in an automobile industry particularly, the reduction of weight of a vehicle body or the like is desired for enhancing the mileage or for enhancing the traveling performances. Here, there exits a considerable demand for the reduction of weight by making use of a metal body which can obtain a high strength by making the metal structure finer not only with respect to high-class cars but also with respect to general-use cars. Accordingly, there exists a potential demand for a metal body which possesses a high strength or high ductility at a low cost.

Inventors of the present invention have made research and development for manufacturing various kinds of metal bodies which possess the high strength or the high ductility at a low cost by turning the metal structure into a finer grain structure and have arrived at the present invention.

DISCLOSURE OF THE INVENTION

According to one aspect of the invention, in a method for processing a metal body which can make the metal structure of the metal body finer by forming a low deformation resistance region where the deformation resistance is locally lowered in the metal body and by deforming the low deformation resistance region by shearing, a non-low deformation resistance region is formed along the low deformation resistance region using a non-low deformation resistance region forming means which forms the non-low deformation resistance region by increasing the deformation resistance which is lowered in the low deformation resistance region. Due to such a constitution, it is possible to efficiently turn the metal structure of the low deformation resistance region portion which is locally formed into the finer grain structure.

According to another aspect of the invention, in a method for processing a metal body which turns the metal structure of the metal body into the finer grain structure by forming a low deformation resistance region which traverses the metal body by locally lowering the deformation resistance of a metal body which extends in one direction and by deforming the low deformation resistance region by shearing, using a non-low deformation resistance region forming means which forms a non-low deformation resistance region by increasing the deformation resistance which is lowered in the low deformation resistance region, the non-low deformation resistance region is formed along at least one side periphery of the low deformation resistance region. Due to such a constitution, it is possible to efficiently turn the metal structure of the low deformation resistance region portion which is locally formed into the finer grain structure.

According to another aspect of the invention, the metal body is moved along the extending direction and, at the same time, the non-low deformation resistance region is formed by the non-low deformation resistance region forming means along side peripheries of the low deformation resistance region at a downstream side in the moving direction. Due to such a constitution, it is possible to extremely efficiently and continuously form the metal body having the finer metal structure.

According to another aspect of the invention, the non-low deformation resistance region forming means includes cooling means which cools the metal body. Due to such a constitution, it is possible to extremely easily and surely form the non-low deformation resistance region and hence, the metal body having finer grain structure can be surely formed at a low cost.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the low deformation resistance region is formed in a vacuum. Due to such a constitution, it is possible to prevent the formation of a reaction film of a gaseous component on a surface of the low deformation resistance region deformed by shearing and hence, the processing in post steps can be alleviated. Particularly, when the metal body is heated in forming the low deformation resistance region, it is possible to cool the metal body by making use of a self cooling function without using the cooling means and hence, the efficiency of formation of the low deformation resistance region can be enhanced.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the low deformation resistance region is formed in a high pressure atmosphere. Due to such a constitution, by applying the high pressure to the low deformation resistance region, it is possible to enhance the efficiency in turning the metal structure into the finer grain structure.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the low deformation resistance region is formed in an active gas atmosphere. Due to such a constitution, while turning the metal structure of the metal body into the finer grain structure, it is possible to form a reaction region with the active gas on a surface of the low deformation resistance region and hence, it is possible to form the highly functionalized metal body.

According to another aspect of the invention, in the method for processing a metal body described in claim 7, the active gas is nitrogen gas. Due to such a constitution, while turning the metal structure of the metal body into the finer grain structure, it is possible to nitride the low deformation resistance region and hence, it is possible to form the highly functionalized metal body.

According to another aspect of the invention, in the method for processing a metal body described in claim 7, the active gas is methane gas and/or carbon monoxide gas. Due to such a constitution, while turning the metal structure of the metal body into the finer grain structure, it is possible to apply the carburizing treatment to the low deformation resistance region and hence, it is possible to form the highly functionalized metal body.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, a powdery material is sprayed to the low deformation resistance region. Due to such a constitution, while turning the metal structure of the metal body into the finer grain structure, it is possible to mechanically mix the powdery material into the low deformation resistance region and hence, it is possible to form the highly functionalized metal body. Particularly, it is possible to easily form a metal body having the composition which is difficult to manufacture by the conventional casting and, at the same time, when a powdery material other than metal is sprayed to the low deformation resistance is sprayed, it is also possible to produce a novel material.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, ion doping is applied to the low deformation resistance region. Due to such a constitution, while turning the metal structure of the metal body into the finer grain structure, it is possible to mix the ionized particles into the low deformation resistance region and hence, it is possible to form the highly functionalized metal body. Particularly, it is possible to easily form the metal body having the composition which is hardly formed using the conventional casting.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the low deformation resistance region is formed by applying second heating to the metal body after applying first heating for a given time. Due to such a constitution, a heating state of the low deformation resistance region can be homogenized in the formation of the low deformation resistance region by heating and hence, it is possible to turn the metal structure into finer homogenous structure.

According to another aspect of the invention, in the method for processing a metal body, the low deformation resistance region is formed by applying second heating to the metal body after applying first heating for a given time. Due to such a constitution, a heating state of the low deformation resistance region can be homogenized in the formation of the low deformation resistance region by heating and hence, it is possible to turn the metal structure into finer homogenous structure.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the low deformation resistance region is formed in a non-constraining region of constraining means which constrains the metal body heated to a high temperature. Due to such a constitution, it is possible to turn the metal structure of the metal body in the heated state during the manufacturing steps of the metal body into the finer grain structure and hence, the metal body having the finer metal structure can be manufactured without increasing the manufacturing steps.

According to another aspect of the invention, the low deformation resistance region is formed in a non-constraining region of constraining means which constrains the metal body heated to a high temperature.

Due to such a constitution, it is possible to turn the metal structure of the metal body in the heated state during the manufacturing steps of the metal body into the finer grain structure and hence, the metal body having the finer metal structure can be manufactured without increasing the manufacturing steps.

According to another aspect of the invention, the metal body is quenched after the deformation by shearing. Due to such a constitution, the growth of the metal structure attributed to the continuation of the heating state can be suppressed and, at the same time, the quench hardening can be applied to the metal body whereby it is possible to form the highly functionalized metal body.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the low deformation resistance region is formed by heating the metal body and, at the same time, the metal body is quenched after the low deformation resistance region is deformed by shearing. Due to such a constitution, it is possible to prevent the growth of the metal structure attributed to the continuation of the heating state and, at the same time, the quench hardening can be applied to the metal body whereby it is possible to form the highly functionalized metal body.

According to another aspect of the invention, the low deformation resistance region is formed by heating the metal body and, at the same time, the metal body is quenched after the low deformation resistance region is deformed by shearing. Due to such a constitution, it is possible to prevent the growth of the metal structure attributed to the continuation of the heating state and, at the same time, the quench hardening can be applied to the metal body whereby it is possible to form the highly functionalized metal body.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the low deformation resistance region is formed in the metal body which is immersed in a liquid. Due to such a constitution, the irregularities of conditions for forming the low deformation resistance region can be suppressed whereby it is possible to turn the metal structure into the homogeneous finer grain structure.

According to another aspect of the invention, in the method for processing a metal body, the low deformation resistance region is formed by heating the metal body in the liquid. Due to such a constitution, it is possible to speedily cool the low deformation resistance region which is formed by heating. Particularly, it is possible to continuously perform the quench hardening to portions where the deformation by shearing is finished. Accordingly, the more highly functionalized metal body can be formed.

According to another aspect of the invention, in forming the low deformation resistance region, the heat conductivity of a periphery of the low deformation resistance region is lowered. Accordingly, it is possible to efficiently heat the metal body in the liquid.

According to another aspect of the invention, in forming the low deformation resistance region, bubbles are generated in a periphery of the low deformation resistance region. Due to such a constitution, it is possible to efficiently heat the metal body in the liquid.

According to another aspect of the invention, in a method for processing a metal body which turns the metal structure of the metal body into the finer grain structure by forming a low deformation resistance region where the deformation resistance is locally lowered in the metal body and by deforming the low deformation resistance region by shearing, the metal body which has the finer metal structure is subjected to plastic forming without turning the metal structure into coarser grain structure. Due to such a constitution, since the metal structure can be turned into the finer grain structure, it is possible to provide the metal body which possesses the high strength and the high ductility and also possesses a given shape.

According to another aspect of the invention, the metal body which has the finer metal structure is subjected to plastic forming without turning the metal structure into coarser grain structure. Due to such a constitution, since the metal structure can be turned into the finer grain structure, it is possible to provide the metal body which possesses the high strength and the high ductility and also possesses a given shape.

According to another aspect of the invention, the plastic forming is performed in a heated state for a short time which does not turn the metal structure of the metal body into coarser grain structure. Due to such a constitution, it is possible to prevent a drawback that the acquisition of the high strength and the high ductility is obstructed due to the growth of the metal structure during the plastic forming.

According to another aspect of the invention, the aging treatment is performed without turning the metal structure into coarser grain structure after the metal structure is subjected to plastic forming. Due to such a constitution, the metal body who has acquired the high strength or the high ductility can further enhance the strength thereof.

According to another aspect the invention, the metal body is subjected to the carburizing treatment. Due to such a constitution, it is possible to turn the metal structure into the finer grain structure by performing the carburizing treatment along with the deformation of the low deformation resistance region by shearing and hence, the more highly functionalized metal body can be formed.

According to another aspect of the invention, the metal structure of the metal body is turned into the finer grain structure by stretching the low deformation resistance region. Due to such a constitution, it is possible to apply not only the strain attributed to shearing but also the strain attributed to the stretching to the low deformation resistance region and hence, the metal structure can be turned into the further finer metal structure.

According to another aspect of the invention, the metal structure of the metal body is turned into the finer grain structure by compressing the low deformation resistance region. Due to such a constitution, it is possible to apply not only the strain attributed to shearing but also the strain attributed to the compacting to the low deformation resistance region and hence, the metal structure can be turned into the further finer metal structure. Particularly, by compressing the low deformation resistance region, it is possible to prevent the occurrence of a drawback that the metal body is cracked due to the deformation by shearing imparted to the low deformation resistance region, and the low deformation resistance region can be further deformed by shearing thus turning the metal structure into the further finer grain structure.

According to another aspect of the invention, the metal body is formed in a cylindrical body having a hollow portion and the hollow portion is held in a reduced pressure state. Due to such a constitution, it is possible to deform the low deformation resistance region by shearing in a state that the metal body is deformed by contracting toward the hollow portion in the low deformation resistance region thus turning the metal structure into the further finer grain structure.

According to another aspect of the invention, the metal body is formed in a cylindrical body having a hollow portion and the hollow portion is held in a high pressure state. Due to such a constitution, it is possible to deform the low deformation resistance region by shearing in a state that the metal body is deformed by expansion in the low deformation resistance region thus turning the metal structure into the further finer grain structure.

According to another aspect of the invention, a forming guide body which forms the metal body into a given shape is brought into contact with the low deformation resistance region. Due to such a constitution, while turning the metal structure into the finer grain structure in the low deformation resistance region due to the deformation by shearing, it is possible to deform a shape of metal body into desired shape using the forming guide body and hence, it is possible to provide the metal body which possesses the high strength and the high ductility and also has the desired shape.

According to another aspect of the invention described, the forming guide body constitutes heating means which heats the metal body. Due to such a constitution, it is possible to locally heat a contact portion of the metal body which is brought into contact with the forming guide body and hence, the formation of the low deformation resistance region is further facilitated.

According to another aspect of the invention, the forming guide body constitutes cooling means which cools the metal body. Due to such a constitution, it is possible to locally cool a contact portion of the metal body which is brought into contact with the forming guide body and hence, the low deformation resistance region after the deformation by shearing can be efficiently cooled whereby the manufacturing efficiency can be enhanced.

According to another aspect of the invention, the low deformation resistance region is formed in a transverse manner in the metal body which is extended in one direction, and the low deformation resistance region is moved along the extending direction of the metal body. Due to such a constitution, it is possible to extremely easily turn the whole metal structure of the metal body which is extended in one direction into the finer grain structure and hence, it is possible to continuously turn the metal structure into the finer grain structure.

According to another aspect of the invention, the low deformation resistance region traverses the metal body, and one of non-low deformation resistance regions of the metal body which sandwich the low deformation resistance region has a position thereof fluctuated relative to another non-low deformation resistance region is fluctuated thus deforming the low deformation resistance region by shearing. Due to such a constitution, it is possible to turn the metal structure of the portion of the low deformation resistance region which is locally formed into the finer grain structure and hence, the metal body which possesses the high strength and the high ductility can be easily formed.

According to another aspect of the invention, the fluctuation of the position is a vibratory motion having vibratory motion components which allow the vibratory motion of one non-low deformation resistance region relative to another non-low deformation resistance region in the direction substantially orthogonal to the extending direction of the metal body. Due to such a constitution, it is possible to extremely easily generate the deformation by shearing in the low deformation resistance region.

According to another aspect of the invention, the fluctuation of the position is a one-way rotational motion which allows the rotation of one non-low deformation resistance region relative to another non-low deformation resistance region about a rotary axis which is arranged substantially parallel to the extending direction of the metal body. Due to such a constitution, it is possible to extremely easily generate the deformation by shearing in the low deformation resistance region.

According to another aspect of the invention, the fluctuation of the position is a both-way rotational motion which allows the rotation of one non-low deformation resistance region relative to another non-low deformation resistance region about a rotary axis which is arranged substantially parallel to the extending direction of the metal body. Due to such a constitution, it is possible to extremely easily generate the deformation by shearing in the low deformation resistance region.

According to another aspect of the invention, a metal body in a heated state which is extended in one direction is moved along the extending direction, the metal body is cooled by allowing the metal body to pass through cooling means, and the cooled metal body is subjected to a vibratory motion thus turning the metal structure in the metal body into the finer grain structure by deforming the metal structure by shearing before the metal body is allowed to pass through the cooling means. Due to such a constitution, in the course of the manufacturing step of the metal body such as hot rolling or the like, it is possible to turn the metal structure of the metal body into the finer grain structure and hence, it is possible to produce the highly value-added metal body without increasing a manufacturing cost.

According to another aspect of the invention, in performing solution heat treatment by quenching a metal body which is heated up to a temperature for performing the solution heat treatment using cooling means, the metal body at a quenched portion is deformed by shearing thus turning the metal structure into finer metal structure and, at the same time, the solution heat treatment is performed. Due to such a constitution, it is possible to manufacture the metal body which is subjected to the solution heat treatment in a state that the metal structure is turned into the finer grain structure and hence, it is possible to manufacture the metal body which possesses the high strength and the high ductility.

According to another aspect of the invention, the deformation of the metal body by shearing is performed by imparting a vibratory motion which includes vibratory motion components which generate the vibratory motion in the direction substantially orthogonal to the extending direction of the metal body which is extended in one direction. Due to such constitution, it is possible to extremely easily deform the metal body by shearing.

According to another aspect of the invention, the deformation of the metal body by shearing is performed by imparting a one-way rotational motion which generates the rotation about a rotational axis substantially parallel to the extending direction of the metal body which is extended in one direction to the metal body. Due to such constitution, it is possible to extremely easily deform the metal body by shearing.

According to another aspect of the invention, the deformation of the metal body by shearing is performed by imparting a both-way rotational motion which generates the rotation about a rotational axis substantially parallel to the extending direction of the metal body which is extended in one direction to the metal body. Due to such a constitution, it is possible to extremely easily deform the metal body by shearing.

According to another aspect of the invention, the metal body whose metal structure is turned into the finer grain structure is formed into a given shape by performing plastic forming under a condition which prevents the metal structure from being turned into the coarse grain structure. Due to such a constitution, the metal structure is turned into to the finer grain structure and hence, it is possible to provide the metal body which possesses the high strength and the high ductility and also has a desired shape.

According to another aspect of the invention, a first low deformation resistance region and a second low deformation resistance region which traverses the metal body are formed in a spaced-apart manner by a given distance by locally lowering the deformation resistance of the metal body which extends in one direction, a non-low deformation resistance region which increases the deformation resistance larger than the deformation resistance of the first low deformation resistance region and the second low deformation resistance region is formed between the first low deformation resistance region and the second low deformation resistance region using non-low deformation resistance region forming means, and a vibratory motion including vibratory motion components in the direction orthogonal to the extending direction of the metal body is imparted to the non-low deformation resistance region thus deforming the first low deformation resistance region and the second low deformation resistance region by shearing. Due to such a constitution, it is possible to easily impart the vibratory motion to the non-low deformation resistance region and, at the same time, it is possible to easily introduce the method for processing a metal body of the present invention to manufacturing steps of a metal body in general by defining a region to which the vibratory motion is imparted to a local area.

According to another aspect of the invention, in a method for processing a metal body which turns the metal structure of the metal body into the finer grain structure in which a first low deformation resistance region and a second low deformation resistance region which traverse the metal body are formed in a spaced-apart manner by a given distance by locally lowering the deformation resistance of the metal body which extends in one direction, a non-low deformation resistance region which increases the deformation resistance larger than the deformation resistance of the first low deformation resistance region and the second low deformation resistance region is formed between the first low deformation resistance region and the second low deformation resistance region using non-low deformation resistance region forming means, and a one-way rotational motion about a rotary axis substantially parallel to the extending direction of the metal body is imparted to the non-low deformation resistance region thus deforming the first low deformation resistance region and the second low deformation resistance region by shearing whereby the metal structure of the metal body is turned into the finer grain structure. Due to such a constitution, it is possible to easily impart the one-way rotational motion to the non-low deformation resistance region and, at the same time, it is possible to easily introduce the method for processing a metal body of the present invention to manufacturing steps of a metal body in general by defining a region to which the vibratory motion is imparted to a local area.

According to another aspect of the invention, a first low deformation resistance region and a second low deformation resistance region which traverse the metal body are formed in a spaced-apart manner by a given distance by locally lowering the deformation resistance of the metal body which extends in one direction, a non-low deformation resistance region which increases the deformation resistance larger than the deformation resistance of the first low deformation resistance region and the second low deformation resistance region is formed between the first low deformation resistance region and the second low deformation resistance region using non-low deformation resistance region forming means, and a both-way rotational motion about a rotary axis substantially parallel to the extending direction of the metal body is imparted to the non-low deformation resistance region thus deforming the first low deformation resistance region and the second low deformation resistance region by shearing. Due to such a constitution, it is possible to easily impart the both-way rotational motion to the non-low deformation resistance region and, at the same time, it is possible to easily introduce the method for processing a metal body of the present invention to manufacturing steps of a metal body in general by defining a region to which the vibratory motion is imparted to a local area.

According to another aspect of the invention, the metal body is moved along the extending direction. Due to such a constitution, it is possible to increase the productivity of the metal body which possesses the high strength and the high ductility.

According to another aspect of the invention, there is provided an apparatus for processing a metal body which includes low deformation resistance region forming means which forms a low deformation resistance region which traverses the metal body by locally lowering the deformation resistance of the metal body which extends in one direction; non-low deformation resistance region forming means which forms non-low deformation resistance region by increasing the deformation resistance which is lowered in the low deformation resistance region, and displacement applying means which displaces one side of the metal body which sandwiches the low deformation resistance region with another side of the metal body relative to another side of the metal body, wherein the apparatus turns the metal structure of the metal body into the finer grain structure by deforming the low deformation resistance region by shearing along with the displacement applied by the displacement applying means. Due to such a constitution, it is possible to provide a forming apparatus which can easily turn the metal structure into the finer grain structure and can manufacture the metal body which possesses the high strength or the high ductility.

According to another aspect of the invention, the displacement applying means applies a vibratory motion including vibratory motion components in the direction which intersects the extending direction of the metal body to the metal body. Due to such a constitution, it is possible to provide the forming apparatus which can easily turn the metal structure into the finer grain structure and can manufacture the metal body which possesses the high strength or the high ductility.

According to another aspect of the invention, the displacement applying means applies a one-way rotational motion including about a one-way rotational axis substantially parallel to the extending direction of the metal body to the metal body. Due to such a constitution, it is possible to provide the forming apparatus which can easily turn the metal structure into the finer grain structure and can manufacture the metal body which possesses the high strength or the high ductility.

According to another aspect of the invention, the displacement applying means applies a both-way rotational motion including about a both-way rotational axis substantially parallel to the extending direction of the metal body. Due to such a constitution, it is possible to provide the forming apparatus which can easily turn the metal structure into the finer grain structure and can manufacture the metal body which possesses the high strength or the high ductility to the metal body.

According to another aspect of the invention, the low deformation resistance region forming means is heating means which heats the metal body to a given temperature or more. Due to such a constitution, it is possible to provide the forming apparatus which can easily turn the metal structure into the finer grain structure and can manufacture the metal body which possesses the high strength or the high ductility at a low cost.

According to another aspect of the invention, the non-low deformation resistance region forming means is cooling means which cools the metal body. Due to such a constitution, it is possible to provide the forming apparatus which can easily turn the metal structure into the finer grain structure and can manufacture the metal body which possesses the high strength or the high ductility at a low cost.

According to another aspect of the invention, the apparatus includes supply means which supplies the metal body along the extending direction. Due to such a constitution, it is possible to provide the forming apparatus which can easily turn the metal structure into the finer grain structure and can continuously manufacture the metal body which possesses the high strength or the high ductility.

According to another aspect of the invention, the low deformation resistance region forming means includes preheating means which heats the metal body to a second heating temperature after heating the metal body to a first heating temperature and holding the first heating temperature for a given time. Due to such a constitution, it is possible to provide the forming apparatus which can make the heating state of the low deformation resistance region uniform in the formation of the low deformation resistance region by heating and can easily turn the metal structure into finer homogeneous structure.

According to another aspect of the invention, the first heating temperature is a temperature which is necessary for solution heat treatment of the metal body. Due to such a constitution, it is possible to turn the metal structure into the finer grain structure while performing the solution heat treatment and hence, it is possible to provide the forming apparatus which can manufacture the metal body which possesses the high strength and the high ductility and is also subjected to the solution heat treatment.

According to another aspect of the invention, the apparatus includes aging treatment means which performs the aging treatment of the metal body whose metal structure is turned into the finer grain structure by holding the metal body at a temperature which prevents the metal structure from becoming coarser. Due to such a constitution, it is possible to provide the forming apparatus which can manufacture the metal body which can further enhance the strength of the metal body which possesses the high strength and the high ductility.

According to another aspect of the invention, a forming guide body which forms the metal body in a given shape is brought into contact with the low deformation resistance region. Due to such a constitution, it is possible to form the metal body into a desired shape using the forming guide body and hence, it is possible to provide the forming apparatus which can manufacture the metal body which possesses the high strength and the high ductility and has the desired shape.

According to another aspect of the invention, the forming guide body is heating means which heats the metal body. Due to such a constitution, it is possible to provide the forming apparatus which can locally heat a contact portion of the metal body which is brought into contact with the forming guide body and can easily form the low deformation resistance region.

According to another aspect of the invention, the forming guide body is cooling means which cools the metal body. Due to such a constitution, it is possible to provide the forming apparatus which can locally cool a contact portion of the metal body which is brought into contact with the forming guide body and can efficiently cool the low deformation resistance region after the deformation by shearing thus enhancing the manufacturing efficiency.

According to another aspect of the invention, the metal body is a cylindrical body having a hollow portion, and the apparatus includes flattening means which cuts the metal body whose metal structure is turned into the finer grain structure along the extending direction of the metal body so as to form the planar metal body. Due to such a constitution, it is possible to provide the forming apparatus which can manufacture a planar metal body which can turn the metal structure into the finer grain structure.

According to another aspect of the invention, the low deformation resistance region forming means forms the low deformation resistance region in a vacuum. Due to such a constitution, it is possible to provide the forming apparatus which can prevent the formation of a reaction film with a gaseous component on a surface of the low deformation resistance region which is deformed by shearing.

According to another aspect of the invention, the low deformation resistance region forming means forms the low deformation resistance region in a high pressure atmosphere. Due to such a constitution, it is possible to provide the forming apparatus which can enhance the efficiency to turn the metal structure into the finer grain structure due to an action to the low deformation resistance region attributed to the high pressure.

According to another aspect of the invention, the low deformation resistance region forming means forms the low deformation resistance region in an active gas atmosphere. Due to such a constitution, the metal structure of the metal body can be turned into the finer grain structure and, at the same time, a reaction region with the active gas can be formed on a surface of the low deformation resistance region and hence, it is possible to provide the forming apparatus which can form the highly functionalized metal body.

According to another aspect of the invention, the active gas is nitrogen gas. Due to such a constitution, the metal structure of the metal body can be turned into the finer grain structure and, at the same time, the low deformation resistance region can be nitrided and hence, it is possible to provide the forming apparatus which can form the highly functionalized metal body.

According to another aspect of the invention, the active gas is methane gas and/or carbon monoxide. Due to such a constitution, the metal structure of the metal body can be turned into the finer grain structure and, at the same time, the low deformation resistance region can be carburized and hence, it is possible to provide the forming apparatus which can form the highly functionalized metal body.

According to another aspect of the invention, low deformation resistance region forming means includes powdery material spraying means which sprays a powdery material to the low deformation resistance region. Due to such a constitution, the metal structure of the metal body can be turned into the finer grain structure and, at the same time, the powdery material can be mechanically mixed into the low deformation resistance region and hence, it is possible to provide the forming apparatus which can form the highly functionalized metal body.

According to another aspect of the invention, low deformation resistance region forming means includes ion doping means which dopes ions to the low deformation resistance region. Due to such a constitution, the metal structure of the metal body can be turned into the finer grain structure and, at the same time, the ionized particles can be mixed into the low deformation resistance region and hence, it is possible to provide the forming apparatus which can form the highly functionalized metal body.

According to another aspect of the invention, the low deformation resistance region forming means forms the low deformation resistance region by heating the metal body which is immersed in the liquid at a given temperature or more. Due to such a constitution, the irregularities of conditions for forming the low deformation resistance region can be suppressed and hence, it is possible to provide the forming apparatus which can turn the metal structure into finer homogeneous structure.

According to another aspect of the invention, in forming the low deformation resistance region, the heat conductivity of a periphery of the low deformation resistance region is lowered. Due to such a constitution, it is possible to provide the forming apparatus which can efficiently heat the metal body in the liquid.

According to another aspect of the invention, in forming the low deformation resistance region, bubbles are formed in a periphery of the low deformation resistance region. Due to such a constitution, it is possible to provide the forming apparatus which can efficiently heat the metal body in the liquid.

According to another aspect of the invention, there is provided an apparatus for processing a metal body which includes moving means which moves a metal body which extends in one direction along the extending direction; heating means which heats the metal body to a temperature for performing the solution heat treatment; cooling means which quenches the metal body heated by the heating means; and shearing deformation means which deforms a portion of the metal body which is cooled by the cooling means by shearing. Due to such a constitution, it is possible to turn the metal structure into the finer grain structure while performing the solution heat treatment and hence, it is possible to provide the forming apparatus which can manufacture the metal body which possesses the high strength and the high ductility and, at the same time, is subjected to the solution heat treatment.

According to another aspect of the invention, the shearing deformation means applies a vibratory motion which includes vibratory motion components which perform the vibratory motion in the direction substantially orthogonal to the extending direction of the metal body to the metal body. Due to such a constitution, it is possible to turn the metal structure into the finer grain structure while performing the solution heat treatment of the metal body and hence, it is possible to provide the forming apparatus which can manufacture the metal body which possesses the high strength and the high ductility and, at the same time, is subjected to the solution heat treatment.

According to another aspect of the invention, the shearing deformation means applies a one-way rotational motion which rotates the metal body about a one-way rotating axis substantially parallel to the extending direction of the metal body to the metal body. Due to such a constitution, it is possible to turn the metal structure into the finer grain structure while performing the solution heat treatment and hence, it is possible to provide the forming apparatus which can manufacture the metal body which possesses the high strength and the high ductility and, at the same time, is subjected to the solution heat treatment.

According to another aspect of the invention, the shearing deformation means applies a both-way rotational motion which rotates the metal body about a both-way rotating axis substantially parallel to the extending direction of the metal body to the metal body. Due to such a constitution, it is possible to turn the metal structure into the finer grain structure while performing the solution heat treatment and hence, it is possible to provide the forming apparatus which can manufacture the metal body which possesses the high strength and the high ductility and, at the same time, is subjected to the solution heat treatment.

According to another aspect of the invention, there is provided an apparatus for processing a metal body which includes moving means which moves the metal body in a heated state extending in one direction along the extending direction; cooling means which forms a non-low deformation resistance region by increasing the deformation resistance by cooling the metal body; and vibratory motion applying means which applies a vibratory motion to the non-low deformation resistance region, wherein the metal structure in the metal body before being supplied to the cooling means is turned into the finer grain structure by the deformation by shearing due to the vibratory motion applied by the vibratory motion applying means. Due to such a constitution, it is possible to easily turn the metal structure into the finer grain structure and hence, it is possible to provide the forming apparatus which can manufacture the metal body which possesses the high strength and the high ductility.

According to another aspect of the invention, there is provided an apparatus for processing a metal body which includes first low deformation resistance region forming means which forms a first low deformation resistance region which traverses the metal body by locally lowering the deformation resistance of the metal body which extends in one direction; second low deformation resistance region forming means which forms a second low deformation resistance region which traverses the metal body by locally lowering the deformation resistance of the metal body at a position spaced apart from the first low deformation resistance region by a given distance; non-low deformation resistance region forming means which forms non-low deformation resistance region by increasing the deformation resistance which is lowered in the first low deformation resistance region and the second low deformation resistance region between the first low deformation resistance region and the second low deformation resistance region, and displacement applying means which applies the displacement for deforming the first low deformation resistance region and the second low deformation resistance region by shearing to the non-low deformation resistance region, wherein the apparatus turns the metal structure of the first low deformation resistance region and the second low deformation resistance region into the finer grain structure. Due to such a constitution, it is possible to easily turn the metal structure into the finer grain structure and hence, it is possible to provide the forming apparatus which can manufacture the metal body which possesses the high strength and the high ductility.

According to another aspect of the invention, the displacement applying means applies a vibratory motion including vibratory motion components in the direction which intersects the extending direction of the metal body to the non-low deformation resistance region. Due to such a constitution, it is possible to easily turn the metal structure into the finer grain structure and hence, it is possible to provide the forming apparatus which can manufacture the metal body which possesses the high strength and the high ductility.

According to another aspect of the invention, the displacement applying means applies a one-way rotational motion including about a one-way rotational axis substantially parallel to the extending direction of the metal body to the non-low deformation resistance region. Due to such a constitution, it is possible to easily turn the metal structure into the finer grain structure and hence, it is possible to provide the forming apparatus which can manufacture the metal body which possesses the high strength and the high ductility.

According to another aspect of the invention, the displacement applying means applies a both-way rotational motion including about a both-way rotational axis substantially parallel to the extending direction of the metal body to the non-low deformation resistance region. Due to such a constitution, it is possible to easily turn the metal structure into the finer grain structure and hence, it is possible to provide the forming apparatus which can manufacture the metal body which possesses the high strength and the high ductility.

According to another aspect of the invention, the first low deformation resistance region forming means and the second low deformation resistance region forming means are heating means which heats the metal body to a given temperature or more. Due to such a constitution, it is possible to easily turn the metal structure into the finer grain structure and hence, it is possible to provide the forming apparatus which can manufacture the metal body which possesses the high strength and the high ductility at a low cost.

According to another aspect of the invention, the non-low deformation resistance region forming means is cooling means which cools the metal body. Due to such a constitution, it is possible to easily turn the metal structure into the finer grain structure and hence, it is possible to provide the forming apparatus which can manufacture the metal body which possesses the high strength and the high ductility at a low cost.

According to another aspect of the invention, the apparatus includes supply means which supplies the metal body along the extending direction. Due to such a constitution, it is possible to easily and continuously turn the metal structure into the finer grain structure and hence, it is possible to provide the forming apparatus which exhibits high productivity of the metal body which possesses the high strength and the high ductility.

BEST MODE FOR CARRYING OUT THE INVENTION

Figure 1:
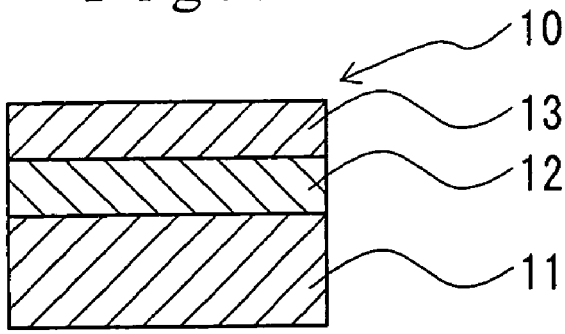
FIG. 1 is a cross-sectional schematic view of a metal body.

A method for processing a metal body and an apparatus for processing a metal body of the present invention can produce a metal body which acquires the high strength or the high ductility and, particularly, the method and the apparatus can allow the metal body to obtain the high strength or the high ductility by turning the metal structure contained in the metal body into the finer grain structure.

Particularly, to turn the metal structure into the finer grain structure, according to the present invention, a low deformation resistance region where the deformation resistance is locally lowered is formed in the metal body and a strong strain is applied to the low deformation resistance region by deforming the low deformation resistance region by sharing thus turning the metal structure into the finer grain structure.

Further, by locally forming the low deformation resistance region, a sharing stress generated by the sharing deformation applied for turning the metal structure into the finer grain structure concentrically acts on the low deformation resistance region and hence, the strong strain is efficiently generated thus turning the metal structure into the finer grain structure.

Further, with respect to the metal body such as a magnesium alloy or the like, it is expected that the crystal orientation can be adjusted.

Particularly, for locally forming the low deformation resistance region, a non-low deformation resistance region which increases the deformation resistance is formed along the low deformation resistance region. By providing non-low deformation resistance region generating means which generates the non-low deformation resistance region along the low deformation resistance region, it is possible to suppress the diffusion of the sharing deformation applied to the low deformation resistance region to the outside of the low deformation resistance region and hence, it is possible to efficiently generate the sharing stress in the low deformation resistance region.

To be more specific, it is sufficient that the non-low deformation resistance region generating means is cooling means which cools the metal body and such cooling means can easily adjust the deformation resistance of the metal body.

For example, in hot rolling steps of the metal body, it is possible to cool the metal body in a heated state by allowing the metal body to pass through a cooling device, the non-low deformation resistance region where the deformation resistance is increased due to such cooling is formed, and the non-low deformation resistance region which constitutes a region after the metal body passes through the cooling device is subjected to a vibratory motion and hence, the region which has not yet passed through the cooling device is deformed by sharing thus easily turning the metal structure into the finer grain structure whereby it is possible to produce the metal body which obtains the high strength or the high ductility.

Here, the above-mentioned low deformation resistance region is a region where the deformation resistance is lowered by heating the metal body and is a region where the deformation is liable to be easily generated along with the application of an external force compared to regions other than the low deformation resistance region.

On the other hand, the non-low deformation resistance region is a region where the deformation resistance is larger than the deformation resistance in the low deformation resistance region, and regions other than the low deformation resistance region are basically non-low deformation resistance region.

The low deformation resistance region is formed by other methods besides heating. For example, the non-low deformation resistance region is formed by mounting a constraining body which constrains the metal body on a periphery of the metal body heated at a desired temperature, and the non-constraining regions on which the constraining body is not mounted may constitutes the low deformation resistance region.

To be more specific, there may be a case in which the constraining body is brought into contact with the periphery of the metal body in a high temperature state in hot rolling steps of a cast metal body or the like.

Alternatively, in coagulating the metal body in a liquid state and forming the metal body in a desired shape using the constraining body, non-constraining regions are partially formed and the sharing deformation is applied to the non-constraining region as a low deformation resistance region.

In this manner, by bringing the constraining body into contact with the metal body which is wholly held in the low deformation resistance state by being heated to a given temperature or more thus constraining the metal body, the non-low deformation resistance region is formed and, at the same time, by adopting the non-constraining region which is not brought into contact with a constraining body as the low deformation resistance region, it is possible to turn the metal structure of the metal body which is in a heated state during the manufacturing steps of the metal body in casting or the like into the finer grain structure and hence, it is possible to manufacture the metal body which obtains the finer metal structure without increasing the manufacturing steps.

The term "metal body" in the present invention is not limited to a single metal which is formed of one kind of metal element or an alloy which is formed of two or more kinds of metal elements and may be constituted of an intermetallic compound which is formed of one kind or a plural kinds of metal elements and one or a plural kinds of non-metal elements. Further, unless otherwise specified, the metal body also includes an intermetallic compound such as a ceramic body which contains metal.

Here, the metal body is not always required to have the uniform composition. As shown in FIG. 1 which is a cross-sectional schematic view of the metal body, the metal body may be formed of a stacked body 10 which is constituted by stacking a second metal layer 12 on a first metal layer 11 and, further, a third metal layer 13 on the second metal layer 12. Here, the first metal layer 11, the second metal layer 12 and the third metal layer 13 are respectively formed of a desired metal, an alloy or an intermetallic compound. The first metal layer 11, the second metal layer 12 and the third metal layer 13 may be simply overlapped to each other to form the stacked body 10 or may be stacked using plating, vapor deposition treatment or compression bonding treatment or the like. Here, the stacked body 10 is not limited to three layers and the stacked body 10 may be constituted by overlapping a suitable number of metal layers.

Figure 2:
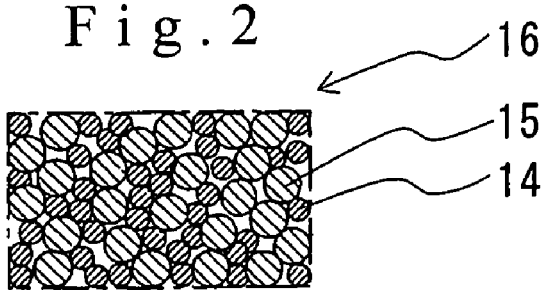
FIG. 2 is a cross-sectional schematic view of a metal body.

Further, the metal body may be, as shown in FIG. 2 which is a cross-sectional schematic view of the metal body, a pre-baked (calcinated) body 16 which is formed by pre-baking a mixed body in which a first metal powdery material 14 and a second metal powdery material 15 are mixed in a given shape. Here, besides the pre-baked body 16 which is formed of two kinds of powdery materials constituted of the first metal powdery material 14 and the second metal powdery material 15, the pre-baked body 16 may be formed by mixing a further larger number of powdery materials. Further, the pre-baked material 16 may be formed by mixing non-metal powdery materials besides metal powdery materials.

Figure 3:
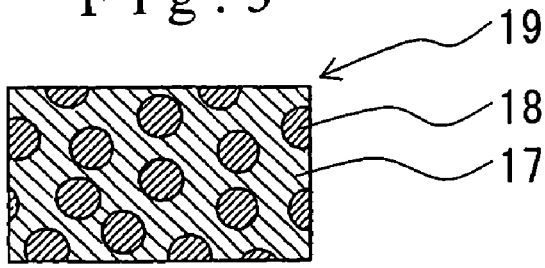
FIG. 3 is a cross-sectional schematic view of a metal body.

Further, as shown in FIG. 3 which is a cross-sectional schematic view of the metal body, the metal body may be a filled body 19 which is formed by filling a metal powdery material 18 into hole portions of a porous body 17 formed in a given shape. Here, in the porous body 17, not only the metal powdery material 18, a non-metal powdery material may be filled.

Figure 4:
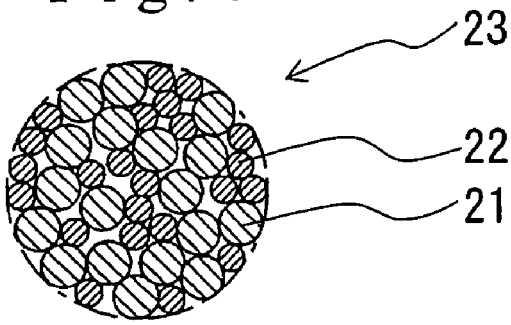
FIG. 4 is a cross-sectional schematic view of a metal body.

Further, the metal body may be, as shown in FIG. 4 which is a cross-sectional schematic view of the metal body, formed of a metal wire bundle 23 which is formed by bundling a plurality of first metal wires 21 and a plurality of second metal wires 22. Here, besides the constitution of the metal wire bundle 23 which is formed by bundling two kinds of metal wires constituting of the first metal wires 21 and the second metal wires 22, the metal wire bundle 23 may be formed by bundling a multiple kinds of metal wires.

In this manner, the metal body can adopt various modes and so long as the metal structure can obtain the finer grain structure by shearing deformation as described later, the metal body can adopt any mode.

In FIG. 1 to FIG. 3, the metal body has a rectangular cross section, while in FIG. 4, the metal body has a circular cross section. However, the metal body is not limited to a rectangular shape which has the rectangular cross section or a rod body having a circular cross section and may be formed in a planner body or a cylindrical body having a hollow portion besides these shapes. The metal body may be, for example, an H-steel body, an angle steel body, a channel steel body, a T-steel body, a lip channel steel body or the like.

Further, the desired treatment such as carburizing treatment, nitriding treatment or the like may be applied to the metal body preliminarily. Particularly, when the carburizing treatment is applied to the metal body, as described later, the decarburizing treatment can be performed along with the shearing deformation of the low deformation resistance region formed in the metal body and hence, it is possible to turn the metal structure into the finer grain structure while performing the decarburizing treatment whereby the more highly functionalized metal body can be formed.

Here, also with respect to the usual carbon steel or the high carbon steel, besides the metal body to which the carburizing processing is applied, the decarburizing treatment can be performed along with the shearing deformation of the low deformation resistance region formed in the metal body and hence, the more highly functionalized metal body can be formed.

Figure 5:
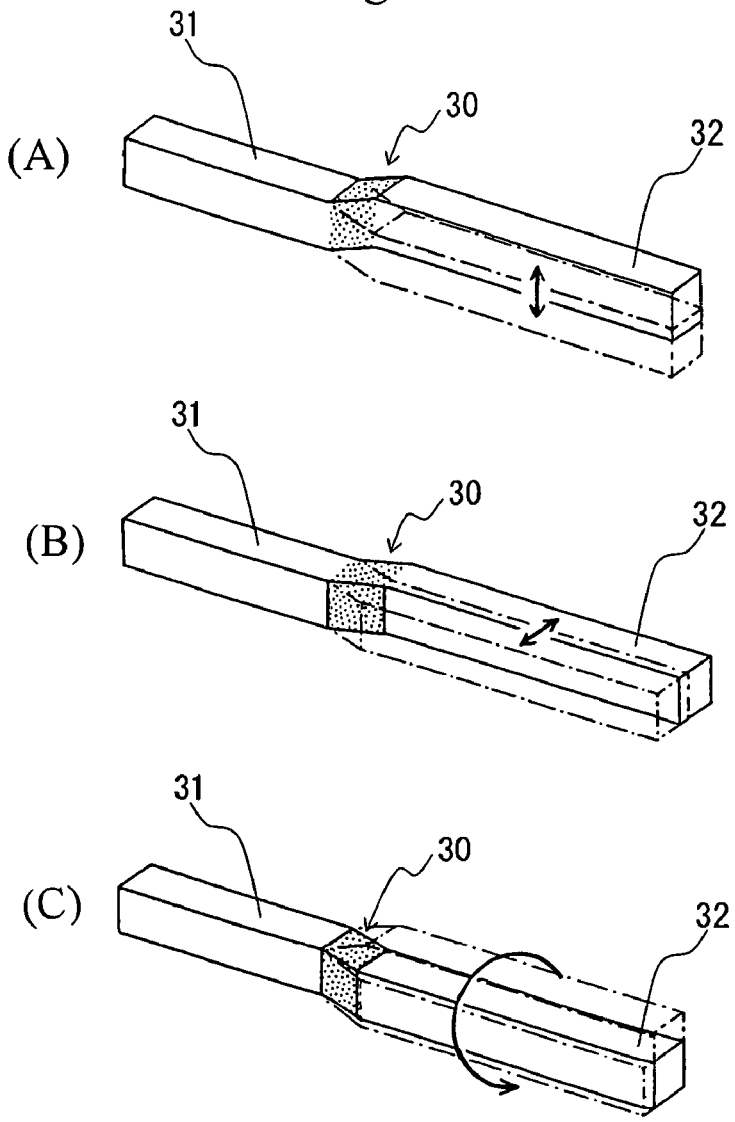
FIG. 5 is an explanatory view of sharing deformation applied to a low deformation resistance region.

The metal body has a mode which extends in one direction and, as shown in FIG. 5, by forming the low deformation resistance region 30 in a state that the low deformation resistance region 30 traverses the metal body, a first non-low deformation resistance region 31 and a second non-low deformation resistance region 32 which are partitioned by the low deformation resistance region 30 are formed in the metal body.

By forming the low deformation resistance region 30 in a state that the low deformation resistance region 30 traverses the metal body which extends in one direction, by deforming the low deformation resistance region 30 by shearing while moving the low deformation resistance region 30 along the extending direction of the metal body, it is possible to continuously perform the processing to turn the metal structure into the finer grain structure.

Further more, by adjusting the deformation mode of the shearing deformation generated in the low deformation resistance region 30 when necessary, it is possible to make modes of a strong strain applied to the portion of the low deformation resistance region 30 different from each other and hence, it is possible to form regions which differ in the degree of fines of the metal structure whereby the metal body can obtain multiple functions.

The shearing deformation of the low deformation resistance region 30 is, as shown in FIG. 5(*a*), performed by fluctuating the position of the second non-low deformation resistance region 32 relative to the first non-low deformation resistance region 31 by imparting a vibratory motion which vibrates the second non-low deformation resistance region 32 with respect to the first non-low deformation resistance region 31 in the thickness direction of the metal body.

Alternatively, the vibration direction of the vibratory motion may be, instead of the thickness direction of the metal body, as shown in FIG. 5(*b*), arranged in the widthwise direction of the metal body which is orthogonal to the thickness direction of the metal body. Further, as shown in FIG. 5(*c*), the vibratory motion may adopt the composite vibration which combines both of the vibration in the thickness direction of the metal body and the vibration in the widthwise direction. When such composite vibration is adopted, it is possible to apply a large shearing stress to the low deformation resistance region.

Here, the vibratory motion is not always a vibratory motion which generates a macroscopic displacement and may be a vibratory motion such as resonance which generates strain in the metal body.

Figure 6:
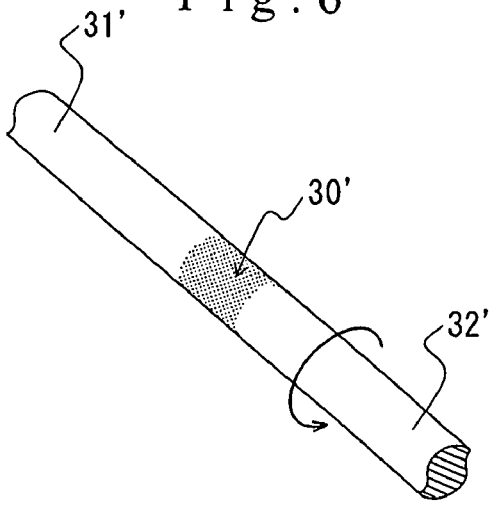
FIG. 6 is an explanatory view of sharing deformation applied to the low deformation resistance region.

Further, when the metal body is a round rod body or a cylindrical body having a hollow portion, as shown in FIG. 6, by rotating a second non-low deformation resistance region 32' with respect to a first non-low deformation resistance region 31' about a rotary axis which is arranged substantially parallel to the extending direction of the metal body, the position of the second non-low deformation resistance region 32' is fluctuated relative to the first non-low deformation resistance region 31' thus generating the shearing deformation in the low deformation resistance region 30'.

Here, the second non-low deformation resistance region 32' may be always rotated at a fixed angular velocity relative to the first non-low deformation resistance region 31' or the second non-low deformation resistance region 32' may be rotated in a state that the normal rotation and the reverse rotation thereof are repeated alternately.

Figure 7:
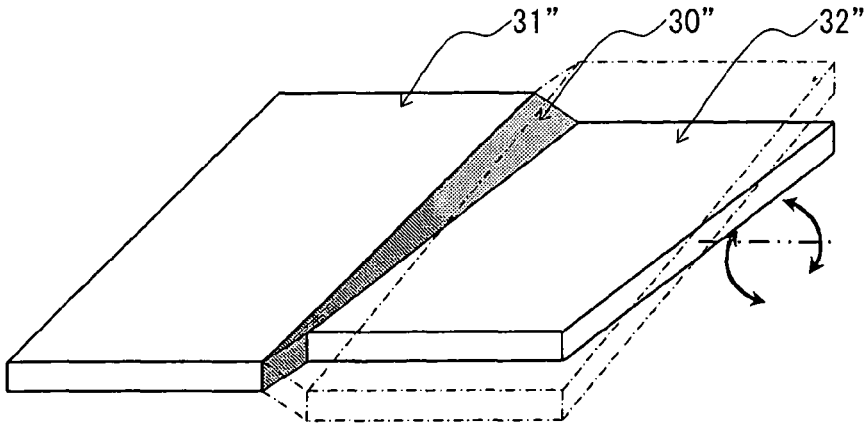
FIG. 7 is an explanatory view of sharing deformation applied to the low deformation resistance region.

Further, the shearing deformation of the low deformation resistance region obtained by the rotation about the rotational axis is not limited to the case in which the metal body is formed of the round rod body or the cylindrical body having the hollow portion. That is, as shown in FIG. 7, a low deformation resistance region 30" may be formed in a transverse state on the metal body made of a planner body, and the metal body may be rotated such that the normal rotation and the reverse rotation about a rotational axis which passes through an approximately center of the metal body and extends substantially parallel to the are repeatedly applied to the second non-low deformation resistance region 32' with respect to the first non-low deformation resistance region 31' in the first non-low deformation resistance region 31" and the second non-low deformation resistance region 32" which sandwich the low deformation resistance region 30".

A momentum of the relative vibratory motion, the one-way rotational motion or the both-way rotational motion of the second non-low deformation resistance region 32, 32', 32" with respect to the first non-low deformation resistance region 31, 31', 31" may be a momentum of a level which can generate the shearing deformation in the low deformation resistance region 30, 31', 32" so as to turn the metal structure into the finer grain structure.

In deforming the low deformation resistance region 30, 30', 30" by shearing, by performing the compression such that a compression stress is applied to the low deformation resistance region 30, 30', 30" in the extending direction of the metal body, it is possible to suppress the generation of a large deformation of shape in the low deformation resistance region 30, 30', 30" or generation of rupture in the low deformation resistance region 30, 30', 30" portion.

Particularly, by applying the compression stress to the low deformation resistance region 30, 30', 30" in the extending direction of the metal body, it is possible to apply not only the strain generated by shearing but also the strain generated by compression to the low deformation resistance region 30, 30', 30" and hence, the metal structure can obtain more finer grain structure.

To the contrary, in deforming the low deformation resistance region 30, 30', 30" by shearing, by stretching (drawing) the metal body such that a tensile stress is applied to the low deformation resistance region 30, 30', 30" along the extending direction of the metal body, it is possible to apply not only the strain generated by shearing but also the strain generated by stretching to the low deformation resistance region 30, 30', 30" and hence, the metal structure can obtain more finer grain structure.

By deforming the low deformation resistance region by shearing in this manner, it is possible not only to turn the metal structure in the low deformation resistance region into the finer grain structure but also to bond the mutual metal structure in the metal bodies shown in FIG. 1 to FIG. 4 and hence, it is possible to produce a new alloy or ceramics. Particularly, it is possible to mechanically produce an alloy having the composition which cannot be produced by a conventional melting method.

Figure 8:
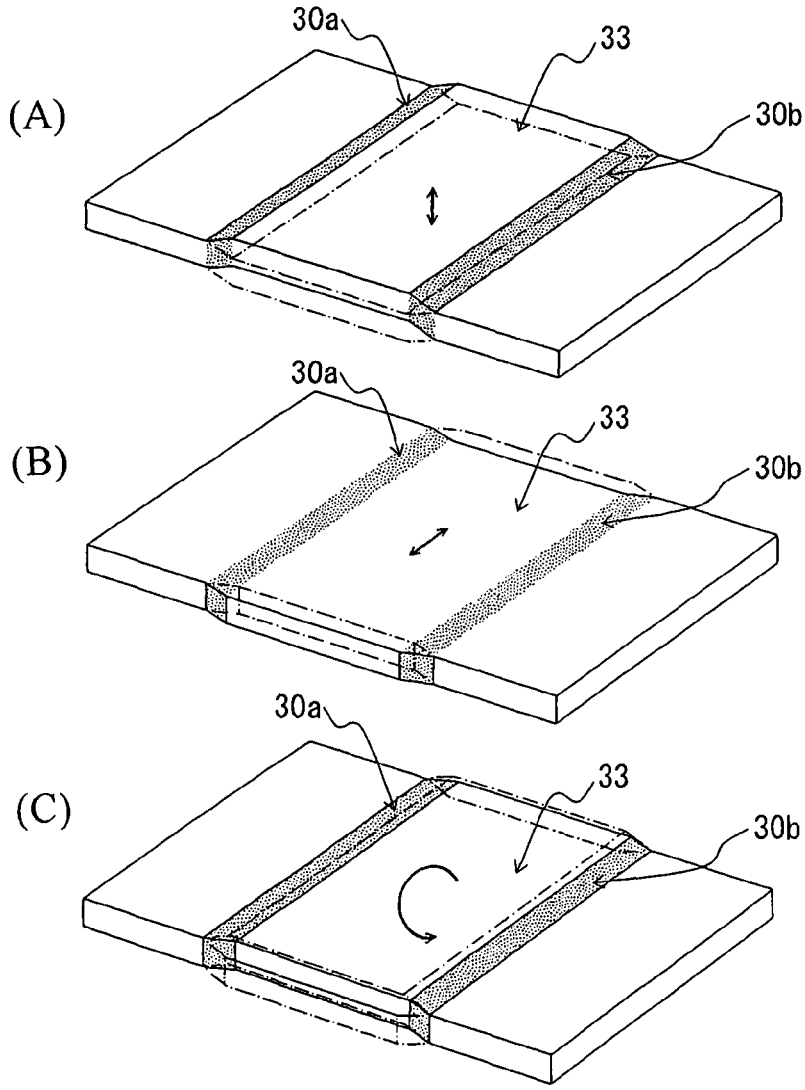
FIG. 8 is an explanatory view of sharing deformation applied to the low deformation resistance region.

As described above, in deforming the low deformation resistance region by shearing, as shown in FIG. 8, in the metal body which extends in one direction, a first low deformation resistance region 30*a* and a second low deformation resistance region 30*b* which traverse the metal body are formed in a spaced-apart manner with a given distance therebetween and, a region sandwiched by the first low deformation resistance region 30*a* and the second low deformation resistance region 30*b* is subjected to the vibratory motion as an intermediate non-low deformation resistance region 33 whereby the first low deformation resistance region 30*a* and the second low deformation resistance region 30*b* can be easily deformed by shearing.

Here, in FIG. 8, the metal body has a planar body, wherein the intermediate non-low deformation resistance region 33 is vibrated in the thickness direction of the metal body in FIG. 8(*a*), while the intermediate non-low deformation resistance region 33 is vibrated in the widthwise direction of the metal body orthogonal to the thickness direction of the metal body in FIG. 8(*b*). In FIG. 8(*c*), the intermediate non-low deformation resistance region 33 is vibrated by the composite vibration which combines both of the vibration in the thickness direction of the metal body and the vibration in the widthwise direction of the metal body.

Figure 9:
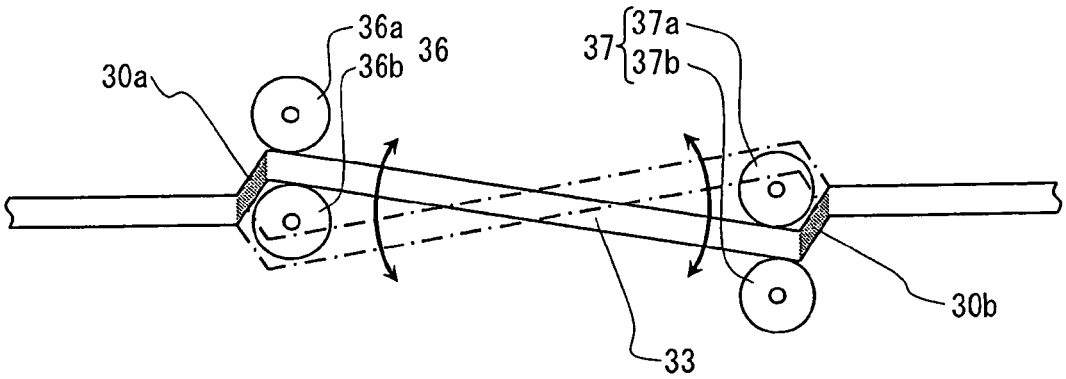
FIG. 9 is an explanatory view of sharing deformation applied to the low deformation resistance region.

Further, as shown in FIG. 9, with respect to the intermediate non-low deformation resistance region 33 which constitutes a region sandwiched by the first low deformation resistance region 30*a* and the second low deformation resistance region 30*b*, at a portion of the intermediate non-low deformation resistance region 33 in the vicinity of the first low deformation resistance region 30*a*, a first feeding device 36 which is constituted of a first upper feeding roller 36*a* and a second lower feeding roller 36*b* which clamp the metal body and feed the metal body in the extending direction of the metal body is provided, while at a portion of the intermediate non-low deformation resistance region 33 in the vicinity of the second low deformation resistance region 30*b*, a second feeding device 37 which is constituted of a second upper feeding roller 37*a* and a second lower feeding roller 37*b* which clamp the metal body and feed the metal body in the extending direction of the metal body is provided. By vertically moving the first feeding device 36 and the second feeding device 37 with phases opposite to each other, the first low deformation resistance region 30*a* and the second low deformation resistance region 30*b* may be deformed by shearing.

In this case, the shearing deformation which is expected to be generated in the first low deformation resistance region 30*a* and the second low deformation resistance region 30*b* is microscopically equal to the shearing deformation generated in the above-mentioned vibration mode shown in FIG. 8(*a*).

Figure 10:
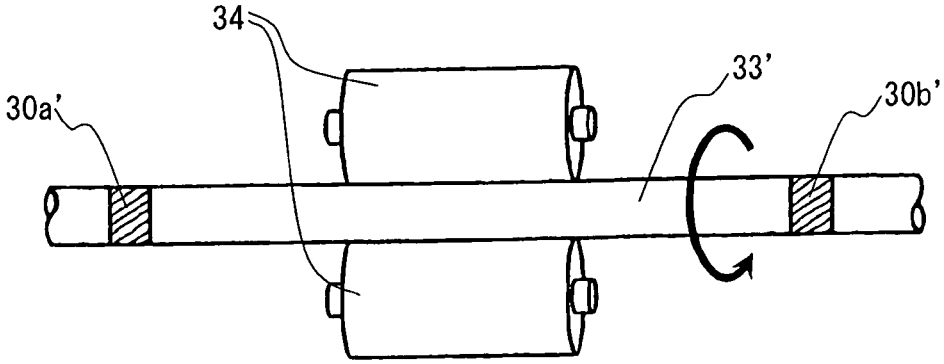
FIG. 10 is an explanatory view of sharing deformation applied to the low deformation resistance region.

When the metal body is a round rod body or a cylindrical body having a hollow portion, as shown in FIG. 10, an intermediate non-low deformation resistance region 33' which is defined between a first low deformation resistance region 30*a*' and a second low deformation resistance region 30*b*' provided in a spaced-apart manner with a given distance therebetween is rotated about a rotational axis arranged substantially parallel to the extending direction of the metal body so as to easily deform the first low deformation resistance region 30*a*' and the second low deformation resistance region 30*b*' by shearing. In FIG. 10, numeral 34 indicates rotary rollers which rotates the intermediate non-low deformation resistance region 33'.

Further, in FIG. 8 to FIG. 10, by allowing the metal body to move along the extending direction thereof, it is possible to move the positions of the first low deformation resistance region 30*a*' and the second low deformation resistance region 30*b*' in the metal body.

Accordingly, usually, during the manufacturing steps of the metal body which is continuously formed, by forming the first low deformation resistance region 30*a*, 30*a*' and the second low deformation resistance region 30*b*, 30*b*' in the metal body and by imparting the vibration, the one-way rotation or the both-way rotation to the intermediate non-low deformation resistance region 33, 33', it is possible to easily deform the metal body by shearing and hence, the metal structure is turned into the finer grain structure whereby the metal body which obtains the high strength or the high ductility can be manufactured at a low cost.

Here, with respect to the above-mentioned vibration, the one-way rotation and the both-way rotation of the intermediate non-low deformation resistance region 33, 33', as other modes of motion, an extension-contraction motion mode which allows the metal body to extend and contract in the extending direction of the metal body and, a both-way rotation motion mode about a rotational axis in the normal direction on a plane of the planar metal body in the intermediate non-low deformation resistance region 33 shown in FIG. 8, for example, are considered. Accordingly, the motions having 6 degrees of freedom in total can be considered.

However, as shown in FIG. 8 to FIG. 10, when the metal body includes the first low deformation resistance region 30*a*, 30*a*' and the second low deformation resistance region 30*b*, 30*b*', in the extension-contraction motion mode, it is difficult to apply the sufficient shearing stress to the first low deformation resistance region 30*a*, 30*a*' and the second low deformation resistance region 30*b*, 30*b*' and, in the same manner, also in the both-way rotation motion mode, it is difficult to apply the sufficient shearing stress to the first low deformation resistance region 30*a*, 30*a*' and the second low deformation resistance region 30*b*, 30*b*'. Accordingly, it is substantially desirable to generate the shearing deformation by making use of the motions of 4 degree of freedom.

However, as shown in FIG. 5 to FIG. 7, when the low deformation resistance region 30, 30' is formed only one portion in the metal body, it is possible to apply the compression stress and the tensile stress in the extending direction of the metal body as described above using the extension-contraction motion mode and the both-way rotation motion mode.

The first low deformation resistance region 30*a*, 30*a*' and the second low deformation resistance region 30*b*, 30*b*' are usually respectively formed by heating the metal body. However, by setting the heating temperatures of the first low deformation resistance region 30*a*, 30*a*' and the second low deformation resistance region 30*b*, 30*b*' different from each other, it is possible to make the shearing stresses respectively applied to the first low deformation resistance region 30*a*, 30' and the second low deformation resistance region 30*b*, 30' different from each other and hence, the shearing stresses which differ from each other can be applied to the metal structure in two stages whereby the metal structure can obtain the further finer grain structure.

Further, when the portion of the metal body which is once turned into the finer grain structure by shearing deformation is further deformed by shearing, since the ductility of the metal body is enhanced, it is possible to lower the heating temperature of the metal body whereby the metal structure can be turned into the further finer grain structure.

Figure 11:
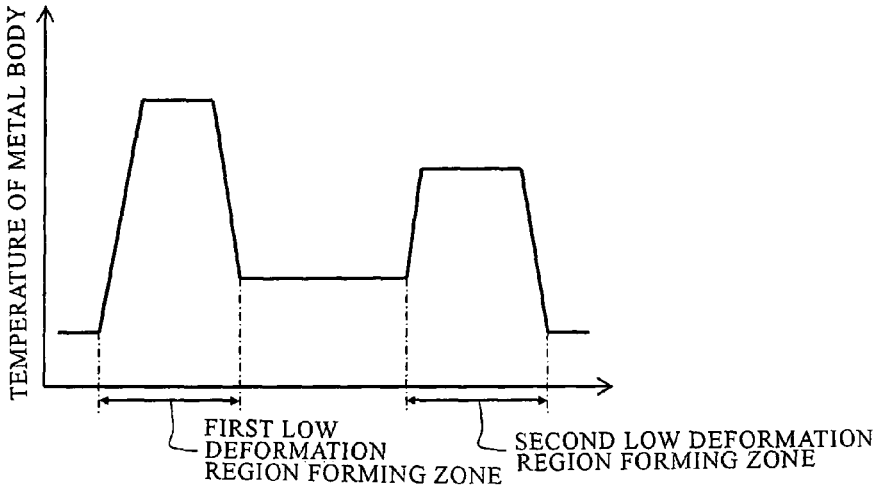
FIG. 11 is an explanatory view of a heating profile for the low deformation resistance region.

To be more specific, by moving the metal body along the extending direction to allow the moving body to pass through a first low deformation resistance region forming zone for forming the first low deformation resistance region 30*a*, 30*a*' and a second low deformation resistance region forming zone for forming the second low deformation resistance region 30*b*, 30*b*', when the metal body is a hardly deformable alloy such as a magnesium alloy or a hardly deformable intermetallic compound, as shown in FIG. 11, the first low deformation resistance region forming zone is set at a high temperature and the second low deformation resistance region forming zone is set at a low temperature compared with the first low deformation resistance region forming zone.

Here, the heating temperature of the first low deformation resistance region forming zone is a temperature at which the metal body in the first low deformation resistance region 30*a*, 30*a*' is sufficiently softened and it is sufficient that the temperature allows the shearing deformation of the first low deformation resistance region 30*a*. By applying the shearing stress to the first low deformation resistance region 30*a*, 30' at such a temperature, the first low deformation resistance region 30*a*, 30*a*' is easily deformed by shearing thus turning the metal structure into uniform structure and, at the same time, allowing the metal body to have the intermediate fine particles having a particle size of 10 to 50 mm, for example whereby the deformation resistance of the metal body can be reduced.

Further, the heating temperature of the second low deformation resistance region forming zone is set to a temperature at which the recrystallization of the metal structure is generated and allows the deformation by shearing of the second low deformation resistance region 30*b*, 30*b*' portion while suppressing the growth of the metal structure of the second low deformation resistance region 30*b*, 30*b*' portion whereby the metal structure can obtain the further finer grain structure.

In this manner, in the first low deformation resistance region forming zone, to realize the shearing deformation of the metal body before the low temperature zone where the recrystallization is generated in the second low deformation resistance region forming zone, the metal body is heated to a level that the adjustment of the particle size can be performed whereby it is possible to easily turn the metal structure into the finer grain structure even when the metal body is a hardly deformable alloy or a hardly deformable metallic compound or the like thus allowing the metal body to achieve the high ductility.

Further, when the metal body is a heat treatment type alloy, by making use of a phenomenon that the metal body is quenched after heating in the first low deformation resistance region forming zone, the heating temperature of the metal body in the first low deformation resistance region forming zone is set as a temperature which becomes a solution processing condition of the metal body, and by applying a shearing stress to the first low deformation resistance region 30*a*, 30*a*' in such a state, it is possible to place a larger amount of addition elements in solid solution than the composition in a constitutional diagram in the first low deformation resistance region 30*a*, 30*a*'.

Further, the metal body has the metal structure thereof turned into the finer grain structure while being subjected to the solution heat treatment and hence, it is possible to form the metal body with micro metal structure while being subjected to the solution heat treatment. The metal body with micro metal structure while being subjected to the solution heat treatment cannot be manufactured due to the growth of the metal structure attributed to the heating during the solution heat treatment in the conventional manufacturing method, such metal body can be manufactured using the processing method and the processing apparatus of the present invention.

The heating temperature of the second low deformation resistance region forming zone is set as the temperature at which the recrystallization of the metal structure is generated and is used for deforming the second low deformation resistance region 30*b*, 30*b*' by shearing while suppressing the growth of the metal structure of the second low deformation resistance region 30*b*, 30*b*' portion thus turning the metal structure into the finer grain structure.

In this manner, by performing the solution heat treatment of the metal body in the first low deformation resistance region forming zone, it is possible to form the metal body whose metal structure is turned into finer homogeneous structure.

As described above, according to the present invention, by deforming the low deformation resistance regions such as the first low deformation resistance region 30*a*, 30*a*' and the second low deformation resistance region 30*b*, 30*b*' by shearing, the metal structure of the metal body is turned into the finer grain structure. With respect to an action which turns the metal structure into the finer grain structure, it is considered that the crystal grains in the metal body which is made easily deformable by heating or the like receive shearing by shearing deformation and are turned into finer crystal grains.

Particularly, at both end portions of the low deformation resistance region, it is difficult to deform the crystal grains of the metal body due to cooling or the like described later and hence, the deformation resistance is increased. Accordingly, it is considered that the shearing stress which is generated along with the shearing deformation largely acts on a boundary between the high deformation resistance region which exhibits the high deformation resistance and the low deformation resistance region and hence, the turning of the metal structure into the finer grain structure is particularly accelerated in the boundary portion between the high deformation resistance region and the low deformation resistance region.

Accordingly, when the metal body is moved along the extending direction so as to allow the metal body to pass through the first low deformation resistance region forming zone and the second low deformation resistance region forming zone, in respective regions, a temperature control which is performed when the metal body assumes the high deformation resistance region from the low deformation resistance region becomes more important than a temperature control which is performed when the metal body assumes the low deformation resistance region from the high deformation resistance region.

Figure 12:
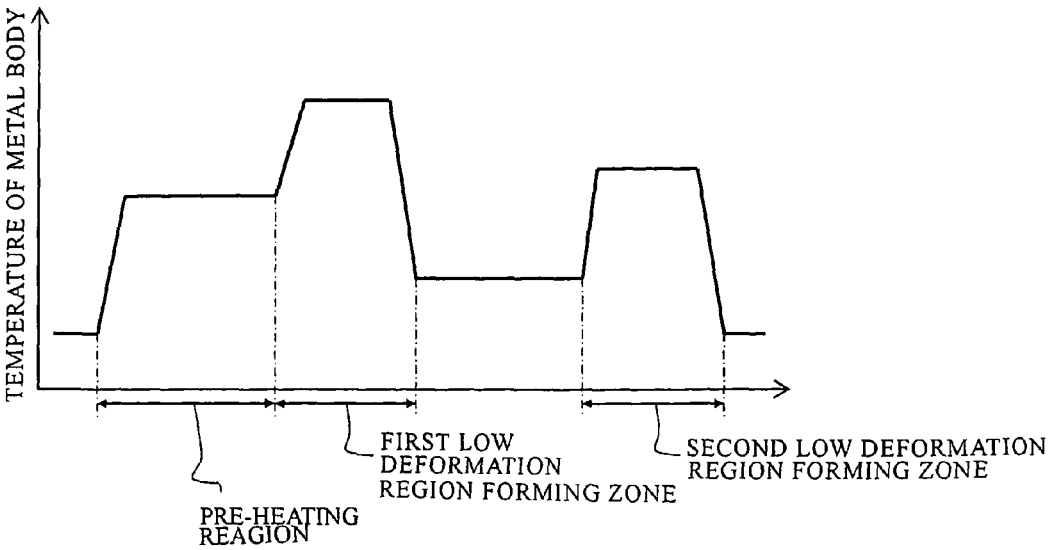
FIG. 12 is an explanatory view of the heating profile for the low deformation resistance region.

That is, when the metal body assumes the low deformation resistance region from the high deformation resistance region, the degree of freedom of the temperature control is high and hence, as shown in FIG. 12, in forming the low deformation resistance region by heating the metal body, a preheating region may be provided and the metal body may be preheated in and, thereafter, the metal body may be heated to a given temperature by main heating.

Particularly, as shown in FIG. 12, by providing the preheating region before the first low deformation resistance region forming zone and by preheating the metal body, the first low deformation resistance region 30*a*, 30*a*' which is heated in a relatively high-temperature state can be heated relatively approximately uniformly in a short time. Accordingly, by deforming the first low deformation resistance region 30*a*, 30*a*' which is heated approximately uniformly by shearing, it is possible to turn the metal structure of the first low deformation resistance region 30*a*, 30*a*' into finer homogeneous structure.

Further, when the solution heat treatment temperature is adopted as the heating condition of the first low deformation resistance region forming zone, by setting the temperature of the preheating in the preheating region to the solution heat treatment temperature, it is possible to perform the heating for a treatment time sufficient for performing the solution heat treatment and hence, the metal body which is surely subjected to the solution heat treatment can be deformed by shearing in the second low deformation resistance region forming zone.

Particularly, when the metal body is subjected to a plurality of solution heat treatment temperature or is subjected to a plurality of transformation temperature, the metal body may be held for given times at respective given temperatures and, thereafter, the main heating may be performed so as to deform the low deformation resistance region by shearing.

Further, also when the metal body is cooled, the metal body may be cooled gradually thus applying desired shearing stresses to the low deformation resistance region at respective cooling states.

Besides the above-mentioned case in which the shearing deformation is applied to the metal body in two stages, a plurality of intermediate non-low deformation resistance regions 33, 33' may be provided along the extending direction of the metal body. Further, the intermediate non-low deformation resistance regions may be provided in multiple stages. Particularly, when the metal body is a ceramic body which contains metal or the like, it is possible to apply the shearing deformation under the condition which differs each time the shearing deformation is applied to the metal body thus achieving the further homogenization of the metal structure.

Hereinafter, the processing apparatus of the first embodiment is explained.

Figure 13:
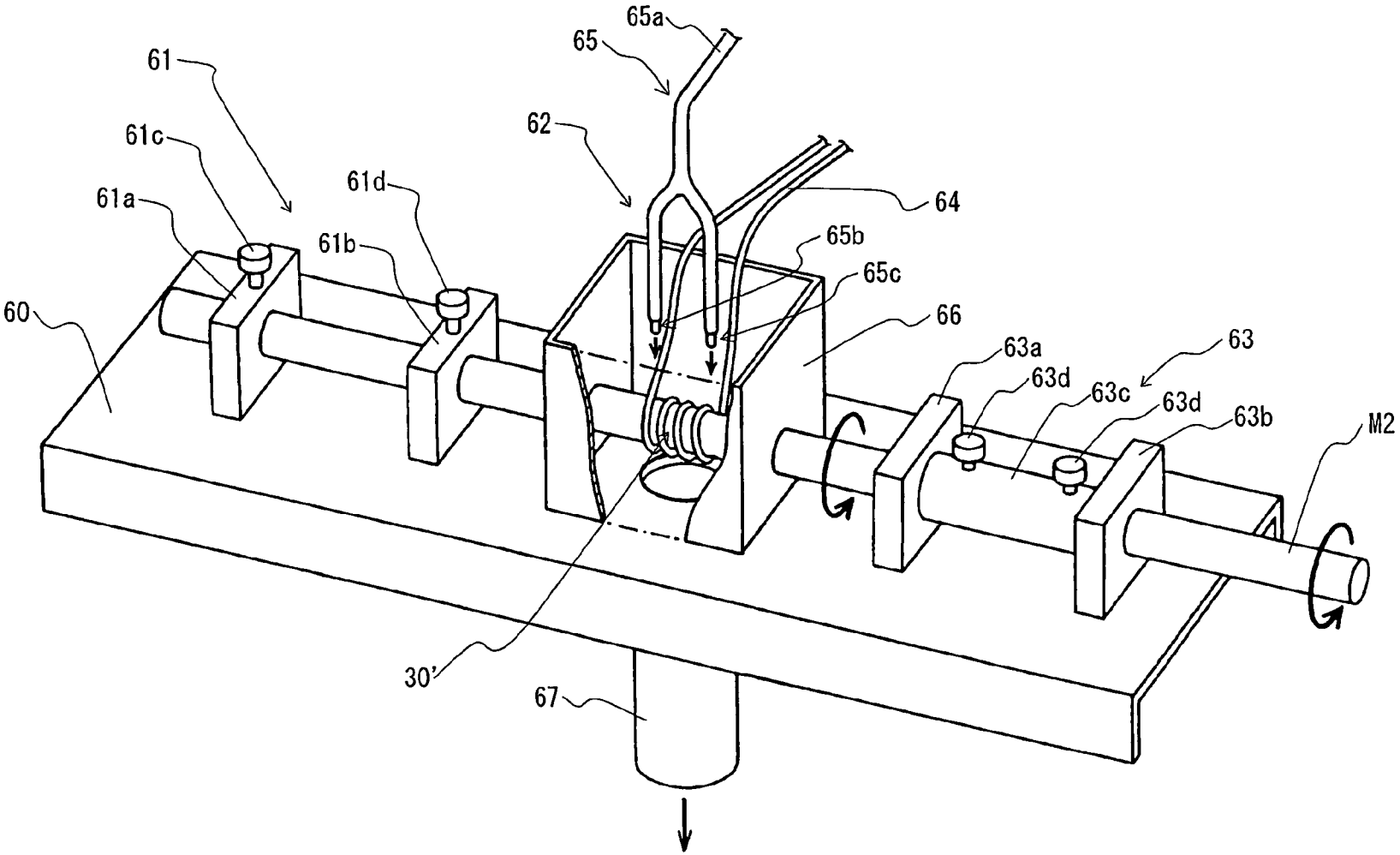
FIG. 13 is a schematic explanatory view of an STSP apparatus of a first embodiment.

FIG. 13 shows an apparatus which generates the shearing deformation of the metal body by twisting the low deformation resistance region formed in the metal body due to the one-way rotational motion or the both-way rotational motion. The method which turns the metal structure into the finer grain structure by generating the shear deforming of the low deformation resistance region by twisting the low deformation resistance region is referred to as a STSP (Severe Torsion Straining Process) by the inventors of the present invention and FIG. 13 is a schematic explanatory view of one example of a STSP apparatus. Here, for facilitating the explanation of the invention, although the metal body M2 is formed of a round rod body having a circular cross section which extends in one direction, the metal body M2 may be formed of a cylindrical body having a hollow portion.

The STSP apparatus includes a fixing portion 61, a shearing deformation portion 62, and a rotating portion 63 which are mounted on an upper surface of a base 60 along the extending direction of the metal body M2.

The fixing portion 61 is constituted of a first fixing wall 61*a* and a second fixing wall 61*b* which are mounted on an upper surface of the base 60 in an erected manner. The first fixing wall 61*a* and the second fixing wall 61*b* are respectively formed of plate bodies having given thicknesses, while the first fixing wall 61*a* and the second fixing wall 61*b* are arranged in substantially parallel to each other.

Further, insertion holes which allow the metal body M2 to pass therethrough respectively are formed in the first fixing wall 61*a* and the second fixing wall 61*b*, and the metal body M2 is allowed to pass through the insertion holes. By bringing distal end portions of fixing bolts 61*c*, 61*d* which are threadedly mounted on upper ends of the first fixing wall 61*a* and the second fixing wall 61*b* into contact with a peripheral surface of the metal body M2 which is allowed to pass through the insertion hole, the metal body M2 is fixed.

Here, the fixing portion 61 is not limited to the constitution which is formed of the first fixing wall 61*a* and the second fixing wall 61*b* and may adopt any constitution provided that the constitution can fix the metal body M2. Here, to fix the metal body M2 means the fixing of rotation of the metal body M2 which uses a center axis of the metal body M2 formed in a round rod shape as a rotational axis.

The rotating portion 63 includes a first restricting wall 63*a* and a second restricting wall 63*b* which are mounted on an upper surface of the base 60 in an erected manner, a reciprocation restricting body 63*c* which is interposed between the first restricting wall 63*a* and the second restricting wall 63*b*, and a rotating device not shown in the drawing.

The first restricting wall 63*a* and the second restricting wall 63*b* are respectively formed of plate bodies having given thicknesses, while the first restricting wall 63*a* and the second restricting wall 63*b* are arranged substantially parallel to each other. Further, the insertion holes which allow the metal body M2 to pass therethrough respectively are formed in the first restricting wall 63*a* and the second restricting wall 63*b*, and the metal body M2 is allowed to pass through the insertion holes.

The reciprocation restricting body 63*c* is formed of a cylindrical body which has a length substantially equal to a distance size between the first restricting wall 63*a* and the second restricting wall 63*b* and can be annularly mounted on the metal body M2. The reciprocation restricting body 63*c* is annularly mounted on the metal body M2 between the first restricting wall 63*a* and the second restricting wall 63*b* and, further, brings distal end portions of fixing bolts 63*d*, 63*d* which are threadedly mounted on a peripheral surface of the reciprocation restricting body 63*c* into contact with a peripheral surface of the metal body M2 which penetrates the reciprocation restricting body 63*c* thus fixing the reciprocation restricting body 63*c* to the metal body M2.

Accordingly, when the non-low deformation resistance region of the metal body M2 is rotated as described later, the reciprocation restricting body 63*c* is restricted by the first restricting wall 63*a* and the second restricting wall 63*b* thus preventing the displacement of the metal body M2 in the extending direction.

Various devices can be used as the rotating device which rotates the non-low deformation resistance region of the metal body M2 and any device can be used provided that the device can rotate the metal body M2 in one direction or in both directions while applying a given torque to the metal body M2 on the rotating portion 63 side. In this embodiment, a rotary motor (not shown in the drawing) is interlockingly connected to an end portion of the metal body M2 on the rotating portion 63 side and this rotary motor constitutes the rotating device.

The shearing deformation portion 62 is formed of a heating device 64 which heats the metal body M2 to a given temperature and a cooling device 65 which cools the metal body M2 to allow the low deformation resistance region 30' which is formed in the metal body M2 by heating using the heating device 64 to obtain a given width size.

In this embodiment, a high-frequency heating coil is used as the heating device 64, wherein the heating device 64 is formed by winding the high-frequency heating coil given turns around the metal body M2 and heats the metal body M2 to the given temperature to reduce the deformation resistance thus forming the low deformation resistance region 30'. Here, the heating device 64 is not limited to the high-frequency heating coil and may adopt heating which uses electron beams, plasma, laser, electromagnetic induction or the like, heating by a gas burner, or heating using electric short-circuiting. Particularly, when the electron beams are used as the heating device 64, a width of the low deformation resistance region 30' in the extending direction of the metal body M2 can be set to an extremely small value and hence, it is possible to apply a larger shearing stress to the low deformation resistance region 30' whereby the metal structure can be turned into the further finer grain structure.

The cooling device 65 is formed of a first water discharge opening 65*b* and a second water discharge opening 65*c* which discharge water supplied from a water supply pipe 65*a* and the metal body M2 is cooled by water discharged from the first water discharge opening 65*b* and the second water discharge opening 65*c*. In FIG. 10, numeral 66 indicates a water receptacle which receives water discharged from the first water discharge opening 65*b* and the second water discharge opening 65*c*, and numeral 67 indicates a water discharge pipe which is connected to the water receptacle 66.

Figure 14:
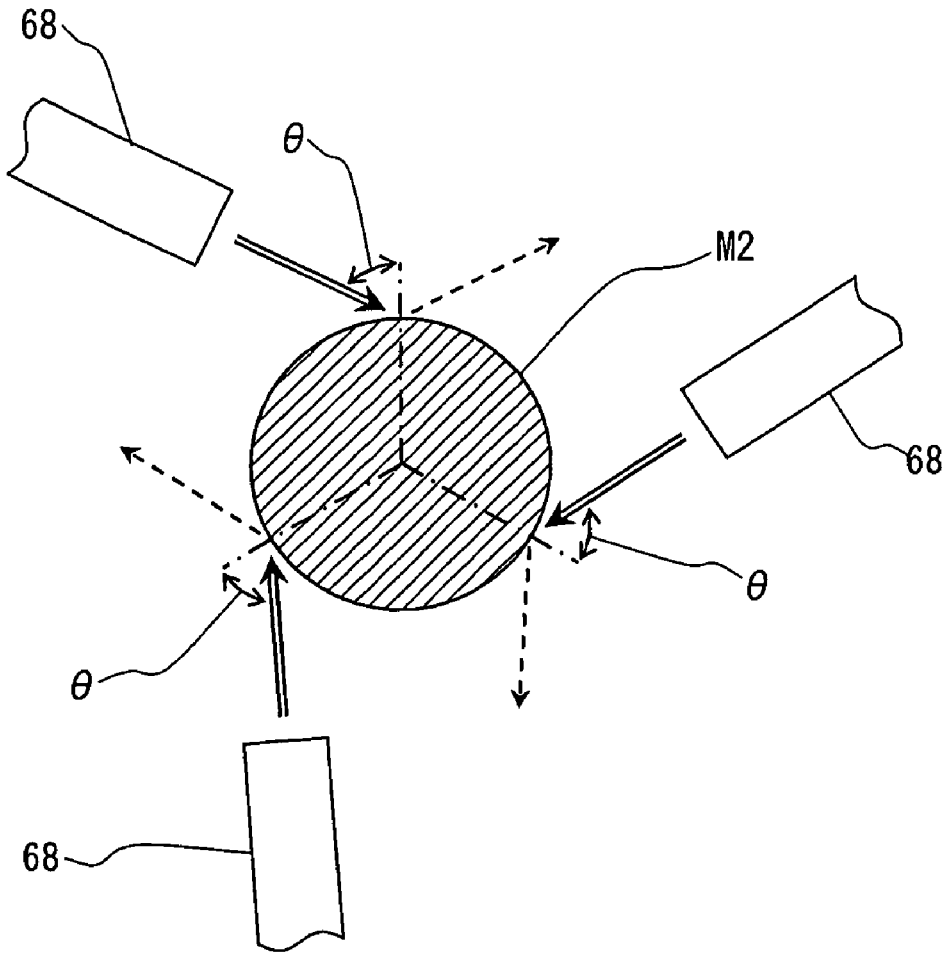
FIG. 14 is an explanatory view of another embodiment in a cooling method of the metal body.

In this embodiment, the first water discharge opening 65*b* and the second water discharge opening 65*c* are configured to eject water downwardly from above the metal body M1. However, as shown in FIG. 14, for example, a plurality of water discharging openings 68 may be formed in a periphery of the metal body M1 and water may be ejected toward the metal body M1 from the plurality of water discharge openings 68.

In this case, water is ejected from the respective water discharge openings 68 at a given incident angle θ with respect to the normal direction of the surface of the metal body M1 and hence, cooling efficiency is further enhanced. Accordingly, the temperature gradient of the metal body M1 can be increased at both ends of the low deformation resistance region 30' and hence, a large shearing stress can be applied to the metal body M1 whereby it is expected that the efficiency in turning the metal structure into the finer grain structure is enhanced.

Particularly, it is possible to efficiently scatter bubbles which are generated on the surface to be cooled along with cooling and hence, the lowering of the cooling efficiency due to the generation of the bubbles is suppressed whereby the cooling efficiency can be enhanced.

Further, in the cooling device 65, both sides of the low deformation resistance region 30' which is formed by the heating device 64 arranged between the first discharge opening 65*b* and the second discharge opening 65*c* are cooled by water discharged from the first discharge opening 65*b* and the second discharge opening 65*c*. Particularly, by adjusting the mounting position of the first discharge opening 65*b* and the second discharge opening 65*c*, the low deformation resistance region 30' is configured to be an extremely minute region compared to the length of the metal body M2 in the extending direction.

In this manner, by setting the low deformation resistance region 30' to have a minute width along the extension direction of the metal body M2, an extremely large shearing deformation can be easily generated on the low deformation resistance region 30' portion and hence, it is possible to enhance the efficiency of turning the metal structure into the finer grain structure. Further, when the low deformation resistance region 30' is twisted by the rotating device, it is possible to prevent the generation of twisting irregularities in the low deformation resistance region 30'. Still further, it is possible to reduce residual strain of the shearing deformation or residual deformation generated in the low deformation resistance region 30' due to twisting.

Further, the low deformation resistance region 30' which is heated by the heating device 64 is rapidly cooled by the cooling device 65 whereby quenching is performed on the low deformation resistance region 30' and hence, it is also possible to enhance the hardness of the metal body M2 having finer metal structure.

Still further, by rapidly cooling the low deformation resistance region 30', it is possible to prevent the continuous heating state and hence, it is possible to suppress that the metal structure which is once turned into the finer grain structure becomes coarse.

The width of the low deformation resistance region 30' is favorably less than approximately three times of the cross section width size of the metal body M2 at a cross section taken along a surface orthogonal to the extending direction of the metal body M2. By imposing such a condition on the low deformation resistance region 30', while suppressing the deformation of the low deformation resistance region 30' due to twisting to necessary minimum, it is possible to generate a large shearing deformation and hence, it is possible to enhance the efficiency in turning the metal structure of the metal body M2 into the finer grain structure.

Although the above-mentioned cooling device 65 is a water cooling device, the cooling device 65 is not limited to the water cooing device and, provided that the device can cool the metal body M2 in a state that the heating region by the heating device 64 is a local region, air cooling may be also used or exciting cooling may be also used and, an arbitrary cooling device may be used.

Particularly, by making use of the water receptacle 66 portion as an arbitrary vacuum chamber and by turning the inner space of the vacuum chamber into a vacuum state which is equal to or less than approximately 500 hPa, when the low deformation resistance region 30' is formed in a vacuum, it is possible to prevent the formation of a reaction film of a gaseous component on the surface of the low deformation resistance region 30'. Accordingly, the processing in post steps can be alleviated.

Further, when the metal body M2 is heated in such a vacuum, an electron beam heating may be used as the heating device 64 and, further, it is possible to make use of a self cooling function for cooling the metal body M2 against the electron beam heating and hence, the low deformation resistance region 30' can be set to have an extremely minute width size whereby it is possible to generate an extremely large shearing deformation on the low deformation resistance region 30'.

Further, by making use of the formation of the low deformation resistance region 30' in a vacuum, ion doping of particles made of given elements may be applied to the low deformation resistance region 30' portion.

In this manner, by applying the ion doping to the low deformation resistance region 30', the low deformation resistance region 30' is turned into to have finer metal structure and, at the same time, since the ionized particles are injected into the low deformation resistance region 30', it is possible to form the highly functionalized metal body. Particularly, by injecting the particles while turning the metal structure into the finer grain structure, the particles can be injected more deeply than the usual ion doping and, at the same time, the injected particles can be sufficiently mixed in the metal body M2. Further, it is possible to eliminate the damage on the metal structure generated in the metal body M2 due to the injection of the particles.

Further, instead of performing the ion doping of the given particles, it is also possible to spray a powdery material having a given component on the low deformation resistance region 30'.

By spraying the powdery material on the low deformation resistance region 30', the metal structure of the metal body M2 is turned into the finer grain structure and, at the same time, the powdery material can be mechanically mixed into the low deformation resistance region 30' and hence, it is possible to form the highly functionalized metal body. Particularly, even a metal body having a component which is difficult to form by a conventional casting can be easily formed and, when the powdery material having a component other than metal is sprayed on the low deformation resistance region 30', a novel material can be manufactured.

Here, when the powdery material having the given component is sprayed on the low deformation resistance region 30', it is not always necessary to perform the operation in a vacuum and the operation may be performed in the normal pressure state.

Instead of forming the low deformation resistance region 30' in a vacuum in the reduced pressure state as described above, it is also possible to form a pressurizing chamber in the water receptor 66 portion and to turning the pressurizing chamber into a high pressure state whereby forming the low deformation resistance region 30'.

In this manner, when the low deformation resistance region 30' is formed in the high pressure state, by making use of the pressurizing function to the low deformation resistance region 30' due to the high pressure, it can be expected that the efficiency in turning the metal structure into the finer grain structure is enhanced.

Particularly, besides applying pressure to the pressurizing chamber by supplying an inert gas into the pressurizing chamber, it is also possible to apply pressure by supplying an active gas.

By forming the low deformation resistance region 30' in the active gas atmosphere, while turning the metal structure of the metal body M2 into the finer grain structure, a reaction region with the active gas can be formed on a surface of the low deformation resistance region 30' and hence, not only a given surface coating is performed by performing a surface reformation on the low deformation resistance region 30' but also a strong strain due to the reaction with the active gas can be generated or the surface coating is performed and hence, it is possible to form the highly functionalized metal body.

Particularly, when a nitrogen gas is used as the active gas, while turning the metal structure of the metal body M2 into the finer grain structure, it is possible to nitride the low deformation resistance region 30' and hence, along with turning the metal structure into the finer grain structure, it is possible to form the highly functionalized metal body M2 which has high strength and high ductility and is applied a nitriding treatment can be supplied at a low cost.

Further, when a gas containing carbon such as a methane gas and/or a carbon monoxide gas is/are used as the active gas, while turning the metal structure of the metal body M2 into the finer grain structure, the carburizing treatment can be applied to the low deformation resistance region 30' and hence, along with turning the metal structure into the finer grain structure, it is possible to supply the highly functionalized metal body M2 which has high strength and high ductility and is applied a nitriding treatment can be supplied at a low cost.

Here, when the active gas is supplied to the pressurizing chamber, it is not always necessary to be in the high pressure state and it may be sufficient that the inside of the pressurizing chamber is in the active gas atmosphere.

Further, instead of bringing the inert gas or the active gas into contact with the low deformation resistance region 30', it is possible to bring an inert liquid or an active liquid into contact with the low deformation resistance region 30'.

That is, the low deformation resistance region 30' may be formed by directly immersing the above-mentioned STSP apparatus in an inert liquid an active liquid.

In this manner, by forming the low deformation resistance region 30' in the inert liquid or in the active liquid, the forming condition of the low deformation resistance region 30' can be made stable whereby the metal structure can be homogeneously turned into the finer grain structure.

Particularly, by forming the low deformation resistance region 30' by heating the metal body M2 in the inert liquid or in the active liquid, it is possible to make use of the inert liquid or the active liquid as a cooling agent and hence, the cooling efficiency can be enhanced.

Further, with respect to the portion where the shearing deformation is finished, it is possible to sequentially perform the quenching by cooling with the inert liquid or the active liquid and hence, it is possible to form the highly functionalized metal body.

Here, when the low deformation resistance region 30' is formed by heating the metal body M2 in the inert liquid or in the active liquid, there arises a possibility that heating efficiency at the low deformation resistance region 30' portion is lowered.

Accordingly, when the low deformation resistance region 30' is formed, by reducing the thermal conductivity in the surrounding of the forming region of the low deformation resistance region 30' in the metal body M2, it is configured to suppress the diffusion of the heat applied to the low deformation resistance region 30' by way of the inert liquid or the active liquid. Accordingly, the heating of the metal body M2 in the liquid can be efficiently performed.

Specifically, an air nozzle (not shown in the drawing) is positioned in the vicinity of the low deformation resistance region 30' to be heated and, by supplying a gaseous body in a bubble form from the air nozzle, a bubble region is generated in the surrounding of the forming region of the low deformation resistance region 30' and hence, a heat insulation layer made of bubbles is formed whereby the thermal conductivity can be reduced. Accordingly, it is possible to reduce the thermal conductivity extremely easily and hence, it is possible to efficiently perform the heating of the metal body M2 in the liquid.

Particularly, when the gaseous body supplied in the bubble form from the air nozzle is a gas containing carbon such as nitrogen gas, a methane gas and/or a carbon monoxide gas, it is possible to apply a nitriding treatment or a carburizing treatment to the low deformation resistance region 30'.

Further, when the metal body M2 is a hollow cylinder having a hollow portion, by turning the hollow portion into a reduced pressure state, it is possible to perform the shearing deformation on the low deformation resistance region while deforming the metal body in the low deformation resistance region toward the hollow portion by contraction and hence, the metal structure can be further turned into the finer grain structure.

Alternatively, by setting the hollow portion in a high pressure state as an opposite case, the shearing deformation can be performed while deforming the metal body in the low deformation resistance region by expansion and hence, the metal structure can be further turned into the finer grain structure.

In this manner, even when the hollow portion is turned into the reduced pressure state or the high pressure state, it is possible to supply the inert gas or the active gas, or the inert liquid or the inactive liquid to the inside of the hollow portion under a given pressure. Particularly, when the hollow portion is turned into the reduced pressure state, it is possible to relatively realize the reduced pressure state by placing the outside of the metal body in the pressurized state.

The STSP apparatus is constituted as described above. When the metal structure of the metal body M2 is turned into the finer grain structure by twisting the low deformation resistance region 30' formed in the metal body M2, the metal body M2 is mounted on the STSP apparatus and, while cooling the both sides of the low deformation resistance region 30' by the cooling device 65, the low deformation resistance region 30' is heated by the heating device 64.

Here, the heating using the heating device 64 is performed until the temperature of the low deformation resistance region 30' becomes equal to or higher than softening temperature for restoring strain or the recrystallization temperature generated in the metal body M2. When the temperature becomes equal to or higher than the restoration/recrystallization temperature, the non-low deformation resistance region is rotated about the rotation axis by the rotating device using a center axis of the metal body M2 as a rotation axis and hence, the low deformation resistance region 30' is twisted.

The rotation of the non-low deformation resistance region using the rotating device is set to 1 to 20 rpm. The number of rotation is equal to or more than half rotation and, larger the number of rotation, the larger the shearing deformation can be generated and hence, it is possible to enhance the efficiency in turning the metal structure into the finer grain structure.

Here, the heating temperature of the metal body M2 by the heating device 64 is equal to or higher than the restoration/recrystallization temperature. However, it is favorable to control the temperature less than the temperature in which the influence of the large-sizing of the metal crystal grains starts to be generated.

In this embodiment, it is configured that one end of the metal body M2 in which the low deformation resistance region 30' is formed is fixed and another end thereof is rotated. However, the both sides sandwiching the low deformation resistance region 30' may be respectively rotated in an opposite direction.

In this manner, the low deformation resistance region 30' is twisted and, thereafter, the low deformation resistance region 30' is cooled. In the above-mentioned embodiment, it is not possible to move the metal body M2 along the extending direction thereof. However, by forming the metal body M2 movable along the extending direction thereof, the position of the low deformation resistance region 30' in the metal body M2 can be displaced and hence, by sequentially performing the shearing processing by twisting on the metal body M2, the metal body M2 having the metal structure thereof turned into the finer grain structure over a wide range of region can be realized.

Further, instead of allowing the metal body M2 to be movable along the extending direction of the metal body M2, it is possible to form the shearing deformation portion 62 constituted of the heating device 64 and the cooling device 65 movable along the extending direction of the metal body M2.

Further, by setting the movement of the metal body M2 in the extending direction thereof or the movement of the shearing deformation portion 62 along the extending direction of the metal body M2 as the reciprocating motion, the shearing processing is repeatedly performed on the region having a given width in the metal body M2 whereby the metal structure is turned into the finer grain structure.

Still further, in some cases, for every low deformation resistance region 30' formed in a given position in the metal body M2, by adjusting the rotation speed of the metal body M2 using the rotating device, heating condition or cooling condition, the degree of turning of the metal structure into the finer grain structure is adjusted and hence, it is possible to adjust the strength or the ductility of the metal body M2. Accordingly, it is possible to form the metal body M2 in which the strength thereof is partially enhanced or the ductility thereof is enhanced.

Figure 15:
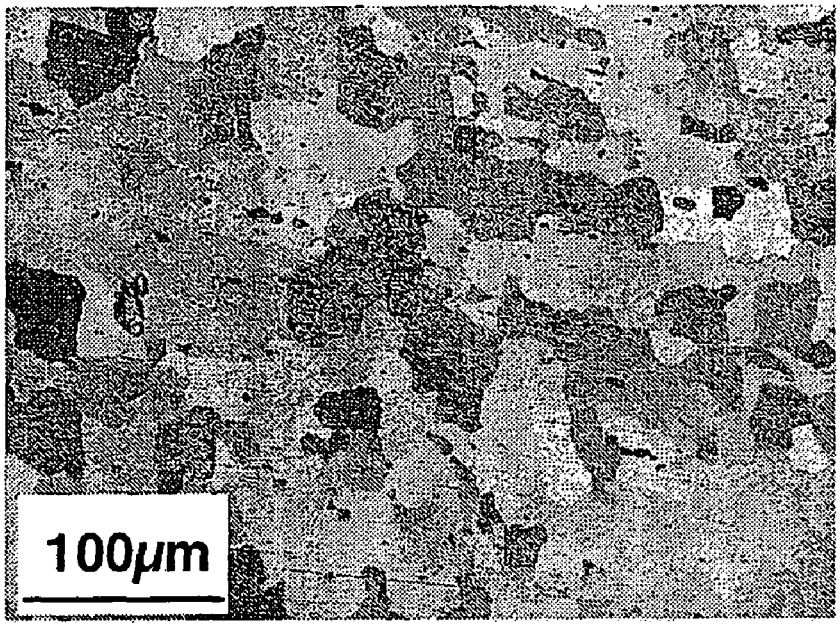
FIG. 15 is an electron microscope photograph of the metal structure before processing by the STSP apparatus.
Figure 16:
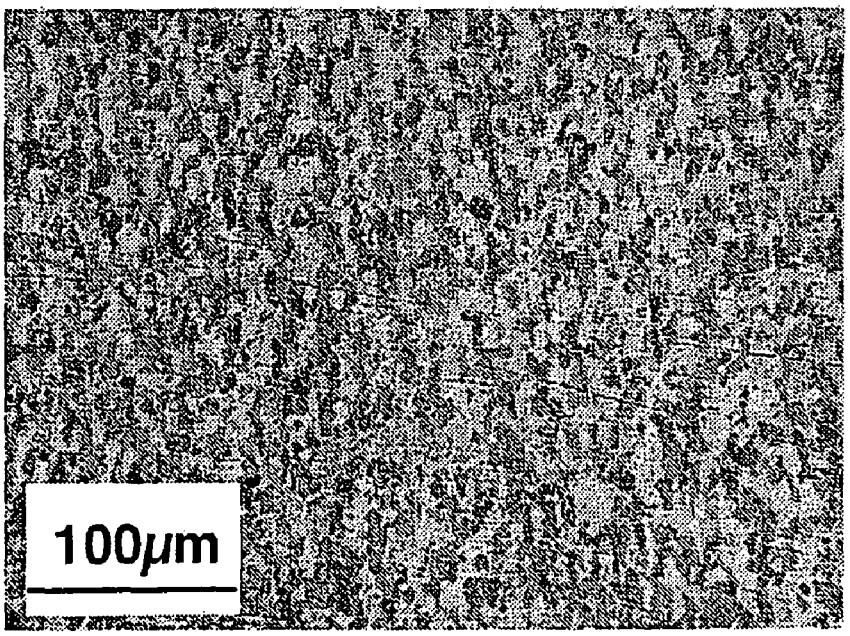
FIG. 16 is an electron microscope photograph of the metal structure after processing by the STSP apparatus.

FIG. 15 is an electron microscope photography of A15056 which forms an aluminum alloy before the treatment by the above-mentioned STSP apparatus and FIG. 16 is an electron microscope photography of A15056 treated by the STSP apparatus. It is understood that, by deforming the metal body M2 by shearing, crystal grains of the metal structure once having a size of 60 to 70 mm can be minimized to have a size equal to or less than 5 mm.

Further, the crystal grains are made to have a finer grain structure by contriving and setting the conditions of heating, cooling. That is, for example, only extremely narrow region is heated using the electron beam to a very deep portion and the region other than the extremely narrow portion is held in a low temperature by making use of a self cooling and hence, it is possible to allow the boundary portion between the low deformation resistance region and the non-low deformation resistance region to have a narrow width and to concentrate strong strain to the low deformation resistance region whereby it is possible to make the crystal grains to have a finer grain structure with sizes from several tens nanometers to ten nanometers.

Figure 17:
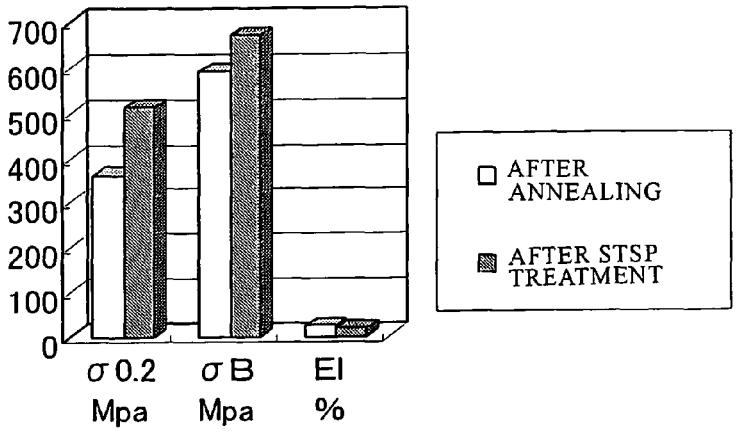
FIG. 17 is a graph showing changes of properties when the metal structure is turned into the finer grain structure with respect to S45C.

Further, FIG. 17 shows a result of comparison between the metal body which is obtained by processing a S45C which is an iron-based material using the above-mentioned STSP apparatus and the metal body which is obtained by applying the annealing treatment based on a heat history equal to the processing in the STSP apparatus to the S45C with respect to a yield, a tensile strength, a uniform elongation. From the result, it is understood that, by processing the metal body using the STSP apparatus, the yield and the tensile strength can be enhanced without increasing the uniform elongation.

Figure 18:
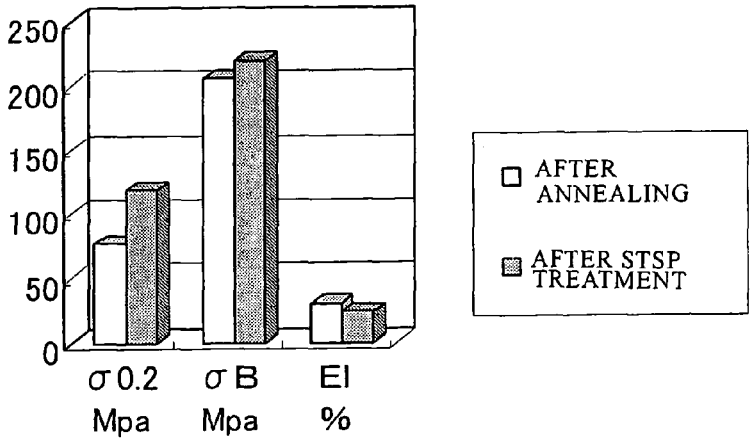
FIG. 18 is a graph showing changes of properties when the metal structure is turned into the finer grain structure with respect to JIS-A5056.

Further, FIG. 18 shows a result of comparison between the metal body which is formed by treating A15056 as aluminum-based material using the above-mentioned STSP apparatus and the metal body by performing the annealing processing by heat history to the S45C which is similar processing in the STSP apparatus with respect to yield, tensile strength, uniform elongation. From the result, it is understood that, by treating the metal body using the STSP apparatus, in the same manner in the case of S45C, the yield and the tensile strength can be enhanced without increasing the uniform elongation.

Here, in the above-mentioned STSP apparatus, it is clearly understood from the structure thereof that there arises a possibility that, when the non-low deformation resistance region is rotated using the rotating device, sufficient shearing deformation is not generated in the rotation axis portion of the low deformation resistance region 30' and hence, a region where the metal structure is insufficiently turned into the finer grain structure is formed.

Accordingly, in the STSP apparatus of this embodiment, when the low deformation resistance region 30' is formed by heating the meal body M2 using the heating device 64, the heating device 64 heats a heating distribution with which the rotation axis region is a non-center.

That is, as described in this embodiment, when the heating device 64 is constituted of a high frequency heating coil, the center axis of the high frequency heating coil is biased from the rotation axis of the metal body M2 rotated by the rotary portion 63. Due to such a constitution, in the low deformation resistance region 30', it is possible to set a heating distribution in which the rotation axis region is a non-center and hence, it is possible to prevent the generation of the region where the metal structure is not turned into the finer grain structure in the rotation axis region whereby it is possible to uniformly turn the metal structure into the finer grain structure even in the STSP apparatus.

In this manner, by adjusting the arrangement of the heating device 64, the heating distribution can be made in a state in which the rotation axis region is the non-center whereby the metal structure in the rotation axis region can be also surely turned into the finer grain structure.

A method for preventing unevenness formed in turning the metal structure into the finer grain structure in the STSP apparatus is as follows. That is, one of the non-low deformation resistance regions sandwiching the low deformation resistance region 30' is moved in the direction approximately orthogonal to the extending direction of the metal body M1 with respect to the other non-low deformation resistance region and hence, the shearing deformation is allowed to be generated in the rotation axis region of the low deformation resistance region 30' due to the movement whereby it is possible to prevent to form the unevenness in turning the metal structure into the finer grain structure.

That is, a vibration imparting device 47 of an SVSP apparatus described later may be incorporated in the STSP apparatus and the low deformation resistance region 30' may be vibrated while being twisted.

Alternatively, by offsetting the rotation axis per se from a geometrical center of the metal body M2 which is formed in a round rod shape, the shearing deformation may be generated in a region of the rotation axis at the low deformation resistance 30' so as to prevent the non-uniformity in turning the metal structure into the finer grain structure.

Further, by bringing a proper forming guide body which is served for forming the metal body M2 into a given shape into contact with the low deformation resistance region 30', it is possible to generate a deformation stress which is applied to the low deformation resistance region 30' by the forming guide body and hence, it is also possible to prevent the non-uniformity in turning the metal structure into the finer grain structure.

Particularly, in the low deformation resistance region 30', since the deformation resistance is lowered, formation of the portion into a given shape can be easily performed and the deformation to a given shape and the elimination of the unevenness in turning the metal structure into the finer grain structure can be simultaneously performed.

Figure 19:
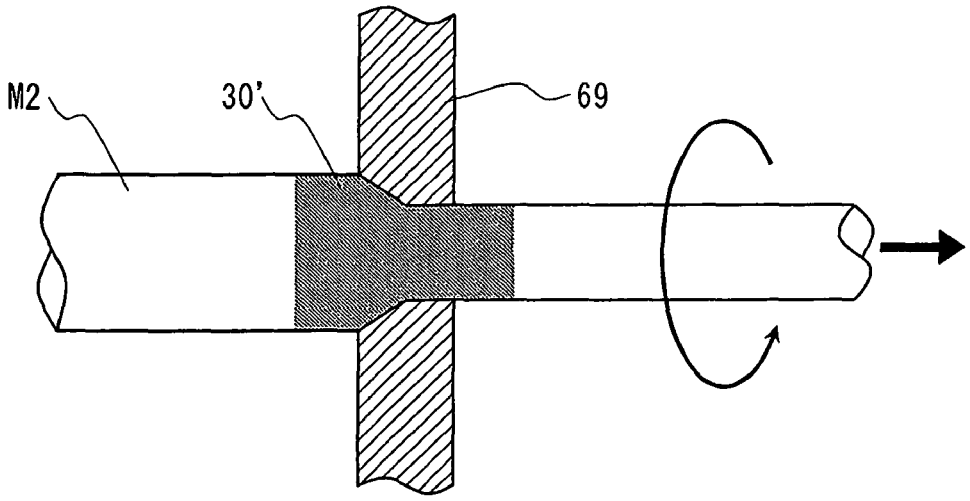
FIG. 19 is a schematic explanatory view of a modification in the STSP apparatus.

Specifically, as shown in FIG. 19, as a forming guide body, for example, a drawing die 69 is brought into contact with the low deformation resistance region 30'. Accordingly, while turning the metal structure into the finer grain structure in the low deformation resistance region 30' by the shearing deformation, it is possible to apply the drawing treatment to the metal body M2 using the drawing die 69.

Particularly, in FIG. 19, the drawing die 69 is connected to a heater not shown in the drawing to obtain a desired temperature. That is, the drawing die 69 can be used as a heating device.

Accordingly, it is possible to locally heat a contacting portion of the metal body M2 which is brought into contact with the drawing die 69 and hence, the low deformation resistance region 30' can be easily formed.

Alternatively, a water passage (not shown in the drawing) or the like which allows cooling water to pass therethrough may be formed in the inside of the drawing die 69 so that the drawing die 69 may be used as a cooling device which cools the low deformation resistance region 30'.

When the drawing die 69 is used as a cooling device, it is possible to locally cool the contacting portion of the metal body which is brought into contact with the drawing die 69, then the drawing die 69 effectively cools the low deformation resistance region after the shearing deformation and hence, the manufacturing efficiency can be enhanced.

Further, a given formation processing can be performed on the metal body M2 using a forming guide body after cooling the low deformation resistance region 30' to a given temperature, particularly to the suitable temperature to perform a formation processing.

Figure 20:
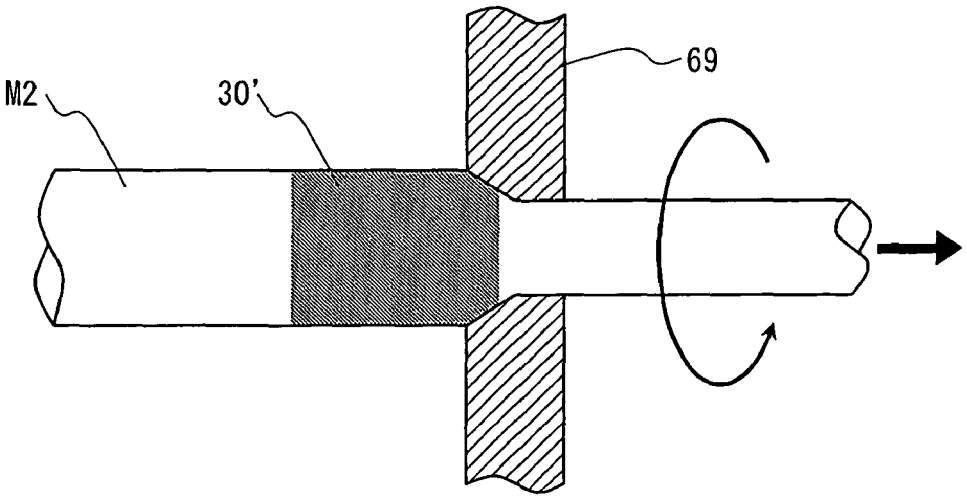
FIG. 20 is a schematic explanatory view of a modification in the STSP apparatus.

Here, for facilitating the explanation, a cooling device is omitted in FIG. 19 and a heating device is omitted in FIG. 20.

The forming guide body is not limited to a drawing die 69. With the use of a die or a bite for forming male threads, thread processing or gear rolling may be also applied.

Figure 21:
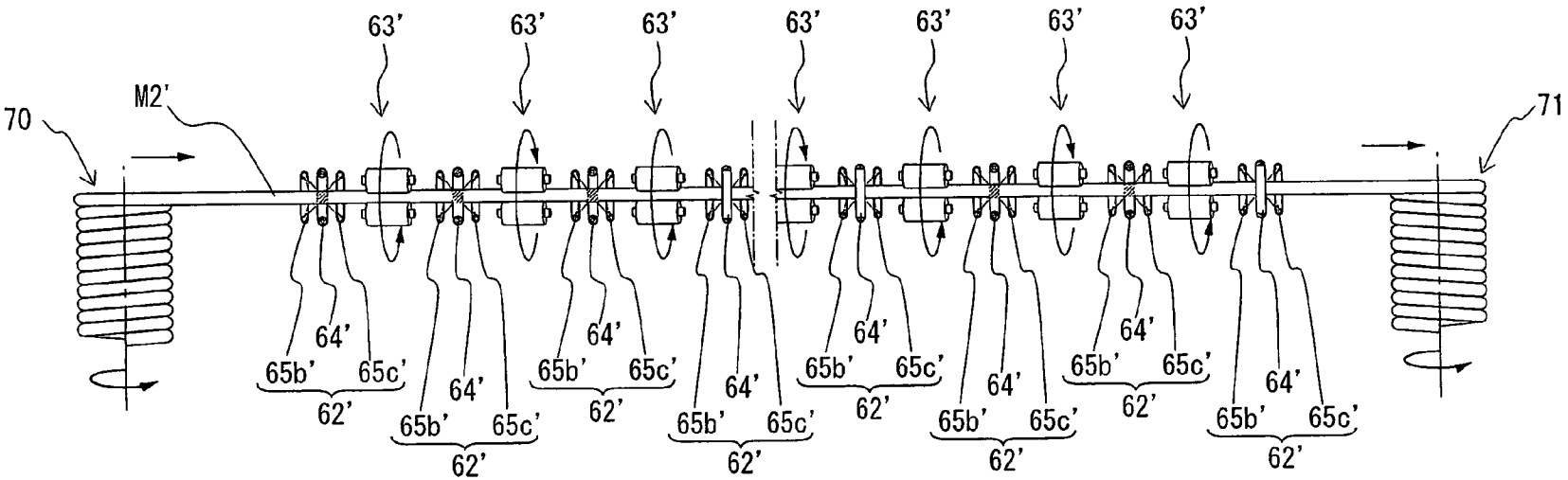
FIG. 21 is a schematic explanatory view of a modification in the STSP apparatus.

FIG. 21 is a schematic explanatory view of a modification of the above-mentioned STSP apparatus. This STSP apparatus includes a supply portion 70 which supplies a metal body M2' and a housing portion 71 which houses the metal body M2' which is deformed by shearing.

The metal body M2' which is wound around a given reel is supplied to the supply portion 70 and the supply portion 70 feeds the metal body M2' while elongating the metal body M2' linearly using a pulling tool not shown in the drawing.

In the housing portion 71, the metal body M2' which is deformed by shearing is wound around a reel using a winding tool not shown in the drawing and is housed.

Then, in the STSP apparatus, a plurality of shearing deformation portions 62' are arranged in a spaced-apart manner at a given interval along the extending direction of the metal body M2' between the supply portion 70 and the housing portion 71. Further, a rotary portion 63' is positioned between the neighboring shearing deformation portions 62',62' and the metal body M2' is rotated about the rotation axis which is arranged approximately in parallel to the extending direction of the metal body M2' by the rotary portion 63' thus deforming the metal body M2' portion of the shearing deformation portion 62' by shearing.

In the shearing deformation portion 62', a high-frequency heating coil 64' which heats the metal body M2', a first water discharging port 65*b'* and a second water discharging port 65*c'* which discharges cooling water to cool the metal body M2' are provided. Further, the high-frequency heating coil 64' is interposed between the first water discharging port 65*b'* and the second water discharging port 65*c'* so as to confine a heating region of the metal body M2' which is formed by the high frequency coil 64' in a minute range.

In this embodiment, the rotary portion 63' includes rotating rollers which are brought into contact with the metal body M2' and the metal body M2' is rotated by the rotating roller. Further, with respect to the neighboring rotary portions 63', rotating directions of respective rotating rollers are set opposite to each other.

In the STSP apparatus having such a constitution, by feeding the metal body M2' using the supply portion 70 and the housing portion 71 as transport means of the metal body M2', it is possible to apply shearing deformation to the metal body M2' plural times.

Alternatively, for example, in a state that the shearing deformation portions 62' are arranged at N positions in a spaced-apart manner at a given interval T along the extending direction of the metal body M2', when the metal body M2' is fed by a distance equal to the given interval T using the supply portion 70 and the housing portion 71 as the transport means of the metal body M2', the shearing deformation can be performed at a time within a region covering a length of T×N. Accordingly, it is possible to feed the metal body M2' by T×N in a state that the shearing deformation is stopped and, thereafter, it is possible to restart the shearing deformation so as to feed the metal body M2' by a distance equal to the given distance T. By repeating such operations, the manufacturing efficiency can be enhanced.

Further, in this case, N is an even number and the rotary portion 63' can be arranged in every other space defined between the neighboring shearing deformation portions 62' without providing the rotary portion 63' in each space defined between every two neighboring shearing deformation portions 62' as shown in FIG. 21.

The STSP apparatus in the second embodiment which is the improved STSP apparatus in the first embodiment is explained hereinafter. In the STSP apparatus in the second embodiment, a low deformation resistance region which is formed by heating the metal body is allowed to move along the extending direction of the metal body.

Figure 22:
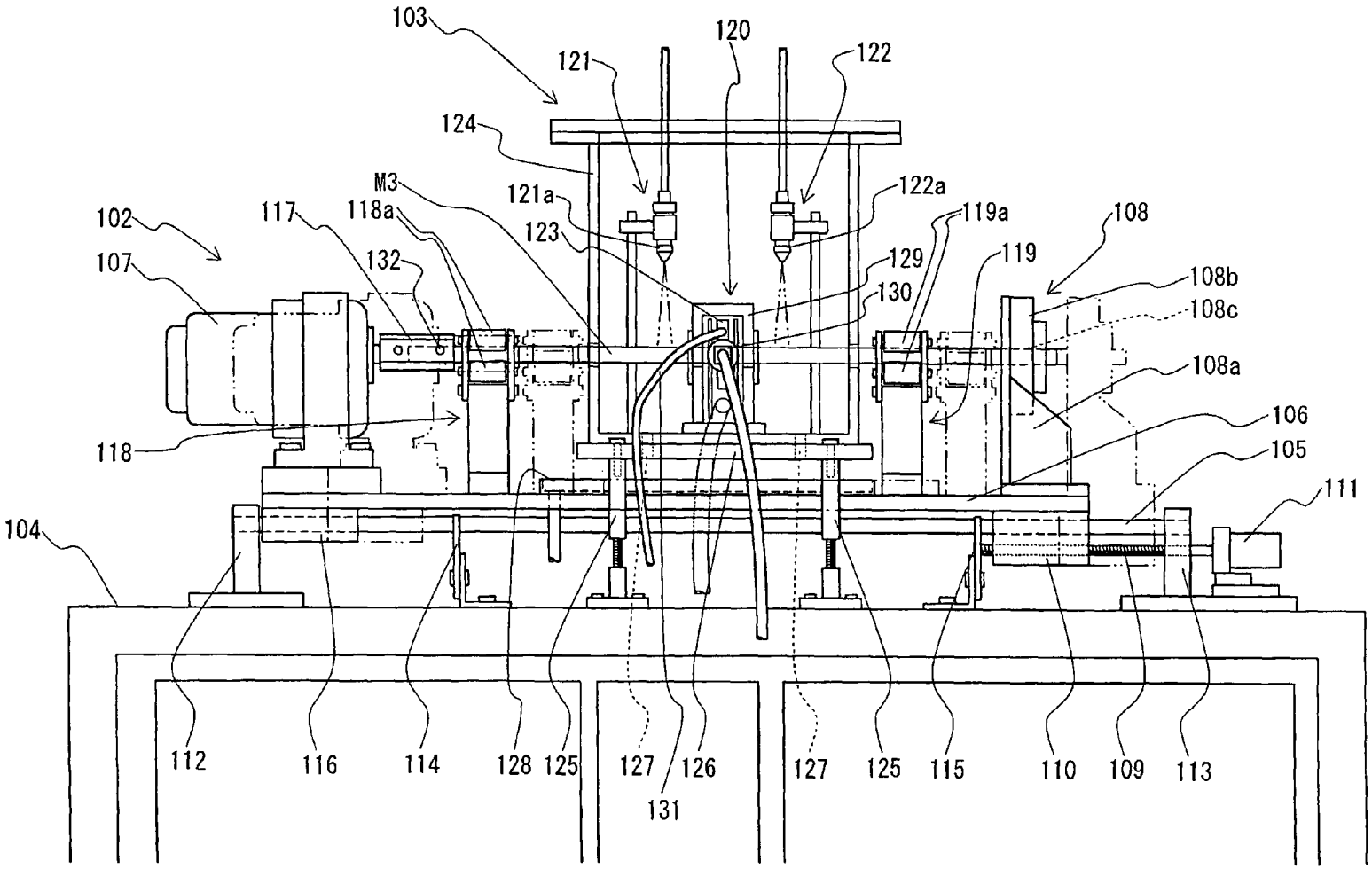
FIG. 22 is a schematic explanatory view of an STSP apparatus of a second embodiment.
Figure 23:
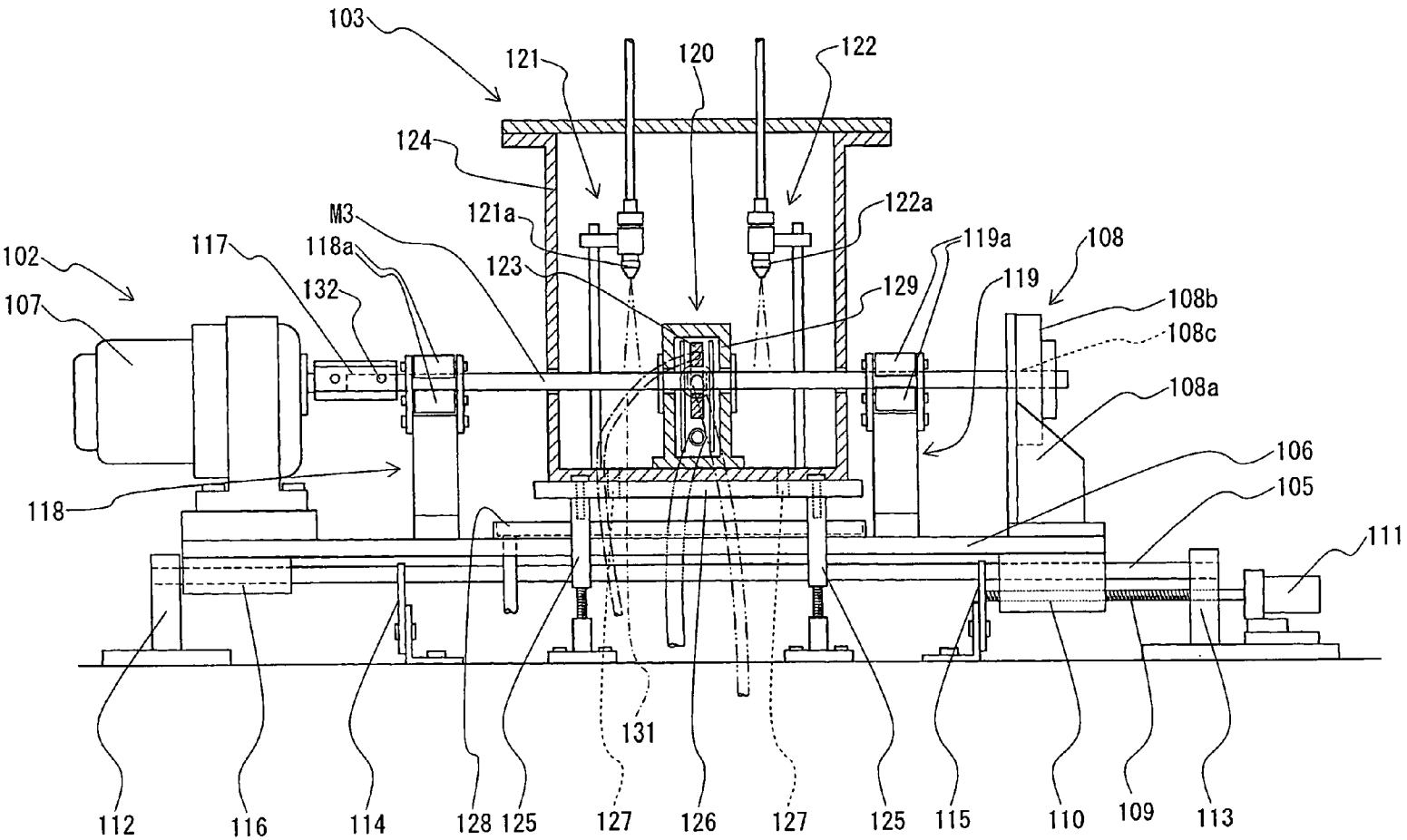
FIG. 23 is an enlarged view with a part broken away of FIG. 2.

FIG. 22 is a schematic explanatory view of the STSP apparatus in the second embodiment and FIG. 23 is a schematic explanatory view of FIG. 22 with a part broken away.

The STSP apparatus in the second embodiment consists of a rotary processing part 102 which supports the rod-like metal body M3 to be processed while rotates the metal body, M3 as a rotating means, and a heating processing part 103 which heats a part of the metal body M3' supported in the rotary processing part 102 and is used as a low deformation resistance region forming means which forms a lower deformation resistance region. Here in this embodiment, the metal body M3 is described as a rod body having circular cross section, however, the metal body M3 is not always limited to the rod body having circular cross section. For example, the metal body can be a cylindrical body which includes a hollow portion extended along the extending direction of the metal body M3 or in some case, the metal body M3 can be a mere angular rod body.

The rotary processing part 102 consists of a slide rail 105 which is mounted on an upper surface of a base body 104 while extended towards horizontal direction, a sliding table 106 which is slidably attached on the slide rail 105 and slides horizontally along the slide rail 105, a twisting motor 107 which is mounted on one end of the sliding table 106, and a fixing support body 108 which is mounted on the other end of the sliding table 106 and fixedly supports one end of the metal body M3 being rotated by the twisting motor 107.

Further, in the lower surface of one end of the sliding table 106, a first projection member 110 which is threaded with a reciprocation manipulation shaft 109 formed in male threads is projected wherein the constitution allows the sliding table 106 to slide horizontally along the slide rail 105 by rotating the reciprocation manipulation shaft 109 using a reciprocation manipulation motor 111 which is interlockingly connected with one end of the reciprocation manipulation shaft 109.

The slide rail 105 is a cylindrical rod-shaped body in this embodiment and is extended between a first supporting wall 112 and a second supporting wall 113 which are erected in a spaced-apart manner with a given distance on the upper surface of the base body 104. Particularly in this embodiment, two slide rails 105 are placed in parallel in a spaced-apart manner on a horizontal plane. In FIG. 22 and FIG. 23, numeral 114 indicates a first subsidiary supporting body which also subsidiarily supports the slide rail 105 and numeral 115 indicates a second subsidiary supporting body which also subsidiarily supports the slide rail 105. Particularly, in the second subsidiary supporting body 115, one end of the reciprocation manipulation shaft 109 is rotatably supported.

The sliding table 106 is constituted of a plate body of a given size, wherein the first projection member 110 is projected downwardly on one end of the lower surface of the sliding table, and the second projection member 116 is also projected downwardly on the other end of the lower surface of the sliding table. Still further in the first projection member 110 and the second projection member 116, insertion holes to which slide rails 105 are respectively inserted are formed, wherein the slide rails 105 are inserted into the insertion holes and hence, the sliding table 106 is mounted to the slide rail 105 so that the slide table 106 can be slidable along the slide rail 105.

A twisting motor 107 is fixedly mounted on one end of the sliding table 106 and on an output shaft of the twisting motor 107, a mounting metal fitting 117 to fix the metal body M3 is attached. In the mounting metal fitting 117, an insertion hole in which one end of the metal body M3 is inserted is formed.

The fixing support body 108 is erected on the other end of the sliding table 106 facing to the twisting motor 107, and particularly, the fixing support body 108 consists of a supporting frame 108*a* and a clutch mechanism portion 108*b* which is attached to the above-mentioned supporting frame.

In the clutch mechanism portion 108*b*, an insertion hole 108*c* in which the metal body M3 is inserted is formed wherein the metal body M3 is fixedly mounted to the rotary plate of the clutch mechanism portion 108*b* after being inserted through the insertion hole 108*c* and hence, by performing a switching operation of the clutch mechanism portion 108*b* between connected state and disconnected state, the metal body M3 is allowed to be switched between a non-rotatable state and a rotatable state.

On the upper surface of the sliding table 106, a first rotating support body 118 and a second rotating support body 119 which rotatably support the metal body M3 at a desired position are formed. The first rotating support body 118 is formed closer to the twisting motor 107, while the second rotating support body 119 is formed closer to the fixing support body 108.

Figure 24:
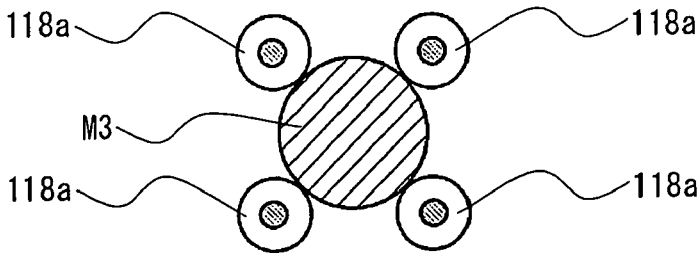
FIG. 24 is an explanatory view of an arrangement mode of guide rollers mounted on a first rotation support body.

On the upper portion of the first rotating support body 118 and the second rotating support body 119, four guiding rollers 118*a* and 119*a* are pivotally mounted in a rotatable manner while being extended in approximately parallel to the metal body M3 and as shown in FIG. 24, the constitution includes the guiding rollers 118*a* positioned in approximately equal distance around the metal body M3 so as to support the metal body M3.

The heating processing part 103 is arranged between the first rotating support body 118 and the second rotating support body 119, wherein particularly, the heating processing part 103 is constituted of a heating part 120 which lowers a deformation resistance by heating a part of the metal body M3 and a first cooling part 121 and a second cooling part 122 which are arranged on the both sides of the heating part 120 which is formed by heating of the heating part 120 and allows the low deformation resistance region to be a minimum region. The first cooling part 121 and the second cooling part 122 enlarge the deformation resistance by cooling the both sides of the low deformation resistance region respectively when the deformation resistance is lowered by heating and are used as forming means of a non-low deformation resistance region.

The heating part 120 in this embodiment, as shown in FIG. 23, consists of a high-frequency heating coil 123 wound around the metal body M3. Here, the heating part 120 is not limited to have a high-frequency heating coil 123 and heating can be also performed by using plasma, laser, electromagnetic induction body or a gas burner.

The first cooling part 121 and the second cooling part 122 respectively consist of spray nozzles 121*a* and 122*a* wherein water and air are supplied to the spray nozzles 121*a* and 122*a* and water is sprayed to the metal body M3 so that the metal body M3 is cooled. The first cooling part 121 is arranged closer to the twisting motor 107, while the second cooling part 122 is arranged closer to the fixing support body 108.

Cooling the metal body M3 by the first cooling part 121 and the second cooling part 122, and then configuring the low deformation resistance region formed by heating of the heating part 120 to a minimum region, it is possible to generate a large amount of shearing stress by configuring a twisting region generated on the metal body M3 to a minute width region as described later.

In order to spray water in the first cooling part 121 and the second cooling part 122, the heating processing part 103 is housed in the inside of a casing 124. Numeral 125 indicates a supporting column erected on the base body 104 to support a mounting table 126 for mounting the casing 124. In the casing 124 and the mounting table 126, water discharging passages 127 are formed to discharge water sprayed by the first cooling part 121 and the second cooling part 122 into the casing 124, wherein the constitution allows to discharge water stored in the lower portion of the casing 124 through the water discharge passage 127. In the constitution, water discharged from the water discharge passage 127 is received by a water discharge vessel 128 formed on the upper surface of the sliding table 106 and then the water is further discharged.

Also, in the inside of the casing 124, in order to prevent the sprayed water from the first cooling part 121 and the second cooling part 122 from being splashed on to the heating part 120, a waterproof casing 129 surrounding the heating part 120 is formed thereon.

On the waterproof casing 129, a temperature measuring sensor 130 to measure the temperature of the metal body M3 heated by the high-frequency heating coil 123 is attached. Particularly, in order to perform an accurate measuring with the temperature measuring sensor 130, an air supply pipe 131 is connected in communicating manner in the inside of the waterproof casing 129 and dry air is supplied. By supplying the dry air into the waterproof casing 129, it also becomes possible to prevent the water sprayed in the first cooling part 121 and the second cooling part 122 from intruding into the heating part 120.

A shearing stress is applied as follows by twisting the metal body M3 with the use of the above-mentioned STSP apparatus.

Firstly, a desired metal body M3 is inserted in the insertion hole of the mounting metal fitting 117 after sequentially passing through the insertion hole 108*c* mounted on the clutch mechanism portion 108*b* of the fixing support body 108, the second rotating support body 119, the high-frequency heating coil 123 in the inside of the casing 124, the first rotating support body 118 and then the metal body M3 is fixedly mounted by fastening a fixing bolt 32 mounted on the outside of the mounting metal fitting 117 and further, the metal body M3 is fixedly mounted on a rotary plate of the clutch mechanism portion 108*b* by a fixing bolt which is not shown in the drawing.

Subsequently, the metal body M3 is rotated in a desired rotational speed by operating the twisting motor 107. Here, the clutch mechanism portion 108*b* is in disconnecting state so that the metal body M3 is in a rotatable state to rotate the whole of the metal body M3. The rotational speed of the metal body M3 may be approximately 1 to 100 rpm. Here, the metal body M3 can be rotated in higher speed in some case.

Also, heating of the metal body M3 by the high-frequency heating coil 123 is started along with the start of the rotation of the metal body M3. It is possible to heat the metal body M3 uniformly by heating the metal body M3 while rotating.

When the metal body M3 reached at the given cooling starting temperature, spraying water from the spray nozzles 121*a* and 122*a* of the first cooling part 121 and the second cooling part 122 is started so as to cool the both sides of the deformation resistance region formed on the metal body M3.

Then, the metal body M3 is further heated by the high-frequency heating coil 123 so that the metal body M3 reaches at the twisting starting temperature which is higher than the cooling starting temperature, when the clutch mechanism portion 108*b* is set in a connecting state to allow one side of the metal body M3 to be in non-rotatable state.

Accordingly, while one side of the metal body M3 is in a non-rotatable state, the other side of the metal body M3 is in a rotatable state by the twisting motor 107 and hence, twisting can be generated in the low deformation resistance region of the metal body M3. Here, the twisting starting temperature is set higher than the recovery temperature or the recrystallization temperature of the metal of the metal body M3, however, it is preferable to control the temperature lower than the temperature which generates an influence on the metal crystalline particles to start becoming coarse.

Further, by operating the reciprocation manipulation motor 111 along with the clutch mechanism part 108*b* being set in a connecting state, the sliding table 106 is allowed to slide along the slide rail 105 and hence, a forming position of the low deformation resistance region of the metal body M3 is moved.

Accordingly, a shearing stress can be applied continuously to the metal body M3 along the extending direction of the metal body M3. The moving speed of the sliding table 106 may be around 1 to 200 cm/min and in view of the rotating speed of the twisting motor 107, it is preferable to set the moving speed suitable to the metal body M3.

When the sliding table 106 has moved for a given distance, heating by the high-frequency heating coil 123 is stopped and then the sliding table 106 is returned to the initial position using the reciprocation motor 111 having reversely rotated.

Then, when the temperature of the metal body M3 is lowered to a given temperature, spray of the water from the spray nozzles 121*a* and 122*a* of the first cooling part 121 and the second cooling part 122 is stopped and hence, the metal body M3 is taken out from the STSP apparatus.

In the above-mentioned embodiment, shearing stress is applied only on the approaching route of the sliding table 106 which is reciprocated by the reciprocate manipulation motor 111 by twisting the metal body M3, however, twisting of the metal body M3 may be also performed on the returning route of the sliding table 106, and further, in such a condition, the rotating direction of the twisting motor 107 can be reversed. Furthermore, by reciprocating the sliding table 106 for several times, shearing stress can be repeatedly applied to the metal body M3.

In the above-mentioned STSP apparatus, the high-frequency heating coil 123 of the heating part 120 can be wound such that the distance from the metal body M3 is set approximately uniform. When the high-frequency heating coil 123 of the heating part 120 is wound such that the distance from the metal body M3 is not set approximately uniform, the heated center of the metal body M3 by the high-frequency heating coil 123, that is, the mostly heated portion can be positioned in a deflecting direction from the rotation axis of the metal body M3 rotated by the twisting motor 107, that is the twisting rotation axis of the low deformation resistance region and hence, sufficient shearing stress can be also applied to the metal of the rotation axis and therefore, it is possible to allow the metal structure of the metal body M3 to uniformly have a finer grain structure.

Also, it is possible to apply sufficient shearing stress to the metal of the rotation axis portion for twisting by forming a vibrating means which vibrates the metal body M3 along the direction substantially orthogonal to the extending direction of the metal body M3 on at least either one of the first rotating support body 118 or the second rotating support body 119. Therefore, it is possible to allow the metal body M3 to have a uniformly finer metal structure. As a vibrating means, a vibrator may simply be attached either to the first rotating support body 118 or to the second rotating support body 119.

Still further, in the inside of the casing 124, a given reaction film may be formed on the surface of the non deformation resistance region by supplying an active gas such as nitrogen gas or methane gas and/or carbon monoxide gas or the like.

Particularly, by forming the high pressure atmosphere in the inside of the casing 124 with an active gas or the like, it can be expected to improve the fining efficiency of the metal structure due to the applying a high pressure to the low deformation resistance region.

Alternatively, the non deformation resistance region can be formed in a liquid after pouring a liquid into the inside of the casing 124. Here, spraying water from spray nozzles 21*a* and 22*a* is not necessary and concurrently it is possible to enhance the cooling efficiency of the metal body M3. In this case, it is also preferable to form the above-mentioned waterproof casing 129 and supply a given air therein so as to allow the metal body M3 to be heated without fail by the high-frequency heating coil 123.

Particularly, it is possible to form a given reaction film on the surface of the non deformation resistance region by applying an active gas such as nitrogen gas or methane gas and/or carbon monoxide gas in the inside of the waterproof casing 129.

Further, when a liquid is poured into the inside of the casing 124, a quenching is also being performed concurrently and hence, a given quenching or a cooling can be performed by adjusting the temperature of the liquid which is poured into the inside of the casing 124.

Here, bringing a forming guide body into contact with the non-heated part of the metal body M3, the metal structure may turn into finer grain structure and also enable to form the metal structure in a given configuration.

When the above-mentioned rotary processing part 102, the sliding table 106 which mounts this rotary processing part 102 and the sliding mechanism which slides the sliding table 106 are mounted in the inside of a chamber in a suitable form to be housed in the inside of the chamber of an electron beam irradiation device, it becomes possible to apply electron beam for heating the metal body and the metal body can be cooled by self-cooling effect of the metal body without using any cooling means and hence, the forming effect of the low deformation resistance region can be enhanced.

Hereinafter, an STSP apparatus of the third embodiment which is an improvement of the STSP apparatus of the second embodiment is explained. With the STSP apparatus of the third embodiment, it is possible to continuously process the metal body which is extended in an elongated manner in one direction.

Figure 25:
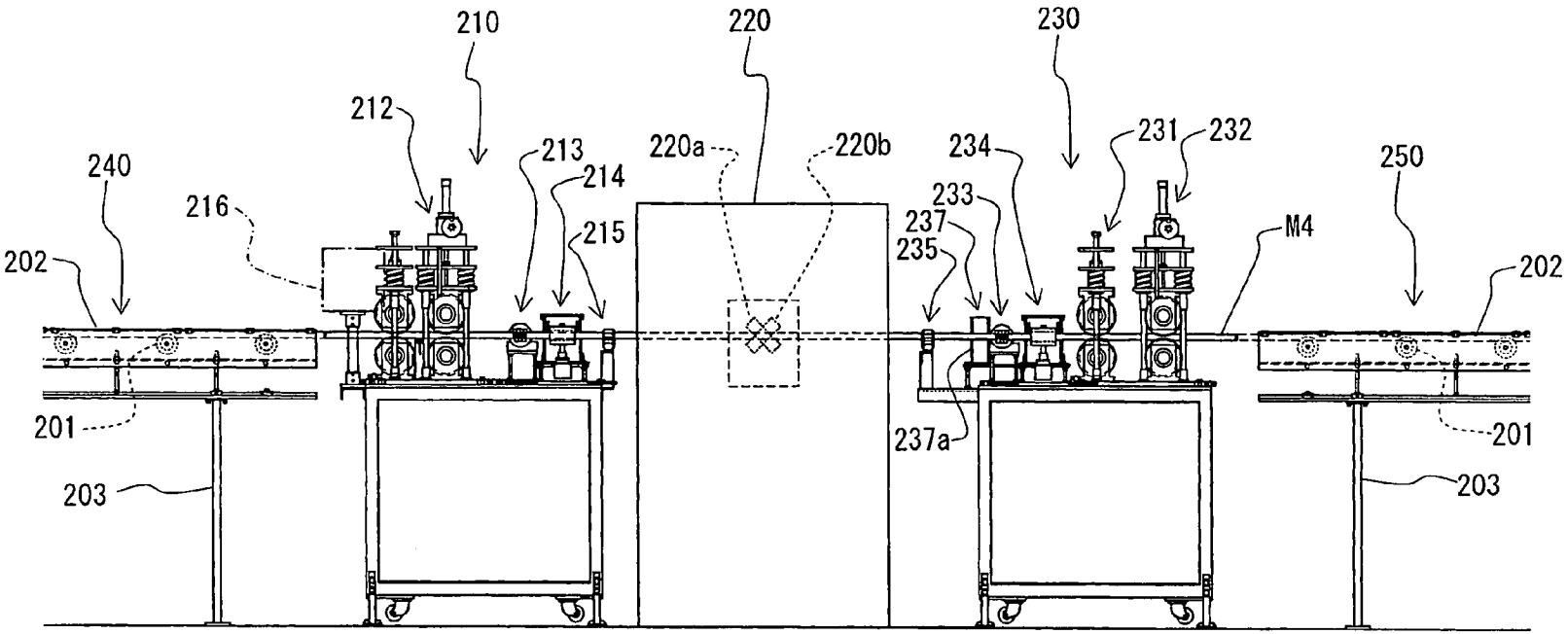
FIG. 25 is a schematic explanatory view of an STSP apparatus of a third embodiment.
Figure 26:
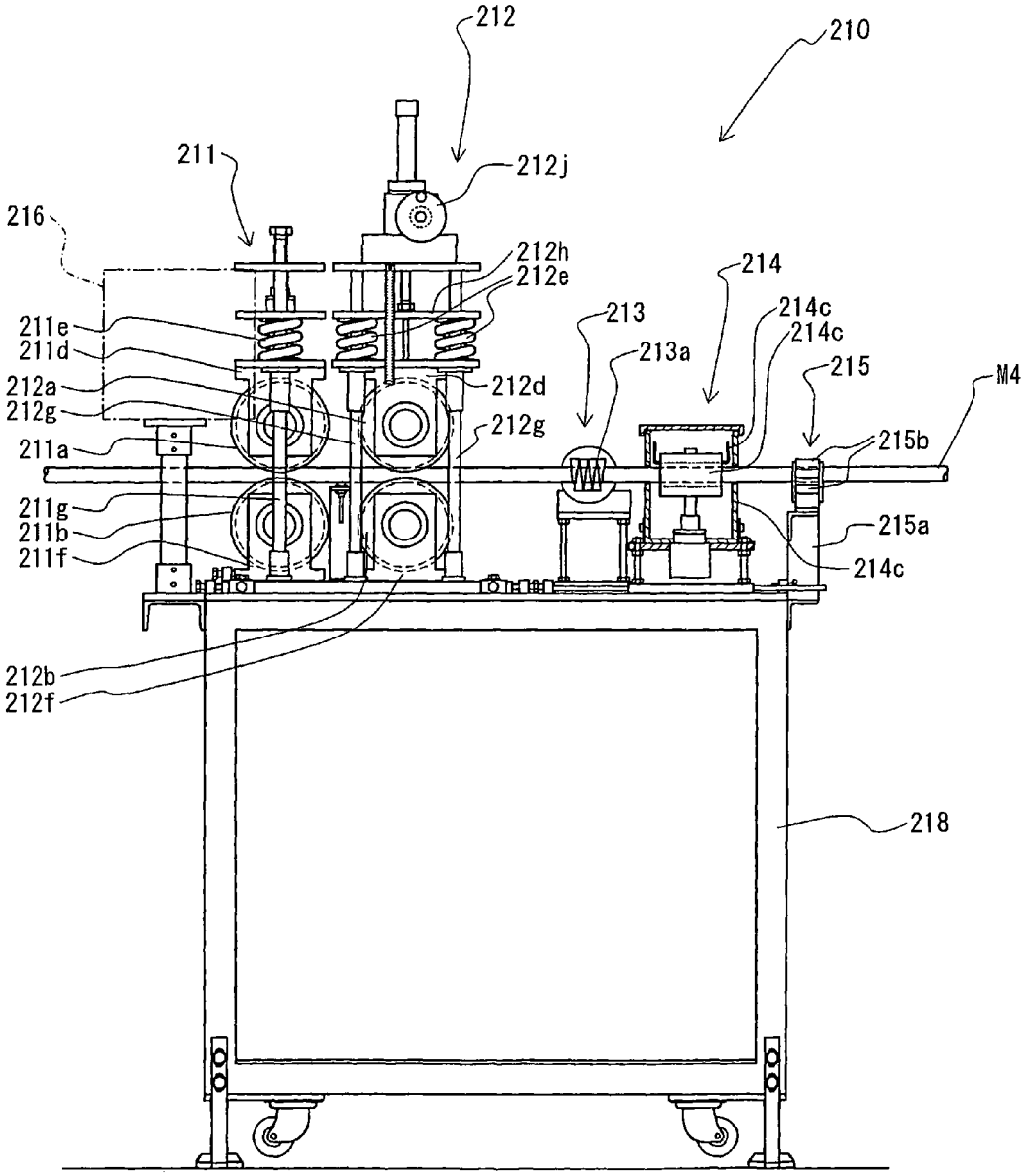
FIG. 26 is an enlarged view of an essential part in FIG. 25.
Figure 27:
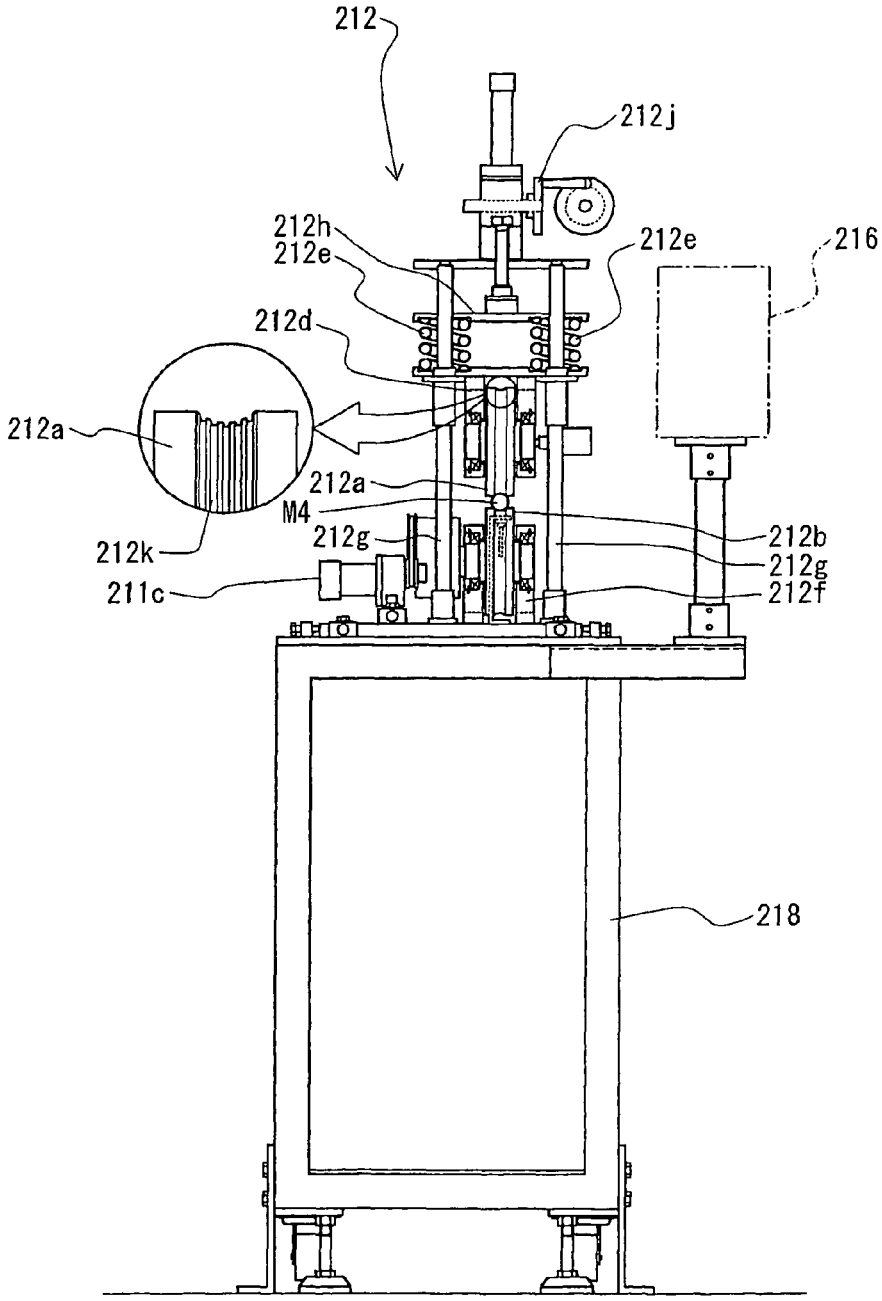
FIG. 27 is a side view of the essential part in FIG. 26.

FIG. 25 is a schematic explanatory view of the STSP apparatus of the third embodiment, FIG. 26 is an enlarged view of an essential part in FIG. 25, and FIG. 27 is a side view of a portion of the essential part.

The STSP apparatus of the third embodiment is configured to be interposed in the midst of the transport step of the metal body M4 which is extended in one direction in an elongated manner, wherein a first low deformation resistance region forming portion 210, a displacement imparting portion 220, and a second low deformation resistance region forming portion 230 are provided from the upstream side in the transport step of the metal body M4. In FIG. 25, numerals 240 and 250 respectively indicate transport guide portions, wherein a guide frame 202 which mounts guide rollers 201 thereon at a given interval is positioned at a desired height using a support strut 203.

The first low deformation resistance region forming portion 210 is constituted by arranging a pair of first feeding rollers 211 which feed the metal body M4, a pair of first transport suppression rollers 212 which suppress the transporting of the displacement applied to the metal body M4 by the displacement imparting portion 220 on a later stage, a first heater 213 which forms a first low deformation resistance region by heating the metal body M4, and a first cooler 214 which cools side peripheries of the first low deformation resistance region formed by the first heater 213 so as to increase the deformation resistance of the metal body M4 along the feeding direction of the metal body M4. In FIG. 25 to FIG. 27, numeral 215 indicates first feeding guide of the metal body M4, and numeral 216 indicates a control portion 230 which controls the first low deformation resistance region forming portion 210 the displacement imparting portion 220, and the second low deformation resistance region forming portion 230.

Further, the second low deformation resistance region forming portion 230 is constituted by arranging a second feeding guides 235 of the metal body M4, a second heater 233 which forms a second low deformation resistance region by heating the metal body M4, a second cooler 234 which cools side peripheries of the second low deformation resistance region formed by the second heater 233 so as to increase the deformation resistance of the metal body M4, a pair of second feeding rollers 231 which feed the metal body M4, and a pair of second transport suppressing rollers 232 which suppress the transfer of the displacement applied to the metal body M4 by the displacement imparting portion 220 in the preceding stage along the feeding direction of the metal body M4.

Particularly, in the second low deformation resistance region forming portion 230, to set a width of the second low deformation resistance region formed by the second heater 233 to a given width, a third cooler 237 is provided between a feed guide 235 and a second heater 233.

In the first low deformation resistance region forming portion 210 and the second low deformation resistance region forming portion 230, the pair of first feeding rollers 211 and the pair of the second feeding rollers 231 have the identical constitution, the pair of the first transport suppressing rollers 212 and the pair of the second transport suppressing rollers 232 also have the identical constitution, the first heater 213 and the second heater 233 also have the identical constitution, the first cooler 214 and the second cooler 234 also have the identical constitution, and the first feeding guide 215 and the second feeding guide 235 also have the identical constitution, wherein the first low deformation resistance region forming portion 210 and the second low deformation resistance region forming portion 230 only differ in the arrangement of these parts.

Hereinafter, the first low deformation resistance region forming portion 210 is explained in conjunction with FIG. 26 and FIG. 27.

The first low deformation resistance region forming portion 210 is constituted by sequentially arranging the pair of first feeding rollers 211, the pair of first transport suppression rollers 212, the first heater 213, the first cooler 214, and the first feeding guide 215 on a base frame 218 having a rectangular frame shape along the feeding direction of the metal body M4.

The pair of first feeding rollers 211 is configured to clamp the metal body M4 between an upper feeding roller 211*a* which is arranged on an upper side of the metal body M4 and a lower feeding roller 211*b* which is arranged on a lower side of the metal body M4. As shown in FIG. 27, by rotating the lower feeding roller 211*b* by means of a drive motor 211*c* which is interlockingly connected with the lower feeding roller 211*b*, it is possible to feed the metal body M4 which is clamped between the upper feeding roller 211*a* and the lower feeding roller 211*b*.

Particularly, with respect to the upper feeding roller 211*a*, by biasing an upper feeding roller support body 211*d* which mounts the upper feeding roller 211*a* thereon downwardly using a first biasing spring 211*e*, the metal body M4 is clamped between the upper feeding roller 211*a* and the lower feeding roller 211*b* with a given pressure. In FIG. 26, numeral 211*f* indicates a lower feeding roller support body which mounts the lower feeding roller 211*b* thereon, and numeral 211*g* indicates a first support strut which supports the upper feeding roller support body 211*d* above the lower feeding roller support body 211*f*.

Here, in this embodiment, the metal body M4 is formed of a round rod body having a circular cross section which extends in one direction and contact surfaces of the upper feeding roller 211*a* and the lower feeding roller 211*b* with the metal body M4 are recessed in an arcuate shape.

The pair of first transport suppression rollers 212 is configured to clamp the metal body M4 between an upper suppression roller 212*a* which is arranged on an upper side of the metal body M4 and a lower suppression roller 212*b* which is arranged on a lower side of the metal body M4.

Particularly, with respect to the upper suppression roller 212*a*, by biasing an upper suppression roller support body 212*d* which mounts the upper suppression roller 212*a* thereon downwardly using a second biasing spring 212*e*, the metal body M4 is clamped between the upper suppression roller 212*a* and the lower suppression roller 212*b* with a given pressure. In FIG. 26, numeral 212*f* indicates a lower suppression roller support body which mounts the lower suppression roller 212*b* thereon, and numeral 212*g* indicates a second support strut which supports the upper suppression roller support body 212*d* above the lower suppression roller support body 212*f*.

The pair of first transport suppression rollers 212 can be elevated or lowered by manipulating an elevation plate 212*h* which is brought into contact with an upper portion of the second biasing spring 212*e* using an elevation manipulation handle 212*j*. By adjusting the height of the elevation plate 212*h*, it is possible to adjust a clamping force of the metal body M4 by the upper suppression roller 212*a* and the lower suppression roller 212*b*.

Contact surfaces of the upper suppression roller 212*a* and the lower suppression roller 212*b* with the metal body M4 are also recessed in an arcuate shape in the same manner as the contact surfaces of the upper feeding roller 211*a* and the lower feeding roller 211*b* with the metal body M4. Particularly, with respect to the upper suppression roller 212*a* and the lower suppression roller 212*b*, in contact surfaces thereof with the metal body M4, a plurality of engaging grooves 212*k* are formed along peripheral surfaces thereof thus preventing the rotation of the metal body M4 at the pair of first transport suppression rollers 212 along with the rotation of the metal body M4 about a rotary axis substantially parallel to the extending direction of the metal body M4 which is imparted to the metal body M4 by the displacement imparting portion 220 as described later.

Here, the pair of first transport suppression rollers 212 may be provided in plural pairs when necessary thus reliably preventing the rotation of the metal body M4 at the pair of first transport suppression rollers 212.

The first heater 213 may be constituted of a high frequency heating coil 213*a* which is wound around the metal body M4. Here, the first heater 213 is not limited to the high frequency heating coil 213*a* and may adopt heating which uses plasma, laser, electromagnetic induction or the like or heating by a gas burner.

The first cooler 24 is constituted of a cylindrical water blow-off pipe 214*a* which forms a plurality of blow-off openings in an inner surface thereof and a water supply pipe 214*b* which supplies water to the blow-off pipe 214*a*. In FIG. 26, numeral 214*c* indicates a casing which prevents the splashing of water blown off from the blow-off pipe 214*a*.

The first feeding guide 215 rotatably and pivotally mounts four guide rollers 215*b* on an upper portion of a rotation support body 215*a* in a state that four guide rollers 215*b* respectively extend substantially parallel to the metal body M4 and has the substantially same constitution as the first rotation support body 118 shown in FIG. 24.

The first low deformation resistance region forming portion 210 has the above-mentioned constitution and, when necessary, a cooler similar to the first cooler 214 may be provided between the pair of first transport suppression rollers 212 and the first heater 213 so as to cool the metal body M4 thus preventing the heat which heats the metal body M4 using the first heater 213 from being transferred to the pair of first transport suppression rollers 212 portion.

The second low deformation resistance region forming portion 230 only differs in the arrangement of the pair of first feeding rollers 211, the pair of first transport suppression rollers 212, the first heater 213, the first cooler 214 and the first feeding guide 215 from the first low deformation resistance region forming portion 210 as mentioned above and hence, the explanation thereof is omitted. Here, a third cooler 237 of the second low deformation resistance region forming portion 230 directly ejects water supplied from the water supply pipe to the metal body M4 without using the water blow-off pipe 214*a* of the first cooler 214. In FIG. 25, numeral 237*a* is a casing for preventing the splashing of water in the third cooler 237.

The displacement imparting portion 220 is, in this embodiment, constituted of a rotating equipment which rotates the metal body M4 about a rotary axis parallel to the extending direction thereof, wherein the metal body M4 is clamped between the first rotating roller 220*a* and the second rotating roller 220*b* so as to rotate the metal body M4.

Particularly, the first rotating roller 220*a* and the second rotating roller 220*b* have respective axes thereof intersected at given angles with respect to the extending direction of the metal body M4 and hence, the metal body M4 can be fed along the extending direction while rotating the metal body M4.

In the above-mentioned STSP apparatus, the first low deformation resistance region and the second low deformation resistance region are formed by heating the metal body M4 by the first heater 213 in the first low deformation resistance region forming portion 210 and the second heater 233 in the second low deformation resistance region forming portion 230 respectively while feeding the metal body M4 in the extending direction and, thereafter, the first low deformation resistance region and the second low deformation resistance region are respectively deformed by shearing by rotating the metal body M4 in the non-low deformation resistance region sandwiched by the first low deformation resistance region and the second low deformation resistance region using the displacement imparting portion 220.

In this embodiment, although the metal body M4 is rotated in the displacement imparting portion 220, the metal body M4 may be vibrated by bringing a suitable ultrasonic vibration device or the like into contact with the metal body M4.

In this manner, by forming the first low deformation resistance region and the second low deformation resistance region on the metal body M4 extended in one direction in a spaced-apart manner with a given distance therebetween and, at the same time, by imparting the given displacement motion to the non-low deformation resistance region portion between the first low deformation resistance region and the second low deformation resistance region, it is possible to turn the metal structure into the finer grain structure during the transport step of the metal body M4.

Further, a heating device for aging treatment may be provided in a stage succeeding the second low deformation resistance region so as to perform the aging treatment in which the metal body M4 is heated at a given aging temperature.

Alternatively, a suitable forming device, for example, a rolling device, a drawing device or the like may be provided to perform the plastic forming of the metal body M4 to the stage succeeding the second low deformation resistance region forming portion 230.

Particularly, when the metal body M4 is formed of the hollow cylindrical body, a planar metal body may be formed by cutting and opening the metal body M4 in a stage succeeding the second low deformation resistance region forming portion 230 along the extending direction. Due to such a constitution, it is possible to extremely easily manufacture the planar metal body having the finer metal structure.

Figure 28:
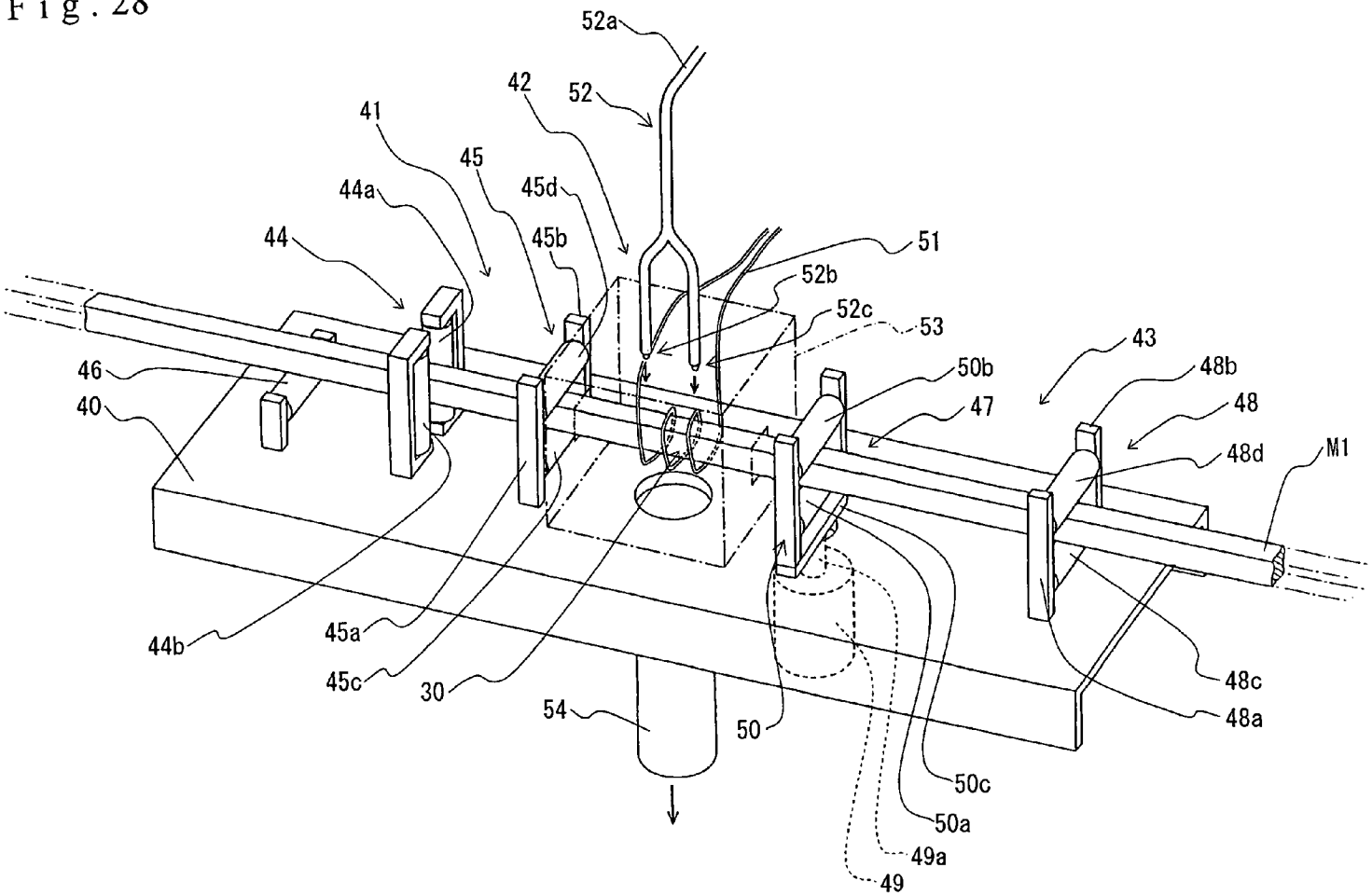
FIG. 28 is a schematic explanatory view of the SVSP apparatus.

FIG. 28 shows an apparatus which deforms by shearing the low deformation resistance region formed in the metal body by vibration. The method which turns the metal structure into the finer grain structure by deforming the low deformation resistance region by shearing by vibration is referred to as a SVSP (Severe Vibration Straining Process) by the inventors of the present invention and FIG. 28 is a schematic explanatory view of one example of a SVSP apparatus. Here, for facilitating the explanation of the invention, although the metal body M1 is formed of an angular rod body which extends in one direction, the metal body M1 may have other shape The SVSP apparatus includes a fixing portion 41, a shearing deformation portion 42, and a vibration portion 43 which are mounted on a base 40 along the extending direction of the metal body M1.

The fixing portion 41 includes a first restricting body 44 and a second restricting body 45 along the extending direction of the metal body M4. The first restricting body 44 restricts the movement in the widthwise direction of the metal body M1 which is fed along the extending direction, and the second restricting body 45 restricts the movement in the thickness direction of the metal body M1 which is fed along the extending direction thus fixing the metal body M1 in a reciprocating manner.

That is, in the first restricting body 44, the metal body M1 is fixed by a first contact roller 44*a* and a second contact roller 44*b* which are respectively rotatably supported on support bodies.

Further, in the second restricting body 45, between a first support body 45*a* and a second support body 45*b* which are mounted in an erected manner with the metal body M1 therebetween, a lower roller 45*c* which is positioned below the metal body M1 and an upper roller 45*d* which is positioned above the metal body M1 are extended in a rotatable manner, and the metal body M1 is fixed by the lower roller 45*c* and the upper roller 45*d*.

Here, the lower roller 45*c*, the upper roller 45*d* as well as the first contact roller 44*a* and the second contact roller 44*b* of the first restricting body 44 may be respectively rotated by suitable drive devices thus constituting a feeding mechanism which feeds the metal body M1. In FIG. 28, numeral 46 indicates a guide roller which supports the feeding of the metal body M1

The vibration portion 43 includes a vibration imparting body 47 and a vibration propagation suppression body 48 along the extending direction of the metal body M1. The given vibrations are applied to the metal body M1 in the vibration imparting body 47, while the propagation of the vibration imparted to the metal body M1 in the vibration imparting body 47 along the metal body M1 is suppressed in the vibration propagation suppression body 48.

The vibration imparting body 47 is formed of an ultrasonic vibration body 49 which is positioned below the metal body M1 and a propagation body 50 which is mounted on an output shaft 49*a* of the ultrasonic vibration body 49. The propagation body 50 is constituted by rotatably mounting a lower roller 50*a* which is positioned below the metal body M1 and an upper roller 50*b* which is positioned above the metal body M1 on a U-shaped support frame 50*c* in an extending manner, wherein the metal body M1 is clamped by the lower roller 50*a* and the upper roller 50*b*.

Further, the propagation body 50 is vibrated at a given amplitude and with a given frequency by operating the ultrasonic vibration body 49 thus vibrating the metal body M1 in the vertical direction. In this embodiment, although the vibratory motion is generated by the ultrasonic vibration body 49, the vibratory motion may be generated by a device other than the ultrasonic vibration body 49 such as a linear motor, a piezoelectric actuator or a cam mechanism in a simplified case.

Figure 29:
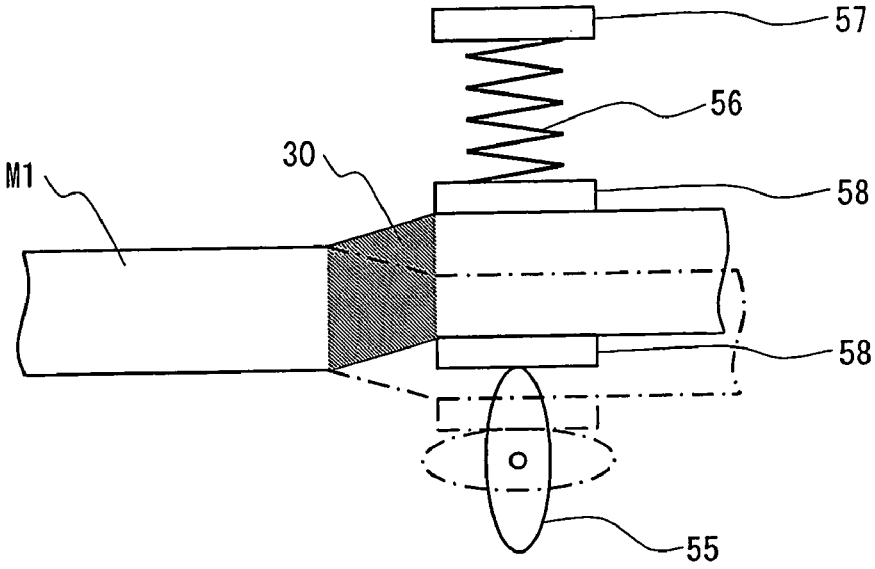
FIG. 29 is a schematic explanatory view of a modification in the SVSP apparatus.

For example, the vibration device which is formed of a cam mechanism is, as shown in FIG. 29, constituted such that, as described later, in the vicinity of the low deformation resistance region 30 formed in the metal body M1, an elliptical cam 55 is formed on one side surface of the metal body M1 and, at the same time, a follower resilient body 56 which is constituted of a spring or the like is formed on another surface side, wherein the metal body M1 is clamped between the elliptical cam 55 and the follower resilient body 56 and the metal body M1 receives the vibratory motion due to the rotational motion of the elliptical cam 55. In FIG. 23, numeral 57 indicates a fixing body for the follower resilient body 56 and numeral 58 indicates a support plate which is directly brought into contact with the metal body M1 and allows the metal body M1 to perform the stable vibration. Here, the cam is not limited to the elliptical cam 55 and may be formed of a cam having a suitable shape such as a polygonal cam.

It is sufficient that the amplitude of the vibrations applied to the metal body M1 using the ultrasonic vibration body 49 is at a level which can turn the metal structure in the low deformation resistance region 30 portion which is formed in the metal body M1 into the finer grain structure by shearing deformation as described later. Basically, the necessary minimum amplitude can be determined based on the particle size of the metal structure of the metal which forms the metal body M1 and the width size in the extending direction of the metal body M1 in the low deformation resistance region 30.

With respect to the amplitude of the vibrations generated by the ultrasonic vibration body 49, although the larger the amplitude of the vibrations, the metal structure can be turned into further finer grain structure, when the amplitude of the vibrations is large, there exists a possibility that the deformation which makes the restoration impossible is generated in the low deformation resistance region 30. Accordingly, it is desirable that the metal body M1 is vibrated with the maximum amplitude which does not generate the deformation which makes the restoration difficult in the low deformation resistance region 30.

Here, the deformation which does not make the restoration difficult is the deformation which allows the low deformation resistance region 30 to restore the shape before the vibrations in the vibrations of a half cycle, while the deformation which makes the restoration difficult is the deformation which does not allow the low deformation resistance region 30 to restore the shape before the vibrations in the vibrations of the half cycle.

It is necessary that the frequency of the vibrations applied to the metal body M1 by the ultrasonic vibration body 49 is the frequency which can apply a strain attributed to the displacement different from the preceding displacement, that is, the displacement in the direction opposite to or different from the preceding displacement before the strain attributed to the displacement generated in the low deformation resistance region 30 by the vibrations is eliminated by the cancellation action of the strain of the metal body M1 or is eliminated by the recrystallization of the metal structure. It is desirable to set the frequency as large as possible. Here, the vibrations applied to the metal body M1 is not always limited to a case in which the high frequency vibrations are applied to the metal body M1 but also are applied to a case in which only the vibrations corresponding to only the half cycle is applied to the low deformation resistance region 30 thus applying the vibrations of low frequency only for a short period.

Here, the low frequency is the frequency of the vibrations which sets the longest time which allows the vibrations of the low frequency to generate the strain of the next displacement until, with respect to the strain attributed to the displacement generated in the low deformation resistance region 30, the cancellation action of the strain of the above-mentioned metal body M1 or the recrystallization action of the metal structure is started to a ¼ cycle.

Here, to perform the shearing deformation of the low deformation resistance region 30 more efficiently, it is desirable that not only the metal body M1 is fixed by the first restricting body 44 but also the metal body M1 is fixed by making use of inertia of the metal body M1 per se. Accordingly, it is desirable that the vibration applying condition which allows the fixing using inertia is selected by applying the vibrations under conditions corresponding to the metal body M1 processed by the SVSP apparatus.

The vibration propagation suppression body 48 has the same constitution as the above-mentioned second restricting body 45, wherein between a first support body 48*a* and a second support body 48*b* which are mounted in an erected manner with the metal body M1 therebetween, a lower roller 48*c* which is positioned below the metal body M1 and an upper roller 48*d* which is positioned above the metal body M1 are extended in a rotatable manner, and the metal body M1 is fixed by the lower roller 48*c* and the upper roller 48*d* thus suppressing the propagation of the vibrations applied to the metal body M1 by the vibration imparting body 47 along the metal body M1.

The shearing deformation portion 42 is formed of a heating device 51 which heats the metal body M1 at a given temperature and a cooling device 52 which cools the metal body M1 for suppressing the low deformation resistance region 30 which is formed in the metal body M1 by heating the heating device 51 within a given width.

In this embodiment, a high-frequency heating coil is used as the heating device 51, wherein the heating device 51 is formed by winding the high-frequency heating coil given turns around the metal body M1 and heats the metal body M1 to the given temperature to reduce the deformation resistance thus forming the low deformation resistance region 30. Here, the heating device 51 is not limited to the high-frequency heating coil and may adopt heating which uses electron beams, plasma, laser, electromagnetic induction or the like, heating by a gas burner, or heating using electric short-circuiting. Particularly, when the electron beams are used as the heating device 51, a width of the low deformation resistance region 30 in the extending direction of the metal body M1 can be set to an extremely small value and hence, it is possible to apply a larger shearing stress to the low deformation resistance region 30 whereby the metal structure can be turned into the further finer grain structure.

The cooling device 52 is formed of a first water discharge opening 52*b* and a second water discharge opening 52*c* which discharge water supplied from a water supply pipe 52*a* and the metal body M1 is cooled by water discharged from the first water discharge opening 52*b* and the second water discharge opening 52*c*. In FIG. 28, numeral 53 indicates a water receptacle which receives water discharged from the first water discharge opening 52*b* and the second water discharge opening 52*c*, and numeral 54 indicates a water discharge pipe which is connected to the water receptacle 53.

In the cooling device 52, both sides of the low deformation resistance region 30 which is formed by the heating device provided between the first water discharging opening 52*b* and the second water discharging opening 52*c* are cooled by water discharged from the first water discharging opening 52*b* and the second water discharging opening 52*c*. Particularly, by adjusting the arrangement position of the first water discharging opening 52*b* and the second water discharging opening 52*c*, the low deformation resistance region 30 is set to an extremely minute region compared with the length of the metal body M1 in the extending direction.

By setting the low deformation resistance region 30 to the extremely minute width in the extending direction of the metal body M1 in this manner, an extremely large shearing deformation is liable to be easily generated in the portion of the low deformation resistance region 30 and hence, the efficiency to turn the metal structure into the finer grain structure can be enhanced. Further, it is possible to reduce the residual strain of the shearing deformation or the residual deformation attributed to the vibratory motion.

Further, the quench hardening is applied to the low deformation resistance region 30 heated by the heating device 51 by quenching the low deformation resistance region 30 by the cooling device 52, it is possible to enhance the hardness of the metal body M1 whose metal structure is turned into the finer grain structure.

Cooling of the metal body M1 is not limited to the cooling by water and may be cooling by air. Further, cooling may be excitation cooling. Any cooling method can be used provided that the method can enhance the deformation resistance of the metal body M1.

As the heating device 51 and the cooling device 52, various heating means and cooling means can be used in the same manner as the heating device 64 and the cooling device 65 of the above-mentioned STSP apparatus.

In this embodiment, although the cooling device 52 is provided between the second restricting body 45 and the heating device 51 formed of the high frequency heating coil and cooling device 52 is provided between the heating device 51 and the vibration imparting body 47, the second restricting body 45 and the vibration imparting body 47 may be arranged closer to the heating device 51 than the cooling device 52 thus making the distance between the second restricting body 45 and the vibration imparting body 47 as short as possible.

By making the distance between the second restricting body 45 and the vibration imparting body 47 as short as possible in this manner, it is possible to prevent the energy of vibrations applied to the metal body M1 by the vibration imparting body 47 from being scattered to portions other than the low deformation resistance region 30 and hence, the shearing deformation of the low deformation resistance region 30 attributed to the energy of vibrations can be efficiently generated.

Further, by imparting a cooling function to the lower roller 45*c* and the upper roller 45*d* of the second restricting body 45 which clamp the metal body M1 and the lower roller 50*a* and the upper roller 50*b* of the propagation body 50 in the vibration imparting body 47, it may be also possible to clamp and cool the metal body M1 using these rollers 45*c*, 45*d*, 50*a*, 50*b*.

In the SVSP apparatus having the above-mentioned constitution, when the metal structure is turned into the finer grain structure by the vibratory motion, the metal body M1 is sequentially fed through the fixing portion 41, the shearing deformation portion 42 and the vibration portion 43, and the metal body M1 is heated by the heating device 51 while cooling both sides of the low deformation resistance region 30 using the cooling device 52 at the shearing deformation portion 42 thus forming the low deformation resistance region 30.

Here, the heating using the heating device 51 is performed until the temperature of the low deformation resistance region 30 is elevated to the softening temperature which can restore the strain generated in the metal body M1 or the recrystallization temperature of the metal structure and, when the temperature of the low deformation resistance region 30 is elevated to the restoration or recrystallization temperature, the non-low deformation resistance regions of the metal body M1 are vibrated by the vibration imparting body 47 thus generating the shearing deformation in the low deformation resistance region 30. Here, although the heating temperature of the metal body M1 attributed to the heating device 51 is equal to or more than the restoration or recrystallization temperature, it is desirable to control the heating temperature of the metal body M1 to a temperature at which the influence of the coarse growth of the crystal grains starts to be generated.

In this manner, by deforming the low deformation resistance region 30 by shearing, it is possible to turn the metal structure into the finer grain structure while hardly generating the change of the profile shape of the metal body M1.

Here, in this embodiment, the vibration imparting body 47 vibrates the non-low deformation resistance region of the metal body M1 in the vertical direction, that is, in the thickness direction of the metal body M1. However, as mentioned above, the low deformation resistance region may be vibrated in the lateral direction, that is, in the width direction of the metal body M1 or may be vibrated by the composite vibration which is the combination of the vibration in the vertical direction and the vibration in the lateral direction. For this end, the vibration applying body 47 may have any suitable constitution.

Here, the vibration applied to the metal body M1 is not limited to the vertical direction or the lateral direction which is substantially orthogonal to the extending direction of the metal body M1. It is possible to use any vibration provided that the vibration at least includes the vibration in the vertical direction or in the lateral direction which is substantially orthogonal to the extending direction of the metal body M1 in vibration components thereof.

In the SVSP apparatus of this embodiment, as mentioned above, the shearing deformation is generated in the low deformation resistance region 30' by applying the vibratory motion from the vibration portion 43 and, at the same time, by feeding the metal body M1 in the extending direction, it is possible to displace the position of the low deformation resistance region 30 in the metal body M1. Accordingly, by continuously performing the shearing treatment by the vibratory motion on the metal body M1, it is possible to turn the metal structure into the finer grain structure over a wide range.

Particularly, since the low deformation resistance region 30 thoroughly traverses the metal body M1 which extends in one direction, along with the movement of the low deformation resistance region 30, it is possible to uniformly apply the shearing treatment to the metal body M1 and hence, it is possible to form the metal body M1 whose metal structure is turned into the substantially homogenous finer grain structure.

Further, in some cases, by adjusting the magnitude of the shearing stress generated due to the shearing deformation at a given position of the metal body M1, the degree of turning the metal structure into the finer grain structure is adjusted and hence, it is possible to adjust the strength or the ductility of the metal body M1 whereby it is possible to form the metal body M1 in which the strength or the ductility is partially enhanced.

In this embodiment, one end of the in which the low deformation resistance region 30 is formed is fixed and another end of the metal body M12 is vibrated. However, both sides of the metal body M12 which sandwich the low deformation resistance region 30 may be respectively vibrated with phases opposite to each other.

Further, when the SVSP apparatus is mounted on a post step portion of a given forming device which performs hot rolling, cold rolling or press forming on the metal body M1, it is possible to deform the metal structure of the metal body M1 which is stretched or drawn in the extending direction by the rolling treatment, the extrusion treatment or the like by shearing whereby the metal structure can be turned into the finer grain structure further easily.

In this manner, with the use of the above-mentioned SVSP apparatus and the STSP apparatus the low deformation resistance regions 30, 30' are locally formed in the metal body and, at the same time, the strong strain is applied to the low deformation resistance regions 30, 30' by deforming the low deformation resistance regions 30, 30' by shearing and hence, the metal structure is turned into the finer grain structure whereby it is possible to enhance the strength or the ductility of the metal body.

Further, as shown in FIG. 1, when the metal body is a stacked body 10 which is formed by laminating a plurality of metal layers, a metal which forms each metal layer is bonded to a metal forming a metal layer which is arranged next to the metal layer in a state that both metal layers are turned into the finer grain structure each other and hence, it is possible to form an integral metal body and, at the same time, it is possible to provide the metal body whose metal composition changes in the stacked layer direction of the metal layers.

Figure 30:
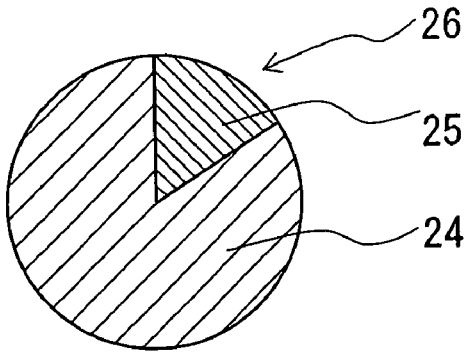
FIG. 30 is a cross-sectional schematic view of the metal body.

Alternatively, as shown in FIG. 30 which is a cross-sectional schematic view of the metal body, when a second metal material 25 is inserted into a notched portion of a first metal rod 24 having a notched round rod shape forming such a notched portion thus forming an integral composite metal rod 26 and the composite metal rod 26 is treated using the STSP apparatus, metal of the first metal rod 24 and metal of the second metal material 25 are mechanically mixed to each other and hence, a novel alloy can be formed.

Further, as shown in FIG. 2, when the metal body is a pre-baked body 16 of a mixed body which is formed by mixing plural kinds of metal powdery materials, by bonding metal structures of respective metal powdery material to each other while turning the metal structures into the finer grain structure, it is possible to form a densely integrated metal body.

Further, as shown in FIG. 3, when the metal body is a filling body 19 which is formed by filling a metal powdery material 18 in hole portions of a porous body, respective metals are bonded to each other in a state that the metal structures of the metals are turned into the finer grain structure and hence, an integral metal can be formed.

Further, as shown in FIG. 4, the metal body is formed of the metal wire bundle 23 which is formed by bundling plural kinds of metal wire materials, metal structures of respective metal powdery bodies are bonded to each other in a state that the metal structures are turned into the finer grain structure, and hence, it is possible to form a densely integral metal body. Particularly, even metals which cannot be bonded by a melting method can be bonded to each other using the SVSP apparatus and the STSP apparatus and hence, it is possible to form a novel alloy.

Particularly, when the metal body is held as a hollow cylindrical body until the metal structure of the metal body is turned into the finer grain structure using the SVSP apparatus or the STSP apparatus and, thereafter, the metal structure is turned into the finer grain structure by the SVSP apparatus or the STSP apparatus and a peripheral surface of the metal body formed in a cylindrical shape is cut and opened to have a planar body, it is possible to extremely easily provide a plate-like metal material whose metal structure is turned into the finer grain structure.

In the above-mentioned SVSP apparatus and the STSP apparatus, by adjusting a length of the low deformation resistance region in the extending direction of the metal body which is formed by the heating device and the shearing deformation which is applied to the low deformation resistance region, it is possible to perform the shearing deformation over the whole area of the low deformation resistance region 30. Alternatively, it is possible to perform the shearing deformation to a portion of the low deformation resistance region, for example, a center region of the low deformation resistance region, both end portions of low deformation resistance region or one end portion of the low deformation resistance region.

Further, the metal body in which the crystal structure of the low deformation resistance region is turned into the finer grain structure using the SVSP apparatus and the STSP apparatus may be, when necessary, subjected to quench hardening in a salt bath. In this case, by allowing the metal body to pass through the salt bath quench hardening device from the SVSP apparatus and the STSP apparatus, it is possible to efficiently form the metal body with an improved function.

Further, with respect to the metal body in which the crystal structure of the low deformation resistance region is turned into the finer grain structure by the SVSP apparatus and the STSP apparatus, by applying the plastic forming to the metal structure while preventing the metal structure from becoming coarse, it is possible to form the metal body whose metal structure is turned into the finer grain structure and hence possesses the high strength or the high ductility and which has a given shape.

Here, when the crystal structure of the low deformation resistance region is turned into the finer grain structure, as mentioned above, the temperature is set at a relatively low temperature which prevents the generation of large-sizing of the crystal grains which are turned into the finer grain structure as described above and hence, the temperature can be set lower than the forming temperature which is necessary in plastic forming in many cases.

Here, when the plastic forming is performed, the metal body is rapidly heated to a given forming temperature and the plastic forming is performed in a heating state for a short time which prevents the growth of the metal structure and hence, it is possible to suppress the growth of the metal structure in the plastic forming so as to suppress the obstruction which prevents the metal structure from have the high strength and the high ductility.

Further, the metal structure of the metal body is not quenched until a normal temperature after performing the plastic forming but the aging treatment is applied to the metal body while holding the metal structure of the metal body at a temperature which prevents the metal growth of the structure. Accordingly, it is possible to further enhance the metal body which obtains the high strength and the high ductility.

As mentioned above, in the metal body in which the metal structure thereof is turned into the finer grain structure, when the temperature of the metal body is higher than the recrystallization temperature of the metal body, the metal structure which is once turned into the finer grain structure is grown thus eliminating an advantageous effect obtained by turning the metal structure into the finer grain structure is eliminated. Accordingly, in turning the metal structure into the finer grain structure using the SVSP apparatus and the STSP apparatus, after the treatment performed using the SVSP apparatus and the STSP apparatus, it is desirable to prevent the treatment at a temperature equal to or higher than the temperature at which the metal structure is grown.

The metal body whose metal structure is turned into the finer grain structure as described above has high strength and hence, when the metal body is used as parts of an automobile, it is possible to reduce a weight of automobile and the mileage can be enhanced by reducing the weight of the automobile.

The metal body which is used for manufacturing parts of the automobile is manufactured as follows.

First, the pretreatment for the planar metal plate which has the desired composition is performed. In the pretreatment, the conversion of the metal plate into single phase by cooling the metal plate after temporarily heating the metal plate, the dispersion of particles of the metal which forms the metal plate, the adjustment of a residual stress in the metal plate and the like are performed.

Next, by processing the metal plate to which the pretreatment is applied using the SVSP method, the metal structure of the metal plate is turned into the finer grain structure uniformly and hence, the metal plate which possesses the high strength and the high ductility is formed.

Particularly, when the metal plate is made of an aluminum alloy, a large-sized aluminum alloy plate which possesses the high strength and the high ductility can be formed and hence, a hood, a cowl or the like which has a complicated shape can be formed by forging whereby a manufacturing cost can be largely reduced.

Particularly, when these hood, cowl and the like are formed by forging, flanges and the fitting structures which are used for connecting these parts with other parts are formed integrally and hence, a cost can be reduced by forming a plurality of parts integrally and, at the same time, the structural strength can be enhanced.

As described the above, by not only forming the metal plate into the desired metal body using the SVSP apparatus but also treating the round-rod-like metal body which has the desired composition using STSP apparatus after performing the above-mentioned pretreatment, the metal structure of the metal plate is turned into the finer grain structure uniformly and hence, the metal body which possess the high strength and the high ductility can be also formed.

The metal body which is formed as described the above possesses a high ductility. Accordingly, by performing the forging using a forging mold which has a plurality of cylinders after separating the metal body into parts having desired capacities respectively, for example, as shown in FIG. 31, it is possible to form a body frame socket 80 which has a complicated form.

Figure 31:
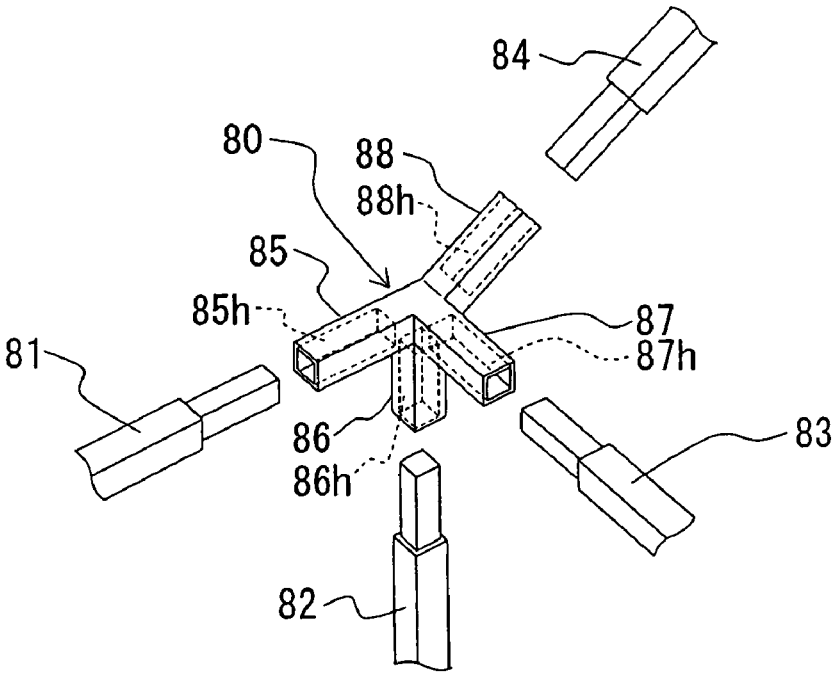
FIG. 31 is an explanatory view of a body frame socket.
Figure 32:
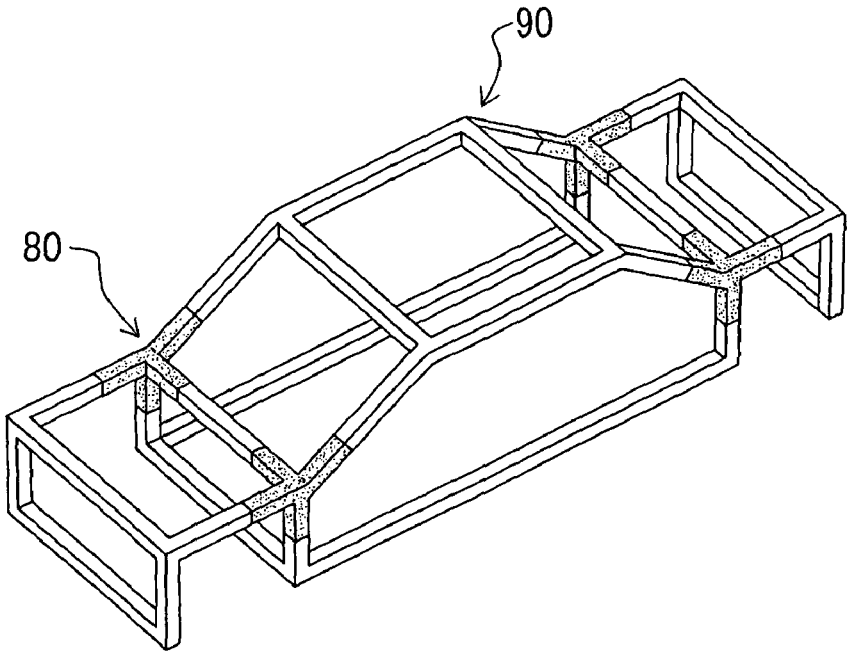
FIG. 32 is an explanatory view of the body frame socket.
Figure 33:
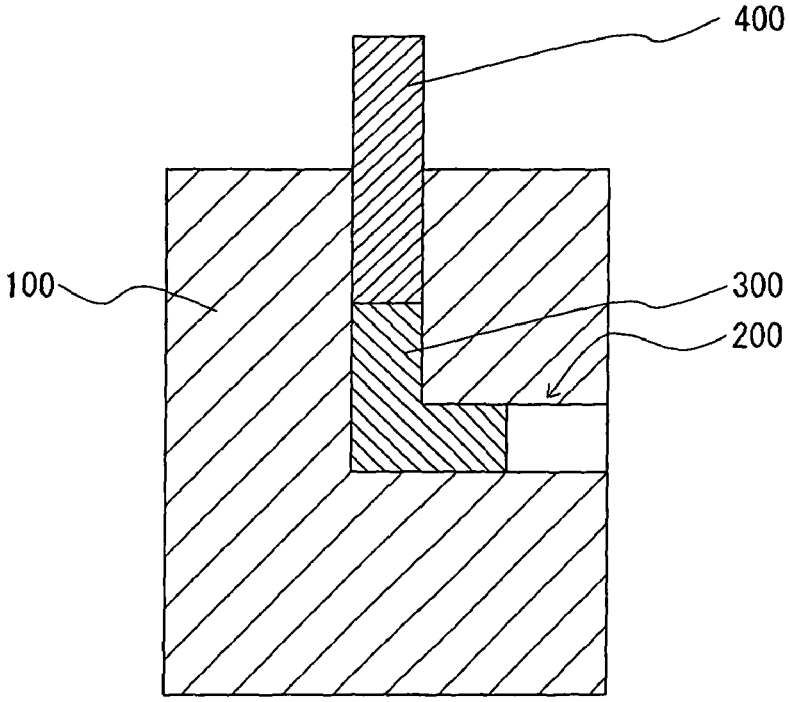
FIG. 33 is a reference view for explaining an ECAP method.

The body frame socket 80 of this embodiment is, as shown in FIG. 32, used to connect portions of respective frames used in the body frame of the automobile. Usually, the respective films are connected to each other by welding respective frames at the connecting portions. However, with the use of the body frame sockets 80 shown in FIG. 31, the welding operation becomes unnecessary and hence, the manufacturing cost can be reduced and, at the same time, the structural strength can be enhanced than welding whereby the reliability can be enhanced.

With respect to the body frame socket 80 shown in FIG. 31, a first fitting part 85, a second fitting part 86, a third fitting part 87 and a fourth fitting part 88 into which four frames 81, 82, 83, 84 of a first frame 81, a second frame 82, a third frame 83 and a forth frame 84 which extend in different directions respectively are inserted respectively, are extended and protruded in a given direction.

Further, insertion holes 85*h*, 86*h*, 87*h*, 88*h* which are formed on each fitting parts 85, 86, 87, 88 by inserting cylinders therein at the time of forging processing are formed and distal ends of respective frames 81, 82, 83, 84 are inserted into and are connected with these insertion holes 85*h*, 86*h*, 87*h*, 88*h*.

As another use mode, by applying the method for turning the metal structure into the finer grain structure using the SVSP method or the STSP method to a rod-like member such as a steering shaft, it is possible to provide a rod-like body which possesses the high strength. Further, without turning the whole metal structure of the rod-like body into the finer grain structure, it is possible to turn only a portion of the metal structure into the finer grain structure or not to turn only a portion of the metal structure into the finer grain structure thus intentionally imparting irregularities in strength of the metal structure.

In this manner, when the metal body is the steering shaft which is formed of the rod-like body having the intentional irregularities in strength, it is possible to impart the shock absorbing property to the steering shaft by allowing the steering shaft to be intentionally broken when an accident occurs.

Alternatively, in the case of forming the bolts, by performing the thread rolling using the rotation of the metal body using the SVSP method after turning the member of the rod-like body into the finer grain structure using the SVSP method, it is possible to form the screw which possess a high strength easily.

Similarly, in forming a transmission gear, the metal structure of the rod-like body member is turned into the finer grain structure using the SVSP method and, thereafter, gear teeth are formed on the rod-like body member using a desired die by making use of the rotation of the metal body of the SVSP method and hence, it is possible to easily form the transmission gear which possesses the high strength.

A metal body having the finer grain structure as described above is extremely useful not only when the metal body is applied to automobile parts but also when the metal body is applied as target materials for sputtering using a sputtering device in a process for manufacturing semiconductors.

Particularly, it is possible to produce the metal body having the desired composition and hence, the produced metal body can have the homogeneous composition, and at the same time, it is possible to form a homogeneous metal film having the finer metal structure on a semi-conductor substrate. Further, such a target material for sputtering can be produced at a cost than a cost for manufacturing the target material using the ECAP method.

The above-mentioned target material for sputtering is produced in a following manner.

First of all, the pretreatment is applied to a metal plate having the desired composition. In the pretreatment, the conversion of the metal plate into single phase by cooling the metal plate after temporarily heating the metal plate, the dispersion of particles of the metal which forms the metal plate, the adjustment of a residual stress in the metal plate and the like are performed.

Next, the metal plate which has already received the pretreatment is processed using the SVSP apparatus and hence, the metal structure of the metal plate is turned into the uniform finer grain structure.

After turning the metal structure into the finer grain structure using the SVSP apparatus, the crystal orientation of the metal structure is adjusted by allowing the metal plate to be subjected to the normal-temperature rolling, the cold rolling or the hot rolling or the swaging and, at the same time, the metal plate is formed into a target shape.

By adjusting the crystal orientation of the finer crystal structure, it is possible to provide the target for sputtering which can produce a homogeneous metal film on the semiconductor substrate.

Further, in forming the metal plate into the target shape, a metal body is formed in an approximately disc-like shape and a recessed groove for cooling is formed in a back side of the metal body. By forming the recessed groove for cooling simultaneously, the manufacturing steps of the target for sputtering can be shortened and hence, the target for sputtering can be produced at a lower cost.

Particularly, since the formability of the metal plate is enhanced due to the finer metal structure obtained by the use of the SVSP apparatus, the cooling recessed groove can be formed with accuracy by cold forging or hot forging.

Further, after turning the metal structure of the metal plate into the uniform finer metal structure using the SVSP apparatus, it is possible to adjust the residual stress by heating the metal plate to a temperature at which the metal crystal is prevented from becoming coarse.

Another manufacturing method can be performed in a following manner. In this manufacturing method, the metal body which constitutes a target material is a round metal rod having the desired composition.

First of all, the pretreatment is applied to the metal rod in the same manner as the metal plate described above. In the pretreatment, the conversion of the metal plate into single phase by cooling the metal plate after temporarily heating the metal plate, the dispersion of particles of the metal which forms the metal plate, the adjustment of a residual stress in the metal plate and the like are performed.

Next, the metal plate which has already received the pretreatment is processed using the STSP apparatus and hence, the metal structure of the metal rod is turned into the uniform finer grain structure.

After turning the metal structure of the metal rod into the finer grain structure using the STSP device, the metal rod is cut for every given length and metal plates are formed by cold forging or hot forging.

By processing the metal plate formed in this manner using the SVSP device, it is possible to turn the metal structure of the metal plate into the further finer grain structure. Thereafter, in the same manner as the above-mentioned metal plate, the crystal orientation of the metal structure is adjusted by allowing the metal plate to be subjected to the normal-temperature rolling, the cold rolling or the hot rolling or the swaging and, at the same time, the metal plate is formed into a target shape.

By producing the metal body which constitutes the target for sputtering using the STSP method and the SVSP method in a combined form, it is possible to form the metal body having the extremely finer grain structure and hence, it is possible to provide the target for sputtering which can produce a homogeneous metal film on an upper surface of the semiconductor substrate.

Particularly, by processing the metal rod using the STSP method, the homogenization of the composition of the metal rod can be realized and hence, the target for sputtering can be produced from the metal body having the more homogeneous metal structure and hence, it is possible to form the target for sputtering which can form the homogeneous metal film on the semiconductor substrate.

By applying the above-mentioned SVSP method and STSP method to following materials besides the automobile parts and the target for sputtering, it is possible to provide materials or parts which can enhance the properties of the materials or parts.

When a metal body is formed of a magnetic material, it is possible to enhance the formability by turning the metal structure of the metal body into the finer grain structure using the SVSP method or the STSP method. Further, in some cases, it is possible to expect the enhancement of the magnetic susceptibility.

When the metal body is formed of a shape memory alloy, the formability can be enhanced by turning the metal structure of the metal body into the finer grain structure using the SVSP method or the STSP method thus realizing the forming the metal body into a finer shape. Particularly, when bolts which are used for assembling electronic equipment are formed using the shape memory alloy, the electronic equipment can be easily dismantled by dissipating threads on the bolts at the time of scrapping the electric equipment by making use of the shape memory.

When the metal body is formed of a hydrogen storage alloy, the enhancement of a storage capacity of hydrogen can be expected by turning the metal structure of the metal body into the finer grain structure using the SVSP method or the STSP method. Further, since the formability is enhanced, the metal body can be formed into various shapes and hence, a structural body having a hydrogen storage function can be produced.

When the metal body is formed of a vibration suppressing alloy, the formability can be enhanced by turning the metal structure into the finer grain structure using the SVSP method or the STSP method thus realizing the forming the metal body into a finer shape.

When the metal body is formed of an electric heat material, the formability can be enhanced by turning the metal structure of the metal body into the finer grain structure using the SVSP method or the STSP method thus realizing the forming the metal body into a finer shape.

When the metal body is formed of a biological material, the formability can be enhanced by turning the metal structure of the metal body into the finer grain structure using the SVSP method or the STSP method thus realizing the forming the metal body into a finer shape.

Particularly, titanium which has been conventionally used as a biological material has a drawback that the formability is poor due to high hardness thereof thus pushing up a forming cost. However, by turning the metal structure into the finer grain structure using the SVSP method or the STSP method, it is possible to form titanium by forging and hence, titanium parts having desired shapes can be formed at a low cost.

Further, titanium whose metal structure is turned into the finer grain structure by using the SVSP method or the STSP method is a material which exhibits the high hardness and the low Young's modulus and hence the biological affinity can be enhanced.

In this manner, the metal body processed using the SVSP method or the STSP method not only can enhance the formability due to the enhanced ductility, but also can obtain the high hardness and hence, light-weighted members having the same strength as the conventional parts can be formed whereby the method can realize the reduction of weight of ships, airplanes, transportation equipments such as automobiles, and architectural structures such as high-rise buildings and bridges.

INDUSTRIAL APPLICABILITY

As described above, with the use of the method and the device for processing the metal body of the present invention, it is possible to extremely easily produce the metal body having the high strength and the high ductility and hence, the metal body having the high hardness and the high ductility can be provided at a low cost.

The invention claimed is:

1. A method for processing an elongated metal body, comprising:

moving the elongated metal body in an extending direction of the elongated metal body;

heating the elongated metal body locally up to a temperature for performing solution heat treatment of the elongated metal body thus forming a low deformation resistance region;

deforming the elongated metal body at the low deformation resistance region by twisting and spraying the elongated metal body, said twisting comprising twisting, the elongated metal body about a rotational axis of the elongated metal body arranged substantially parallel to the extending direction of the metal body by application of torsional force, said spraying comprising spraying water to the elongated metal body at each of two sides of the low deformation resistance region, so that a minute width along the extending direction is set in the low deformation region, and so that the elongated metal body is quenched at one of the two sides of the low deformation resistance region where the metal structure of the elongated metal body is turned into finer grain structure and an amount of addition elements placed in solid solution is increased; and performing aging treatment by maintaining the elongated metal body at a temperature which does not turn the metal structure into coarser grain structure after turning the metal structure of the elongated metal body into the finer grain structure.

2. A method for processing an elongated metal body, comprising:

moving the elongated metal body in an extending direction of the elongated metal body;

heating the elongated metal body locally up to a temperature for performing solution heat treatment of the elongated metal body thus forming a first low deformation resistance region;

deforming the metal body at the first low deformation resistance region by twisting and spraying the elongated metal body, said twisting comprising twisting the elongated metal body about a rotational axis of the elongated metal body arranged substantially parallel to the extending direction of the metal body by application of torsional force, said spraying comprising spraying water to the elongated metal body at each of two sides of the low deformation resistance region, so that a minute width along the extending direction is set in the low deformation region, and so that the elongated metal body is quenched at one of the two sides of the low deformation resistance region where the metal structure of the elongated metal body is turned into finer grain structure and an amount of addition elements placed in solid solution is increased;

heating the elongated metal body at the non-low deformation resistance region up to a temperature at which the recrystallization of metal structure is generated in the elongated metal body thus forming a second low deformation region, a temperature for forming the second low deformation region being lower than the temperature for forming the first low deformation resistance region;

deforming the elongated metal body at the second low deformation resistance region by twisting, and spraying water to the elongated metal body at each of two sides of the low deformation resistance region, so that a minute width along the extending direction is set in the low deformation region, and so that the elongated metal body is quenched at one of the two sides of the low deformation region turning the metal structure of the elongated metal body into further finer grain structure; and performing aging treatment by maintaining the elongated metal body at a temperature which does not turn the metal structure into coarser grain structure after turning the metal structure of the elongated metal body into finer grain structure.

3. A method for processing an elongated metal body according to claim 2, further comprising preheating the elongated metal body before heating the elongated metal body up to the temperature for performing solution heat treatment of the elongated metal body for forming the first low deformation resistance region.

4. A method for processing an elongated metal body according to claim 3, wherein a temperature of the preheating is set to the solution heat treatment temperature.

* * * * *